US008944479B2

(12) United States Patent
Muramatsu et al.

(10) Patent No.: US 8,944,479 B2
(45) Date of Patent: Feb. 3, 2015

(54) VEHICLE DOOR FIXING APPARATUS

(75) Inventors: Akira Muramatsu, Chiryu (JP); Kosuke Tsukamoto, Chiryu (JP); Yoshiki Odaka, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 144 days.

(21) Appl. No.: 13/325,287

(22) Filed: Dec. 14, 2011

(65) Prior Publication Data

US 2012/0161454 A1 Jun. 28, 2012

(30) Foreign Application Priority Data

Dec. 27, 2010 (JP) ..... 2010-291229
Aug. 25, 2011 (JP) ..... 2011-184016

(51) Int. Cl.
*E05C 17/34* (2006.01)
*E05B 77/36* (2014.01)
*E05B 85/04* (2014.01)

(52) U.S. Cl.
CPC ..... *E05B 77/36* (2013.01); *E05B 85/045* (2013.01); *Y10S 292/03* (2013.01); *Y10S 292/55* (2013.01)
USPC ..... 292/342; 292/DIG. 3; 292/DIG. 55; 292/341.12; 16/85; 16/86; 16/82

(58) Field of Classification Search
CPC ..... E05B 15/0006
USPC ..... 292/DIG. 38, DIG. 39, DIG. 19, DIG. 51, 292/DIG. 55, 342, 343, 216
See application file for complete search history.

(56) References Cited

U.S. PATENT DOCUMENTS

2012/0112474 A1 5/2012 Muramatsu et al.
2012/0112477 A1 5/2012 Muramatsu et al.

FOREIGN PATENT DOCUMENTS

IT EP 0 314 075 * 2/1992 ..... E05B 65/19
JP 1-43298 Y2 12/1989
WO WO 2011/105328 A1 9/2011

* cited by examiner

*Primary Examiner* — Kristina Fulton
*Assistant Examiner* — Thomas Neubauer
(74) *Attorney, Agent, or Firm* — Buchanan Ingersoll & Rooney PC

(57) ABSTRACT

A vehicle door fixing apparatus, a fixed wedge configured to be fixedly attached to one of a vehicle body panel and a door panel, a base plate configured to be fixedly attached to the other one of the vehicle body panel and the door panel, a movable wedge slidably provided at the base plate, a biasing member biasing the movable wedge toward the fixed wedge, and a cover fixedly attached to the base plate and covering around the biasing member.

16 Claims, 34 Drawing Sheets

VEHICLE DOOR FIXING APPARATUS

CROSS REFERENCE TO RELATED APPLICATIONS

This application is based on and claims priority under 35 U.S.C. §119 to Japanese Patent Application 2010-291229, filed on Dec. 27, 2010, and Japanese Patent Application 2011-184016, filed on Aug. 25, 2011, the entire contents of which are incorporated herein by reference.

TECHNICAL FIELD

This disclosure generally relates to a vehicle door fixing apparatus.

BACKGROUND DISCUSSION

A known vehicle door fixing apparatus is disclosed in JPH1-43298Y (hereinafter referred to as Patent reference 1). The known vehicle door fixing apparatus disclosed in the Patent reference 1 is provided with a fixed wedge including an inclined surface and fixedly attached to a door panel. The known vehicle door fixing apparatus is also provided with a movable wedge which includes an inclined surface being in contact with the inclined surface in a state where the door is closed and which is provided at a vehicle body panel in a reciprocatingly slidable manner. The movable wedge is biased by a spring so as to be pushed against the fixed wedge in a state where the door is closed, and thus the door is pushed toward a hinge of the door, and thus a backlash or a rattling of the door is restricted. The movable wedge is slidably provided on an upper surface of a base plate fixedly attached to the vehicle body panel.

According to the known vehicle door fixing apparatus having the above-explained structure, in case that a posture of the spring is changed inadequately by an external force, the spring does not bias the movable wedge appropriately, and thus the backlash or the rattling of the door may not be restricted appropriately. Consequently, in order to restrict the posture of the spring from being changed inadequately, there might be a need to provide a bag-shaped accommodating portion formed integrally with the base plate so that the spring is accommodated inside the accommodating portion.

However, in case that the above-explained accommodating portion is formed integrally with the base plate, a shape of the base plate becomes complicated, thereby possibly making it difficult to form the base plate. A need thus exists for a vehicle door fixing apparatus, which is not susceptible to the drawback mentioned above.

SUMMARY

According to an aspect of this disclosure, a vehicle door fixing apparatus includes a fixed wedge configured to be fixedly attached to one of a vehicle body panel and a door panel, a base plate configured to be fixedly attached to the other one of the vehicle body panel and the door panel, a movable wedge slidably provided at the base plate, a biasing member biasing the movable wedge toward the fixed wedge, and a cover fixedly attached to the base plate and covering around the biasing member.

BRIEF DESCRIPTION OF THE DRAWINGS

The foregoing and additional features and characteristics of this disclosure will become more apparent from the following detailed description considered with the reference to the accompanying drawings, wherein:

FIG. 35A is a plan view of the cover to be assembled on the door lock striker of the first embodiment;

DETAILED DESCRIPTION

A vehicle door fixing apparatus according to a first embodiment will be explained with reference to FIGS. 1 to 27.

Figure 1:
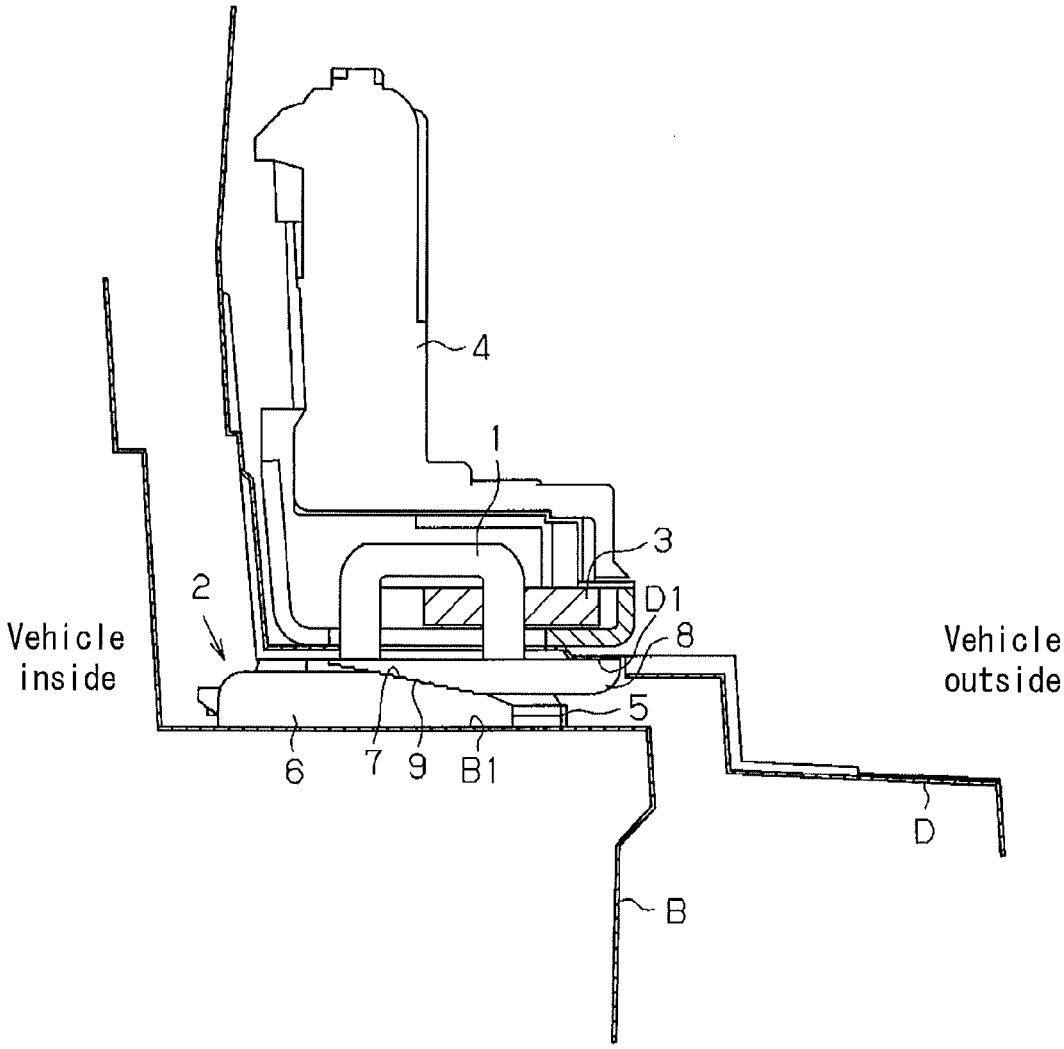
FIG. 1 is a cross sectional view of a vehicle door fixing apparatus according to a first embodiment disclosed here.
Figure 2:
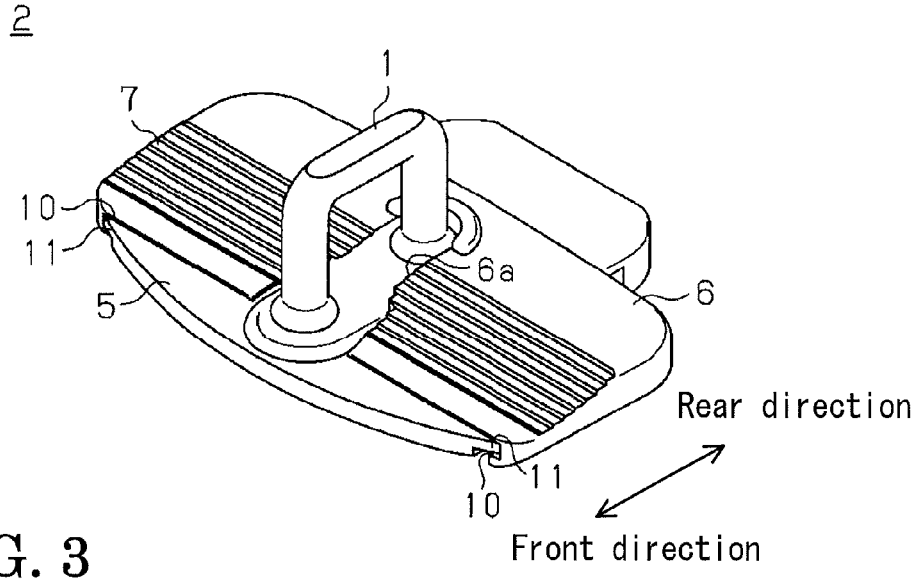
FIG. 2 is a perspective view of a movable wedge device provided at the vehicle door fixing apparatus of the first embodiment.

First, an entire structure of the vehicle door fixing apparatus will be explained with reference to FIG. 1. As shown in FIG. 1, a movable wedge device 2 including a door lock striker 1 and a movable wedge 6 is provided at an end surface B1, which extends in a vehicle width direction and is positioned in a vicinity of the vehicle door, of a vehicle body panel B (i.e., a side member outer panel). On the other hand, a fixed wedge 8 is fixedly attached at an end surface D1, which extends in the vehicle width direction and is positioned in a vicinity of an opening of the vehicle body, of a door panel D (i.e., a door inner panel) so as to face the movable wedge device 2 in a state where the door is closed. In addition, a door lock assembly 4 including a latch 3 engaging with and disengaging from the door lock striker 1 is assembled on the door panel D together with the fixed wedge 8, the door lock assembly 4 is positioned at an opposite side of the fixed wedge 8 relative to the movable wedge device 2.

The vehicle door provided with the above-explained vehicle door fixing apparatus shown in FIG. 1 corresponds to a side door positioned at a front right side of a vehicle having an open air type body structure or a vehicle having a convertible type structure. The vehicle door provided with the above-explained vehicle door fixing apparatus is for opening and closing an opening (a door opening) provided at a side portion of the vehicle in a right/left direction in FIG. 1 (the vehicle width direction).

Figure 3:
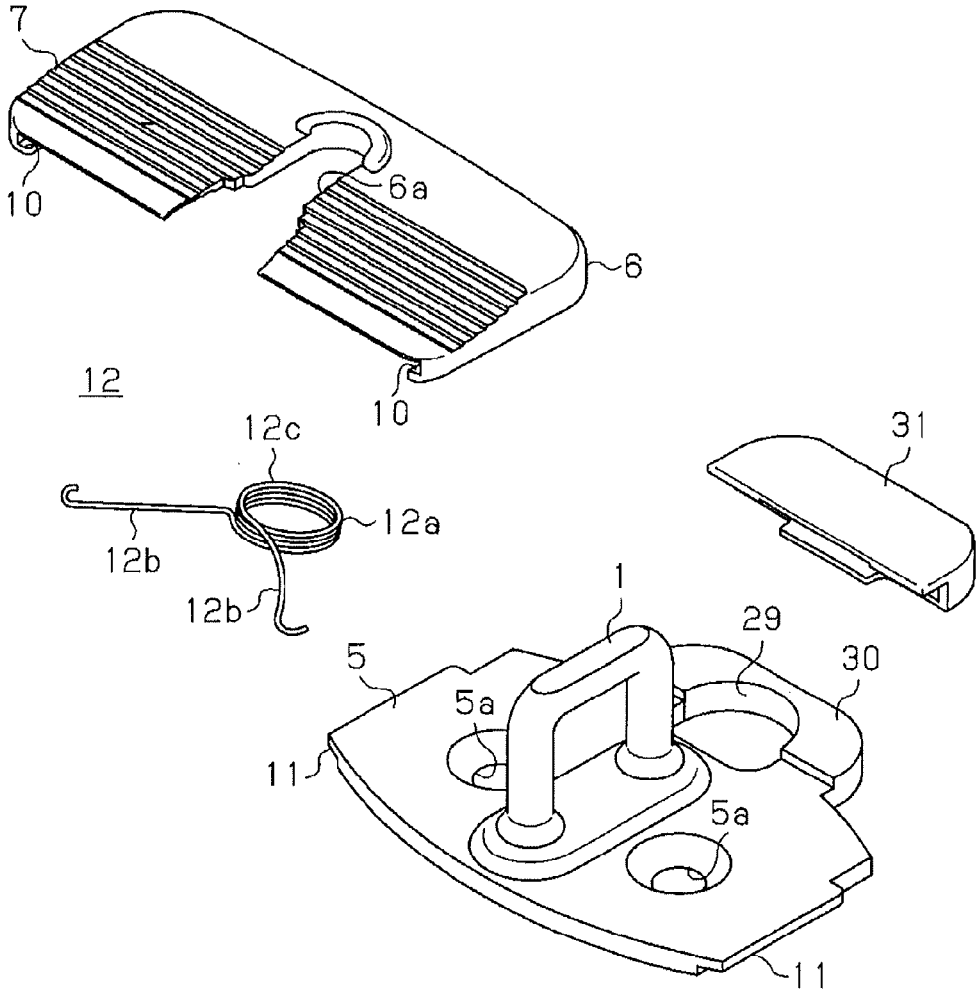
FIG. 3 is an exploded perspective view of the movable wedge device of the first embodiment.
Figure 4A:
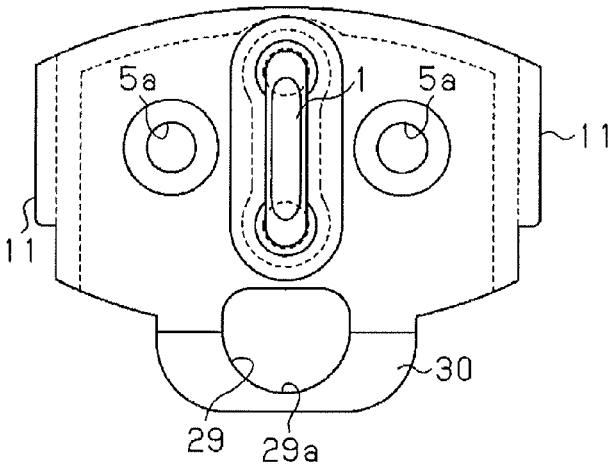
FIG. 4A is a top view of a base plate provided at the movable wedge device of the first embodiment.
Figure 4B:
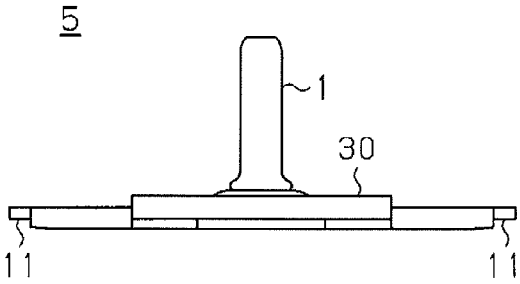
FIG. 4B is a front view of the base plate provided at the movable wedge device of the first embodiment.
Figure 4D:
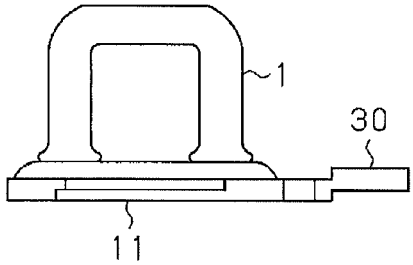
FIG. 4D is a side view of the base plate provided at the movable wedge device of the first embodiment.
Figure 4C:
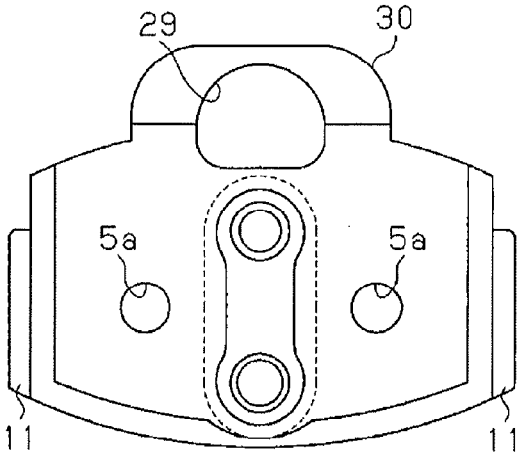
FIG. 4C is a bottom view of the base plate provided at the movable wedge device of the first embodiment.

Next, the movable wedge device 2 provided at the vehicle body panel B will be explained in detail with reference to FIGS. 2 to 14. The movable wedge device 2 having a structure illustrated in FIG. 2 includes a base plate 5, the movable wedge 6, a spring 12 and a cover 31. As shown in FIG. 3, the base plate 5 is formed in a substantially flat plate shape and the door lock striker 1 is provided on an upper surface of the base plate 5 when viewed in FIG. 3. The movable wedge 6 is provided at the upper surface of the base plate 5. The spring 12 serving as a biasing member is positioned between the base plate 5 and the movable wedge 6. The cover 31 is fixedly attached to the base plate 5. The spring 12 includes a coil portion 12*a* wound in a coiled configuration and a pair of arm portions 12*b*, 12*b* each protruding from the coiled portion 12*a*. Hereunder, a diagonally downward left direction and a diagonally upward right direction in FIG. 2 correspond to a front direction and a rear direction of the movable wedge device 2 (the movable wedge 6), respectively. A lengthwise direction of the movable wedge device 2 (the movable wedge 6) corresponds to a lateral direction of the movable wedge device 2 (the movable wedge 6).

As shown in FIGS. 4A to 4D, the door lock striker 1 made from a shaft bent in a substantially U-shaped form when viewed from the lateral direction of the movable wedge device 2 is integrally provided on the upper surface of the base plate 5 formed in the substantially flat plate shape. A bolt hole 5*a* to which a bolt for fixing the base plate 5 to the vehicle body panel B is inserted is formed on the base plate 5 at each side relative to the door lock striker 1 in the lateral direction of the movable wedge device 2. A guide rail 11 having a substantially rectangular cross-section is formed at each lateral side portion of the base plate 5 to linearly extend.

The base plate 5 is provided with a supporting portion 29*a* supporting a part of the spring 12. The supporting portion 29*a* is arranged in a moving direction of the movable wedge 6. Specifically, a spring accommodating portion 29 (i.e., a biasing member accommodating portion) providing an accommodation space of the spring 12 is formed at a rear portion of the base plate 5. The spring accommodating portion 29 is constituted by a hole formed at the rear portion of the base plate 5 and a rear wall portion of the spring accommodating portion 29 corresponds to the supporting portion 29*a* supporting the coil portion 12*a* at a portion positioned opposite to a direction in which the pair of arm portions 12*b*, 12*b* protrudes. The supporting portion 29*a* is provided at the spring accommodating portion 29 accommodating a part of the spring 12 and serves as a supporting surface being into contact with an outer circumferential surface of the coil portion 12*a* of the spring 12. The base plate 5 further includes a step portion 30 formed to be higher than other portions surrounding the step portion 30.

Figure 5A:
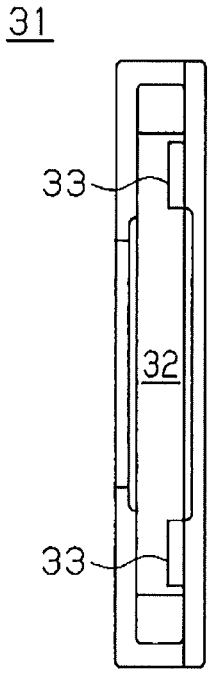
FIG. 5A is a front view of a cover to be assembled on the base plate of the first embodiment.
Figure 5B:
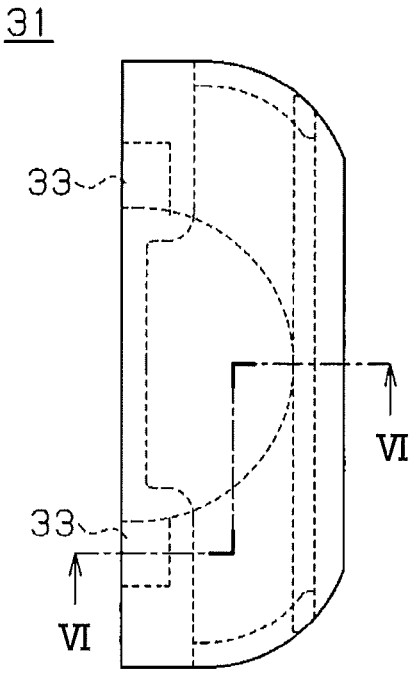
FIG. 5B is a plan view of the cover to be assembled on the base plate of the first embodiment.
Figure 6:
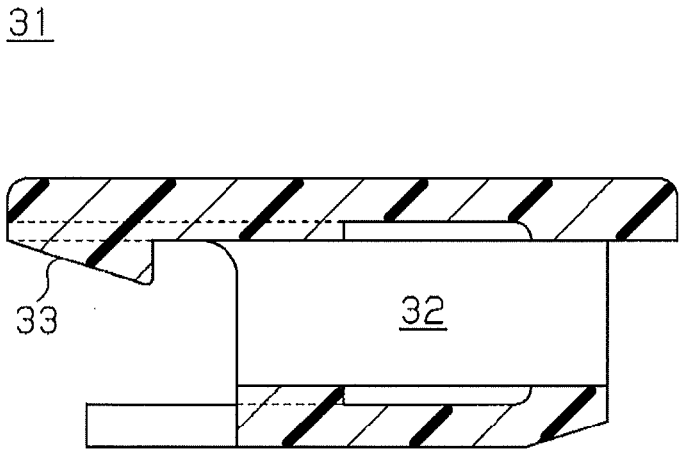
FIG. 6 is a cross sectional view of the cover taken along line VI-VI in FIG. 5B.

The cover 31 fixedly attached to the base plate 5 is formed in a shape illustrated in FIGS. 5A and 5B. The cover 31 includes inside thereof an accommodation space 32 accommodating the spring 12. As shown in FIG. 6, the accommodation space 32 of the cover 31 is formed so as to penetrate from a front end through a rear end of the cover 31. The cover 31 includes a tab 33 formed at a front portion of the cover 31 and engaging with the step portion 30 of the base plate 5 so that the cover 31 is fixedly attached to the base plate 5.

Figure 7:
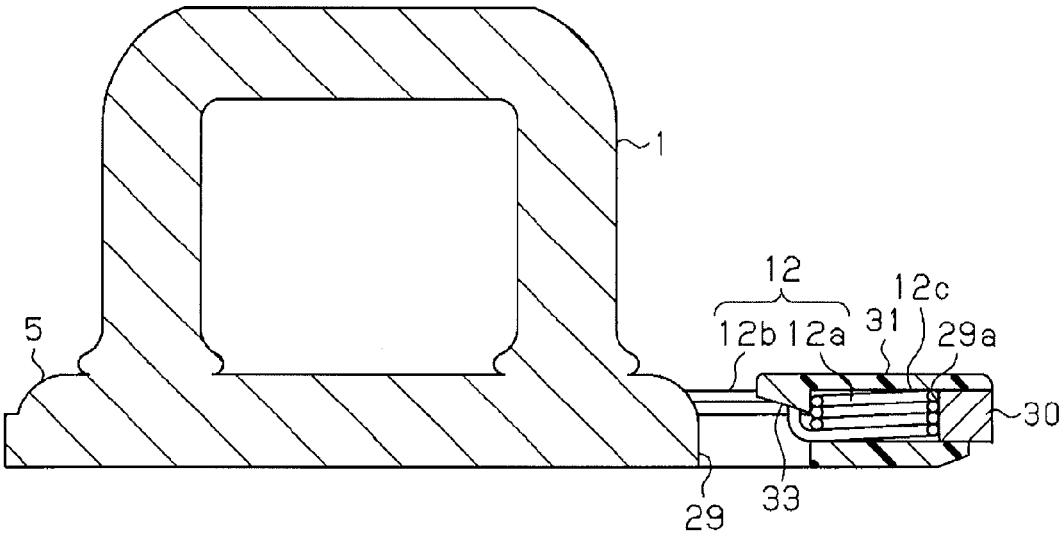
FIG. 7 is a cross sectional view of the base plate on which the cover is assembled according to the first embodiment.

The cover 31 is fixedly attached to the rear portion of the base plate 5 in a manner shown in FIG. 7. As shown in FIG. 7, the step portion 30 is formed so that a height of an upper surface of the step portion 30 is same as a height of an upper portion 12*c* of the coil portion 12*a* of the spring 12, that is, a height of an upper portion of the spring 12. The upper portion 12*c* of the coil portion 12*a* and a lower portion of the coil portion 12*a* of the spring 12 are supported by upper and lower inner walls of the accommodation space 32, respectively and a rear end of the coil portion 12*a* is supported by an inner wall of the spring accommodating portion 29 of the base plate 5. The upper surface of the step portion 30 and the upper portion of the spring 12 face a protruding direction of the shaft 1. The upper portion 12*c* of the coil portion 12*a* faces the protruding direction of the shaft 1 and the lower portion of the coil portion 12*a* faces the opposite direction thereto.

Figure 8:
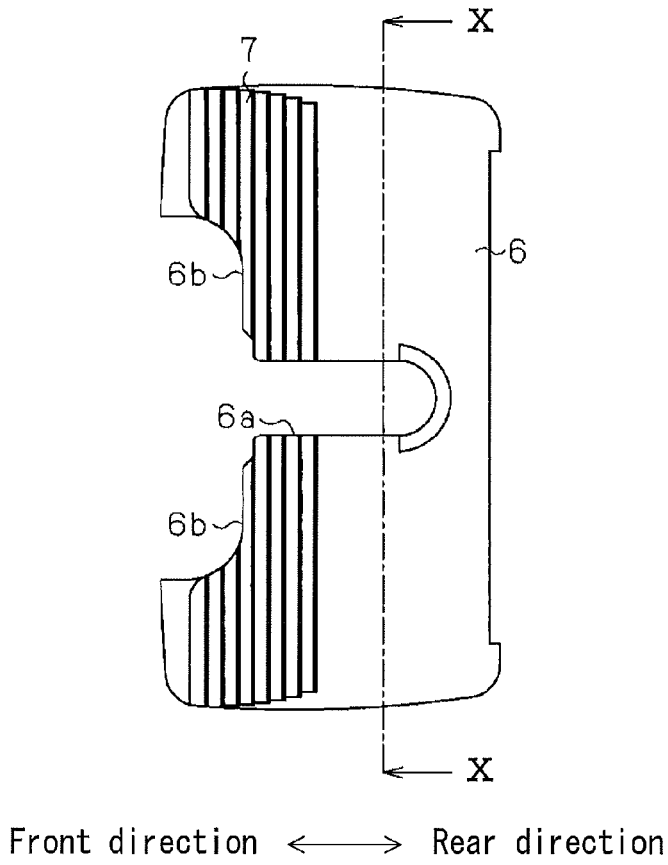
FIG. 8 is a plan view of a movable wedge to be provided at the movable wedge device of the first embodiment.

The movable wedge 6 is provided on the upper surface of the base plate 5 in a manner that the movable wedge 6 covers the upper surface of the base plate 5. As shown in FIG. 8, the movable wedge 6 is formed in a substantially rectangular shape and includes an inclined surface 7 formed at a front portion of an upper surface of the movable wedge 6 to be inclined relative to the upper surface of the base plate 5.

A slit 6*a* is formed at a substantially central portion of the movable wedge 6 in a width direction of the movable wedge 6 to be cut out from the front direction toward the rear direction of the movable wedge 6. The slit 6*a* is provided for allowing the movable wedge 6 to slide in a reciprocating manner in the vehicle width direction relative to the door lock striker 1.

A cut-out portion 6*b* is formed at the front portion of the movable wedge 6 to be positioned at each lateral side relative to the slit 6*a*. The cut-out portion 6*b* is provided for allowing the bolt holes 5*a* formed on the base plate 5 to be exposed and thus allowing the bolts to be inserted in the bolt holes 5*a* in a state where the movable wedge 6 is moved in the rear direction in FIG. 8. Hereunder, a left direction and a right direction in FIG. 8 correspond to the front direction and the rear direction of the movable wedge 6, respectively.

Figure 9:
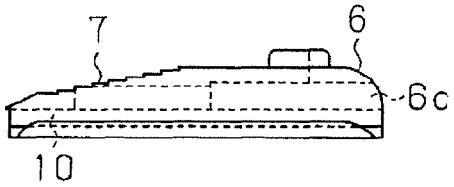
FIG. 9 is a lateral view of the movable wedge of the first embodiment.
Figure 10:
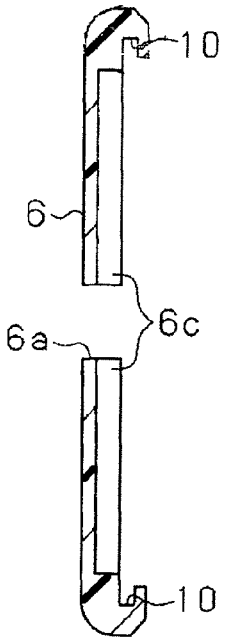
FIG. 10 is a cross sectional view of the movable wedge taken along line X-X in FIG. 8.

As shown in FIG. 9, the inclined surface 7 of the movable wedge 6 is formed stepwise with plural steps. A cross-section of each step of the inclined surface 7 is identical to one another. As shown in FIG. 10, the movable wedge 6 includes a pair of guide grooves 10, 10 formed at lateral side portions thereof. The guide grooves 10, 10 are arranged facing each other and extending in a sliding direction of the movable wedge 6. The guide rail 11, which is formed at each lateral side portion of the base plate 5, engages with the corresponding guide groove 10 in the slidable manner, thereby arranging the movable wedge 6 at the base plate 5 so that the movable wedge 6 is slidable relative to the base plate 5. Each of the pair of guide grooves 10, 10 is opened at a front portion and is closed at a rear portion of the movable wedge device 2.

As explained above, the movable wedge 6 is provided at the base plate 5 in the slidable manner via a rail mechanism constituted by the guide groove 10 and the guide rail 11, and thus the movable wedge 6 is slidable in the front/rear direction of the movable wedge 6 in an appropriate manner. However, a backlash of the movable wedge 6 may be caused by a looseness between the guide groove 10 and the guide rail 11, thereby possibly causing an abnormal noise between the movable wedge 6 and the base plate 5 or between the movable wedge 6 and the fixed wedge 8 in a state where the door is closed.

According to the first embodiment, the looseness between the guide groove 10 and the guide rail 11 is reduced by providing an elastic member in a compressed state between a surface of the guide rail 11 and a wall of the guide groove 10, thereby restricting the backlash of the movable wedge 6.

Figure 11:
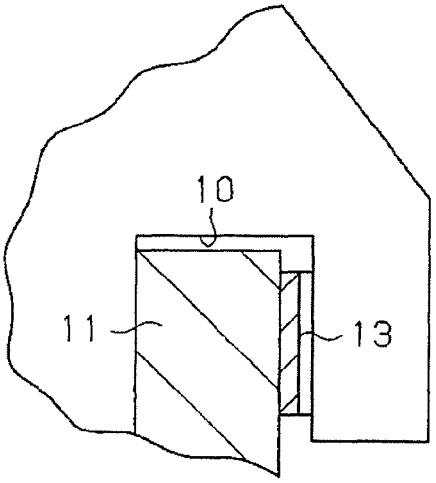
FIG. 11 is an enlarged view of a portion of FIG. 10.
Figure 13:
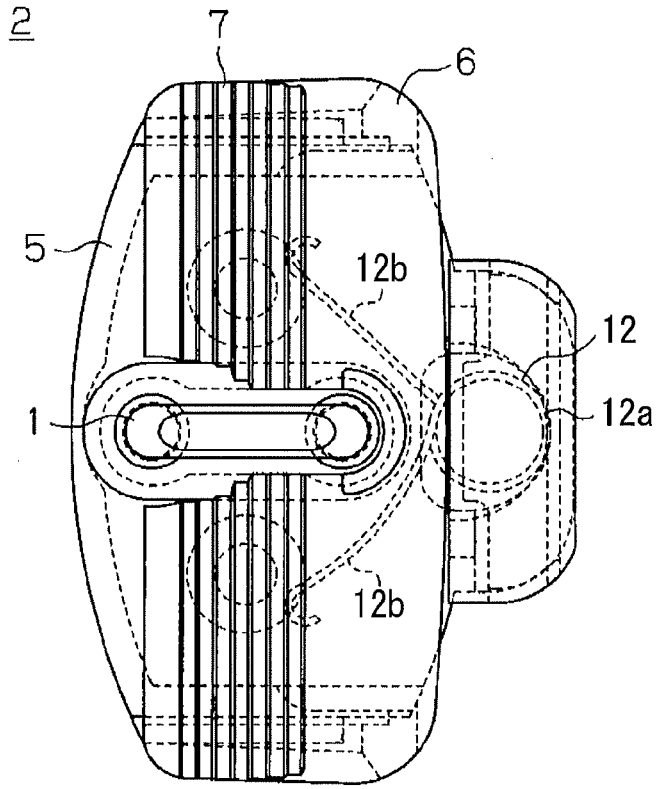
FIG. 13 is a plan view of the movable wedge device of the first embodiment.

As illustrated in FIG. 11 showing an enlarged view of a portion F in FIG. 10, a leaf spring 13 (i.e., the elastic member) is provided in the compressed state between a right-side wall of the guide rail 10 and a right-side surface of the guide rail 11 when viewed in FIG. 13. The guide rail 11 is pushed by the leaf spring 13 toward a direction of a left-side wall of the guide groove 10 when viewed in FIG. 13.

Figure 12:
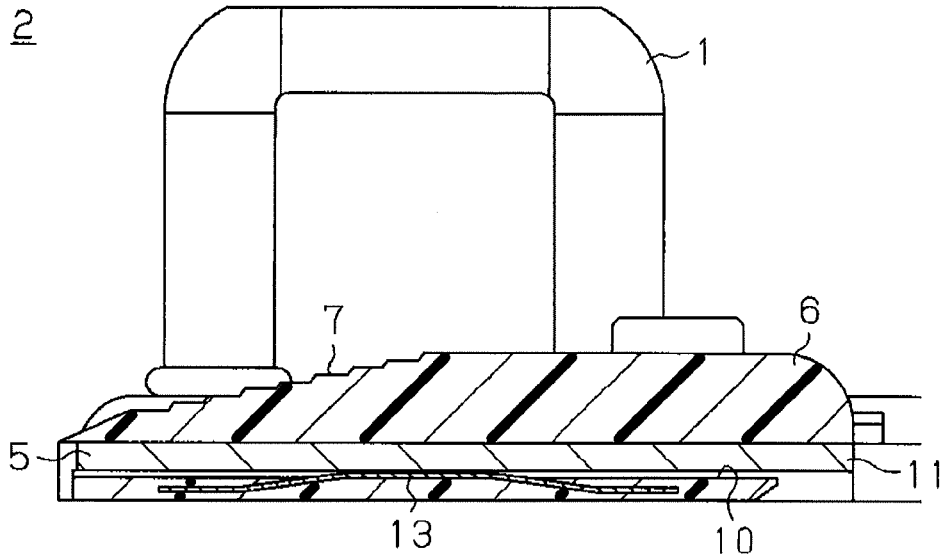
FIG. 12 is a cross sectional view of the movable wedge device of the first embodiment.

As shown in FIG. 12, the leaf spring 13 is formed in a bent shape so that a central portion thereof is curved upwardly when viewed in FIG. 12. The leaf spring 13 is insert-molded so as to be integral with the movable wedge 6.

As shown in FIG. 13, the spring 12 is provided between the base plate 5 and the movable wedge 6. The coil portion 12*a* of the spring 12 is accommodated in the accommodation space 32 of the cover 31. The pair of arm portions 12*b*, 12*b* of the spring 12 is in contact with a front end surface of a recessed portion 6*c* (as shown in FIG. 10) formed on a lower surface (i.e., a backside) of the movable wedge 6. The protruding portion formed at the rear portion of the base plate 5 functions as a stopper restricting the sliding movement of the movable wedge 6 against a biasing force of the spring 12.

As the movable wedge 6 moves in the rear direction (in the right side in FIG. 13), the pair of arm portions 12*b*, 12*b* of the spring 12 is pushed by the front end surface of the recessed portion 6*c* and thus an angle between the pair of arm portions 12*b*, 12*b* increases, that is, a distance between the pair of arm portions 12*b*, 12*b* increases. Thus, a torsion is generated at the coil portion 12*a*, thereby generating a biasing force biasing the movable wedge 6 in the forward direction (in the left side in FIG. 13). Because the spring 12 is positioned between the base plate 5 and the movable wedge 6 in a compressed state, the movable wedge 6 is always biased in the forward direction.

Figure 14:
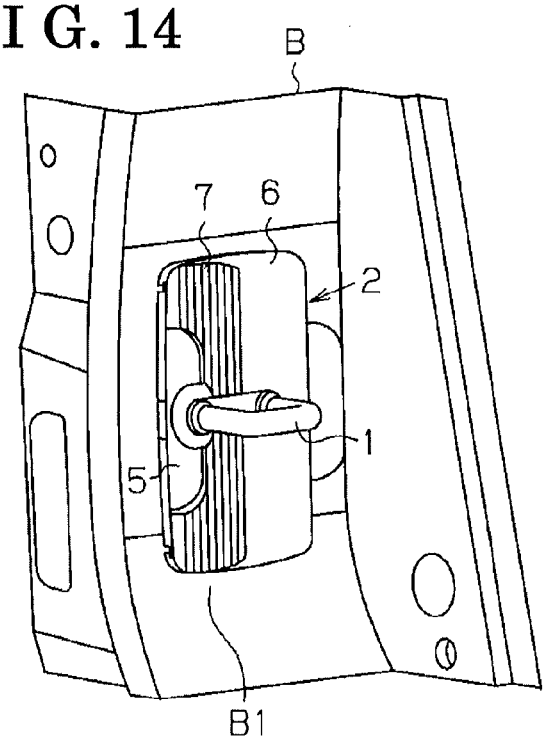
FIG. 14 is a perspective view illustrating a manner in which the movable wedge device of the first embodiment is provided at a vehicle body panel.

As shown in FIG. 14, the movable wedge device 2 having the above-explained structure is fixedly attached to the end surface B1, which extends in the vehicle width direction and is positioned in a vicinity of the vehicle door, of the vehicle body panel B (i.e., the side member outer panel). Next, the fixed wedge 8 provided at the vehicle door fixing apparatus of the first embodiment will be explained with reference to FIGS. 15 to 20. Hereunder, a left direction and a right direction in FIG. 15 correspond to a front direction and a rear direction of the fixed wedge 8, respectively. In other words, here, a direction toward which a thickness of the fixed wedge 8 (that is, the thickness of the fixed wedge 8 at a portion where an inclined surface 9 is formed on an upper surface of the fixed wedge 8) decreases corresponds to the front direction of the fixed wedge 8. A direction toward which the thickness of the fixed wedge 8 increases corresponds to the rear direction of the fixed wedge 8.

Figure 15:
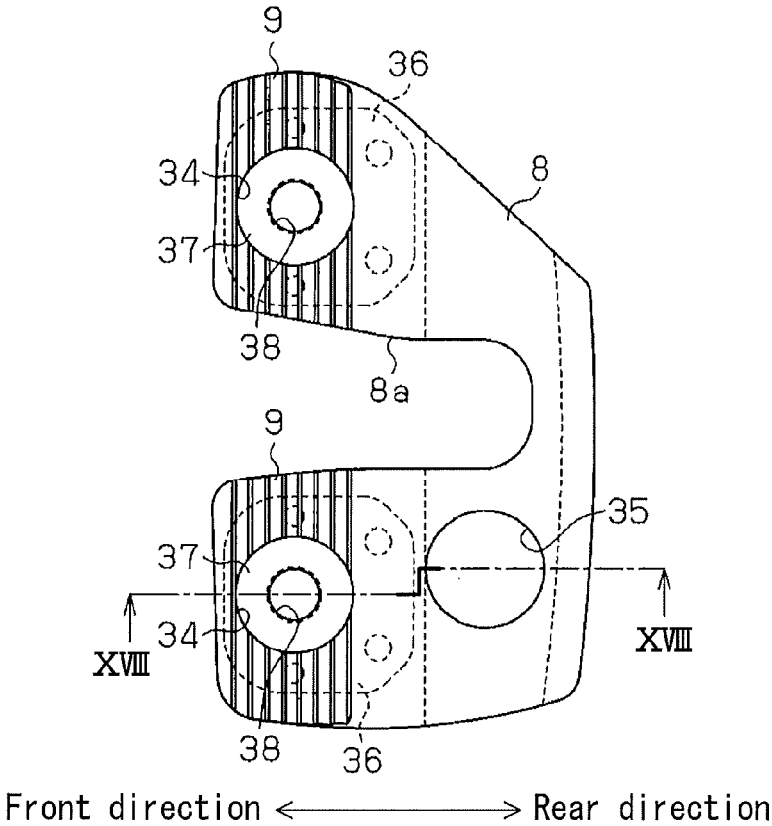
FIG. 15 is a plan view of a fixed wedge to be provided at the vehicle door fixing apparatus of the first embodiment.
Figure 16:
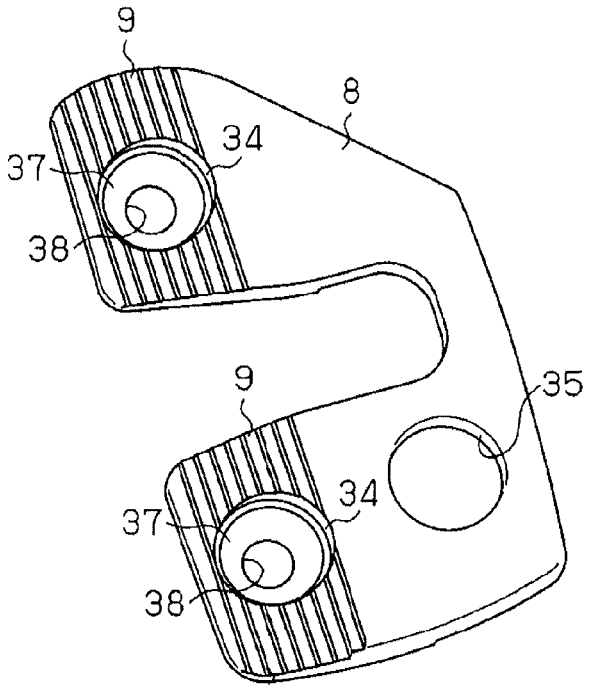
FIG. 16 is a perspective view of the fixed wedge of the first embodiment.

As shown in FIGS. 15 and 16, a slit 8*a* is formed at a front portion of the fixed wedge 8, at which the stepwise inclined surface 9 is formed, so as to be cut out from the front direction toward the rear direction of the fixed wedge 8. The fixed wedge 8 includes an insertion hole 34 which is formed at each side relative to the slit 8*a* in the lateral direction thereof and to which a bolt for fixing the fixed wedge 8 to the door panel D is inserted. The fixed wedge 8 also includes an insertion hole 35 which is formed at a rear portion of the fixed wedge 8 and to which a bolt for temporarily fixing the door lock assembly 4. The fixed wedge 8 is made of resin.

Figure 17A:
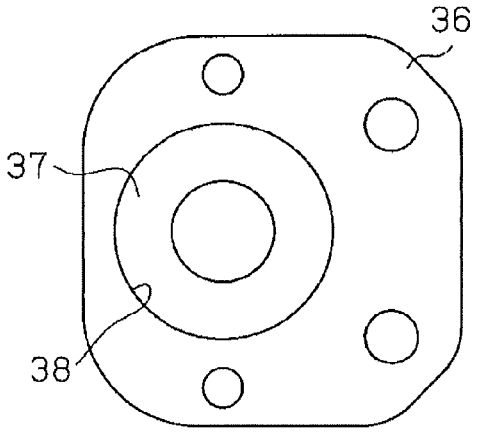
FIG. 17A is a plan view of a metal member provided at the fixed wedge of the first embodiment.
Figure 17B:
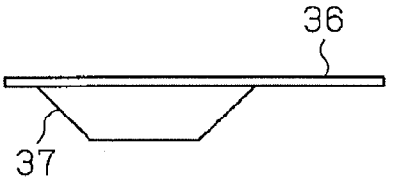
FIG. 17B is a lateral view of the metal member provided at the fixed wedge of the first embodiment.

A metal member 36 formed in a substantially flat plate shape is provided around the insertion hole 34 of the fixed wedge 8 by insert-molding. The metal member 36 constitutes a bearing surface for the bolt for fixing the fixed wedge 8 to the door panel D. As shown in FIGS. 17A and 17B, the metal member 36 includes a first recessed portion 37 formed in a substantially conically depressed shape and serving as the bearing surface for the bolt. A bolt hole 38 in which the bolt is inserted is formed in the center of the first recessed portion 37.

Figure 18:
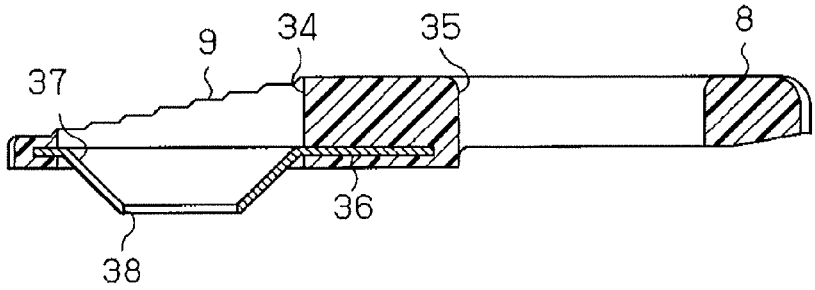
FIG. 18 is a cross sectional view of the fixed wedge taken along line XVIII-XVIII in FIG. 15.

As shown in FIG. 18, the fixed wedge 8, which is provided with the above-explained metal member 36, includes the first recessed portion 37 formed to protrude downwardly below a lower surface of the fixed wedge 8, that is, recessed relative to the lower surface of the fixed wedge 8. The fixed wedge 8 is formed so that the lower surface of the fixed wedge 8 is positioned closer to the upper surface thereof in the rear portion of the fixed wedge 8 than in the front portion of the fixed wedge 8. The upper and lower surfaces of the fixed wedge 8 correspond to the surfaces facing upper and lower directions, respectively when viewed in FIG. 18.

Figure 19:
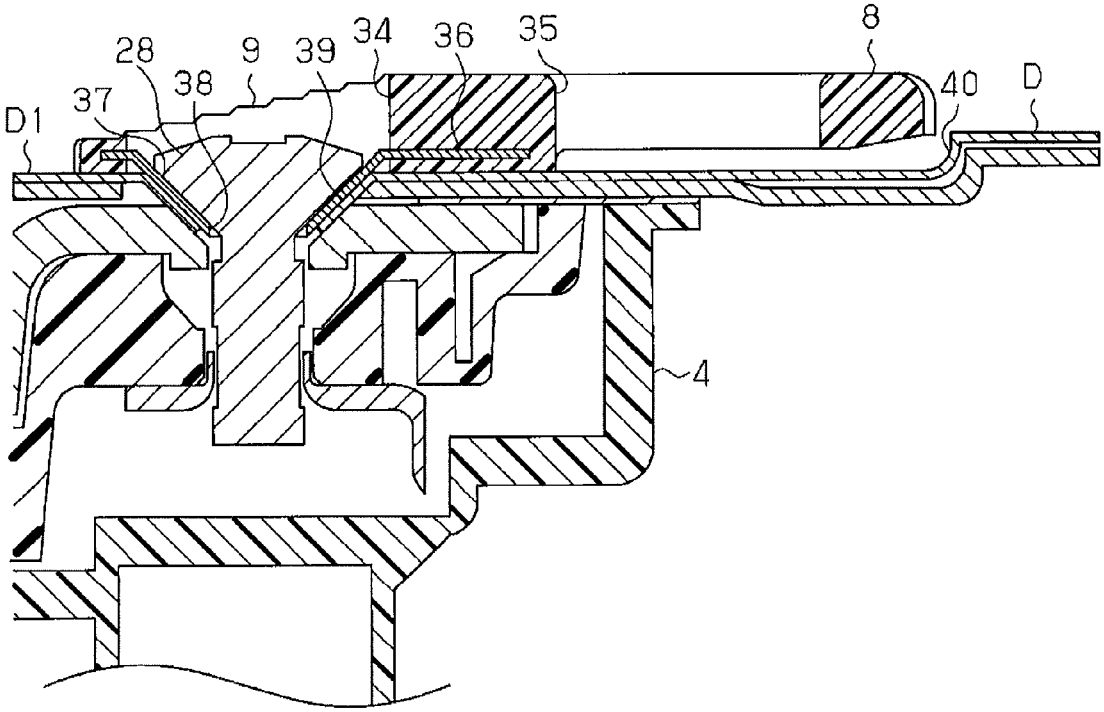
FIG. 19 is a cross sectional view illustrating a manner in which the fixed wedge of the first embodiment is assembled on a door panel.

The fixed wedge 8 is fixedly attached to the end surface D1, which extends in the vehicle width direction and is positioned in a vicinity of the opening of the vehicle body, of the door panel D (i.e., the door inner panel) in a manner shown in FIG. 19. As shown in FIG. 19, the fixed wedge 8 is fixedly attached to the door panel D by means of bolts 28 (i.e., each serving as a mounting member). In a state where the fixed wedge 8 is fixedly attached to the door panel D, the first recessed portion 37 of the metal member 36, which protrudes below the lower surface of the fixed wedge 8, fits in a second recessed portion 39 formed at the door panel D. Because the lower surface of a rear end portion of the fixed wedge 8 is positioned higher than the lower surface of the other portion of the fixed wedge 8, thereby restricting the fixed wedge 8 from interfering with a curved portion 40 of the door panel D.

Figure 20:
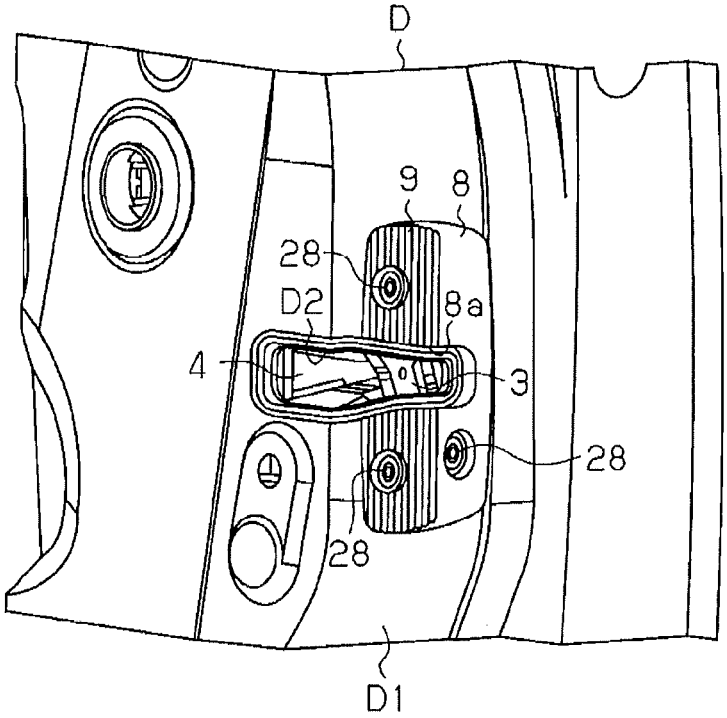
FIG. 20 is a perspective view illustrating a manner in which the fixed wedge of the first embodiment is provided at the door panel.

As shown in FIG. 20, the slit 8*a* of the fixed wedge 8 is formed to match a shape of a portion, which extends in the vehicle width direction, of a recess D2 for receiving therein the striker which is formed on the door panel D. The fixed wedge 8 is assembled on the door panel D together with the lock assembly 4 by means of bolts (e.g., three bolts) when the door lock assembly 4 is assembled on the door panel D, that is, the fixed wedge 8 is not pre-assembled on the door lock assembly 4.

Figure 21:
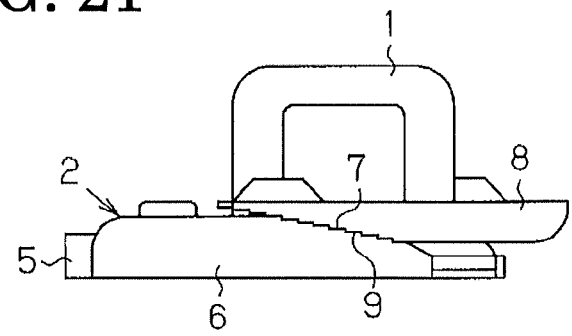
FIG. 21 is a lateral view illustrating a state of the movable wedge device and the fixed wedge of the vehicle door fixing apparatus of the first embodiment when a vehicle body is not deformed.
Figure 22:
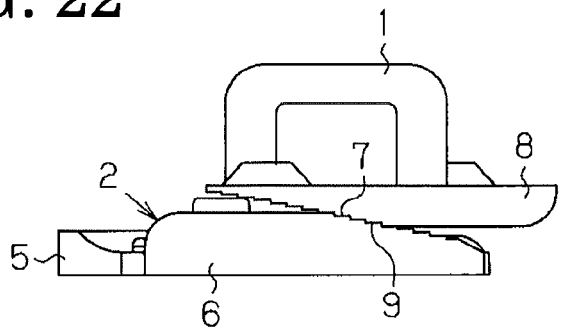
FIG. 22 is a lateral view illustrating a state of the movable wedge device and the fixed wedge of the vehicle door fixing apparatus of the first embodiment when the vehicle body is deformed.

According to the vehicle door fixing apparatus including the above-explained structure, when a bending deformation occurs to the vehicle body in a right/left direction thereof while, for example, when the vehicle makes a turn, the movable wedge 6 arranged at a side of the vehicle at which the vehicle body expands moves relative to the fixed wedge 8 in the right direction when viewed in FIG. 21. At this time, the movable wedge 6 in a state illustrated in FIG. 21 moves to be in a state illustrated in FIG. 22. Thus, the fixed wedge 8 moves upwardly when viewed in FIG. 21 (that is, in the front/rear direction of the vehicle when the fixed wedge 8 is assembled on the vehicle). Accordingly, a gap generated between an opening portion of the vehicle body and the vehicle door in the front/rear direction of the vehicle due to the bending deformation is reduced. At a side of the vehicle at which the vehicle body shrinks while, for example, the vehicle makes the turn, the deformation of the vehicle body may be restricted by the movable wedge device 2. Thus, according to the vehicle door fixing apparatus having the above-explained structure, a backlash of the vehicle door may be restricted and a rigidity of the vehicle body is effectively increased.

According to the vehicle door fixing apparatus including the above-explained structure, the bolt holes 5*a* formed at the base plate 5 are covered with and hidden behind the movable wedge 6 in a normal state, that is, in a state where the movable wedge 6 is not slid in the rear direction thereof against the biasing force of the spring 12. Thus, in order to fix the base plate 5 to the vehicle body panel B, the bolts need to be tightened while retaining the movable wedge 6 in a fully slid position against the biasing force of the spring 12 manually during the bolt tightening process, which decreases an assembling performance. Therefore, according to the first embodiment, a locking member, which restricts the sliding movement of the movable wedge 6 and locks the movable wedge 6 at a position where the movable wedge 6 causes the bolt holes 5*a* to be exposed, is removably attached to the movable wedge device 2.

Figure 23:
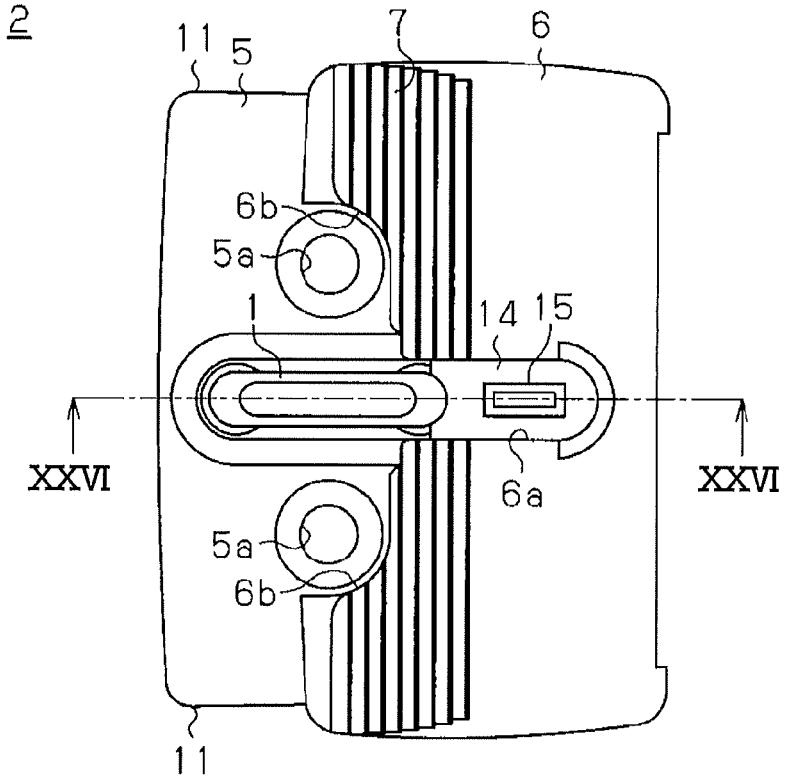
FIG. 23 is a perspective view of the movable wedge device of the first embodiment before being assembled on the vehicle body panel.
Figure 24:
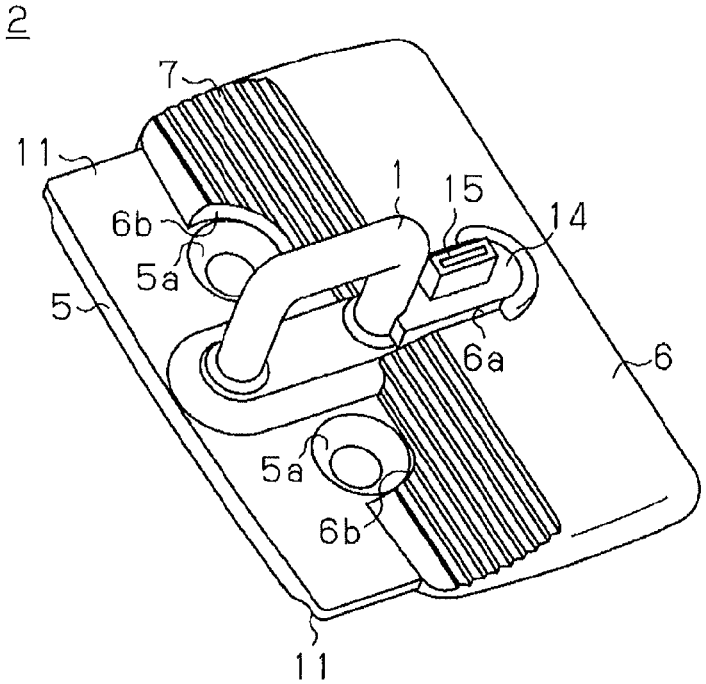
FIG. 24 is a perspective view of the movable wedge device of the first embodiment before being assembled on the vehicle body panel.

As shown in FIGS. 23 and 24 the movable wedge device 2 of the first embodiment is provided with a resin piece 14 serving as the locking member restricting the sliding movement of the movable wedge 6. The resin piece 14 is configured to fit into a gap formed between an innermost portion of the slit 6*a* and the door lock striker 1 when the movable wedge 6 is fully slid in the rear direction thereof.

Figure 25A:
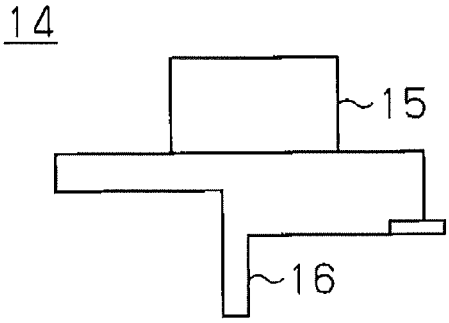
FIG. 25A is a lateral view of a resin piece to be provided at the movable wedge device of the first embodiment.
Figure 25B:
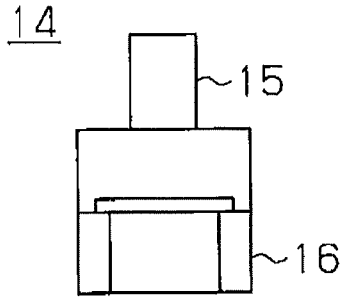
FIG. 25B is a front view of the resin piece to be provided at the movable wedge device of the first embodiment.
Figure 25C:
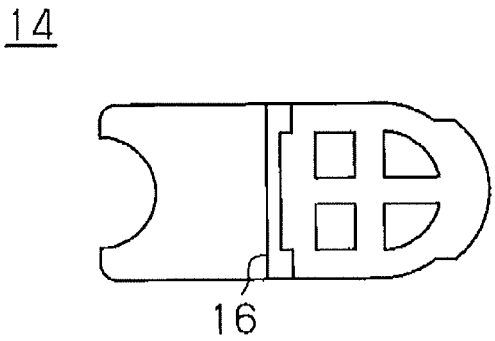
FIG. 25C is a lower surface of the resin piece to be provided at the movable wedge device of the first embodiment.
Figure 26:
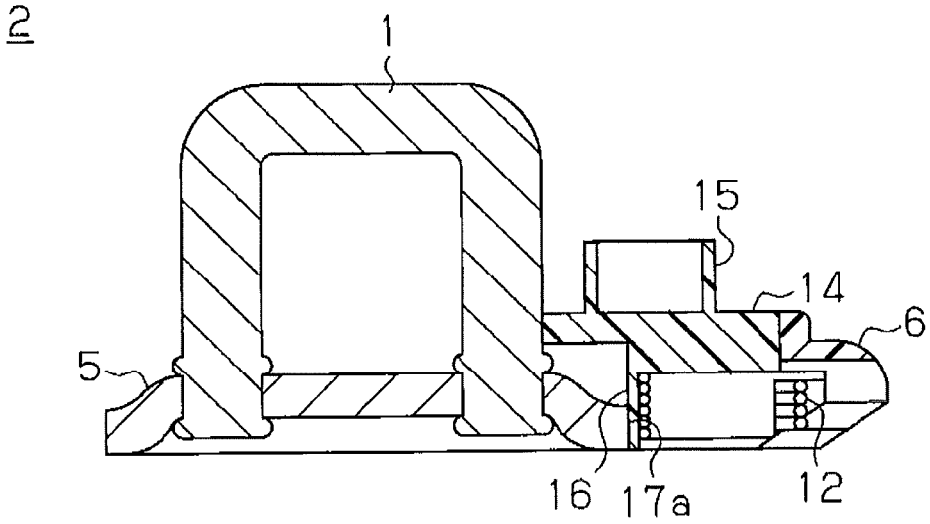
FIG. 26 is a cross sectional view of the movable wedge device taken along line XXVI-XXVI in FIG. 23.

As shown in FIGS. 25A to 25C, a knob portion 15 is provided on an upper surface of the resin piece 14 so that the resin piece 14 is attached to and removed from the movable wedge device 2 by holding the knob portion 15. A protruding portion 16 is provided on a lower surface of the resin piece 14 so as to protrude downwardly. As shown in FIG. 26, the protruding portion 16 is configured to fit into a groove 17*a* formed on the base plate 5 in a state where the resin piece 14 is attached to the movable wedge device 2.

According to the first embodiment, in a state where the resin piece 14 is attached to the movable wedge device 2 by fitting the protruding portion 16 into the groove 17*a*, the resin piece 14 restricts the sliding movement of the movable wedge 6 so that the movable wedge 6 is locked at the position where the movable wedge 6 is fully slid in the rear direction thereof, that is, the position where the movable wedge 6 causes the bolt holes 5*a* of the base plate 5 to be exposed. In a state where the resin piece 14 is removed from the movable wedge device 2, the movable wedge 6, which is thus allowed to slide, is slid in the front direction by the biasing force of the spring 12. At this time, the bolt holes 5*a* of the base plate 5 are completely covered with and hidden behind the movable wedge 6. In other words, the bolt holes 5*a* are covered with the movable wedge 6 in a state where the resin piece 14 is not attached to the movable wedge device 2, and the bolt holes 5*a* are kept exposed by attaching the resin piece 14 to the movable wedge device 2.

The movable wedge device 2 of the first embodiment is delivered to a vehicle assembling site with the resin piece 14 attached thereto, and thus the movable wedge 6 is restricted from sliding and is locked at the position where the bolt holes 5*a* to be exposed. At the vehicle assembling site, the base plate 5 is fixedly attached to the vehicle body panel B by tightening the bolts through the bolt holes 5*a* exposed by attaching the resin piece 14 to the movable wedge 2. After the base plate 5 is fixedly attached to the vehicle body panel B, the resin piece 14 is removed from the movable wedge device 2 so that the assembling of the movable wedge device 2 on the vehicle door fixing apparatus is completed. In other words, according to the first embodiment, the movable wedge device 2 is assembled on the vehicle door fixing apparatus through the following processes A to C.

A. A process in which the resin piece 14 restricting the sliding movement of the movable edge 6 to lock the movable wedge 6 at the position where the bolt holes 5*a* are exposed is attached to the movable wedge device 2. B. A process in which the base plate 5 is fixedly attached to the vehicle body panel B by tightening the bolts through the bolt holes 5*a* which are exposed by attaching the resin piece 14 to the movable wedge 2.

Figure 27A:
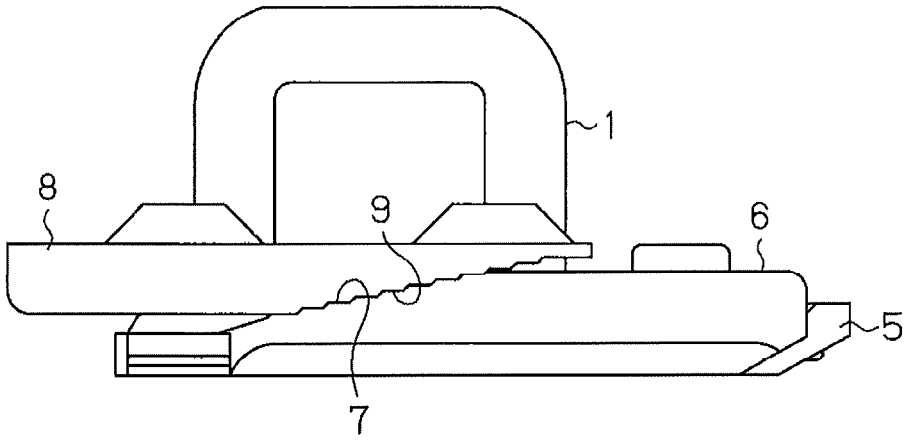
FIG. 27A is a lateral view illustrating a state of the movable wedge and the fixed wedge of the first embodiment in a state where inclined surfaces of the movable wedge and the fixed wedge are in contact with each other.
Figure 27B:
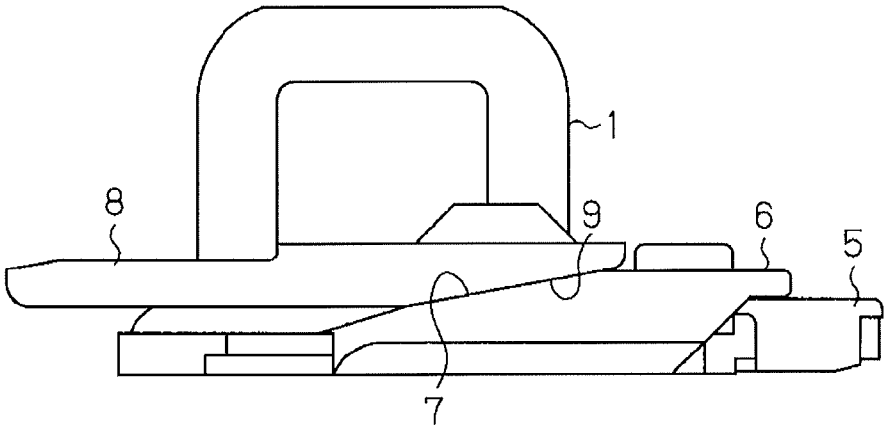
FIG. 27B is a lateral view illustrating a state of the movable wedge and the fixed wedge of the first embodiment in a state where the inclined surfaces of the movable wedge and the fixed wedge are in contact with each other.

C. A process in which the resin piece 14 is removed from the movable wedge device 2 after the base plate 5 is fixedly attached to the vehicle body panel B. According to the vehicle door fixing apparatus of the first embodiment, when the door is closed, the fixed wedge 8 and the movable wedge 6 are in contact with each other in states illustrated in FIGS. 27A and 27B. According to the first embodiment, as illustrated in FIG. 27B, the inclined surface 9 of the fixed wedge 8 engages with the inclined surface 7 of the movable wedge 6 at a more forward portion (that is, a portion positioned on the right side when viewed in FIGS. 27A and 27B), compared to the state illustrated in FIG. 27A. In this case, even though a tightening position of the bolt 28 is the same between FIG. 27A and FIG. 27B, a thickness of the portion at which the bolt 28 is tightened is larger in FIG. 27B. If the thickness of the fixed wedge 8 at the portion to which the bolt 28 is attached is small, a head of the bolt 28 needs to be short so as not to protrude from the inclined surface 9 and so as not to interfere with the inclined surface 7. According to the first embodiment, however, the thickness of the fixed wedge 8 at the portion to which the bolt 28 is attached is large. Thus, the bolt 28 whose head is long may be used, thereby increasing a design flexibility.

As explained above, according to the first embodiment, the following effects and advantages may be obtained. (1) The vehicle door fixing apparatus of the first embodiment includes the fixed wedge 8 fixedly attached to the door panel D, the base plate 5 fixedly attached to the vehicle body panel B, the movable wedge 6 provided at the base plate 5 in the slidable manner and the spring 12 serving as the biasing member biasing the movable wedge 6 toward the fixed wedge 8. The vehicle door fixing apparatus of the first embodiment also includes the cover 31 fixedly attached to the base plate 5 and covering around the spring 12. That is, according to the first embodiment, the spring 12 is accommodated in the spring accommodating portion 29, and a part of the spring 12 and a vicinity of the spring 12 are covered with the cover 31, and thus a displacement of the spring 12 is controlled, which restricts an inadequate posture change of the spring 12. The cover 31 is formed separately from the base plate 5, thereby allowing the base plate 5 to be formed in a simple shape instead of a complicated shape, and also restricting the spring 12 from changing inadequately. Consequently, according to the first embodiment, the inadequate posture change of the spring 12 may be restricted adequately without sacrificing a molding performance of the base plate 5.

(2) According to the first embodiment, the base plate 5 is provided with the supporting portion 29*a* supporting the coil portion 12*a* at the portion positioned opposite to the direction in which the pair of arm portions 12*b*, 12*b* protrudes. The base plate 5 is also provided with the cover 31 so that the cover 31 supports the upper and lower portions of the coil portion 12*a*. Thus, the spring 12 may be held adequately.

(3) According to the first embodiment, the step portion 30 is provided at the base plate 5 and the tab 33 engaging with the step portion 30 is provided at the cover 31. Thus, the cover 31 may be attached to and removed from the base plate 5 in a simple and reliable manner.

(4) According to the first embodiment, the spring 12 is arranged in a manner that the upper surface of the step portion 30 and the upper portion of the spring 12 coincide with each other in terms of the heights thereof when viewed in FIG. 7. Thus, the spring 12 is supported by the step portion 30, and thus the inadequate posture change of the spring 12 may be restricted even more adequately.

(5) According to the first embodiment, the cover 31 is formed to cover a lower surface, that is, the lower portion, of the coil portion 12*a* of the spring 12. Thus, it may be prevented that the coil portion 12*a* of the spring 12 comes into contact with and damages the vehicle body panel B.

(6) According to the vehicle door fixing apparatus of the first embodiment, at which the fixed wedge 8 made of resin is provided, the metal member 36 serving as the bearing surface for the bolt 28 for fixing the fixed wedge 8 to the vehicle door panel D is insert-molded to the fixed wedge 8. According to this structure, strength of the bearing surface for the bolt 28 is increased by using metal for the bearing surface, thereby adequately restricting a backlash of the fixed wedge 8 possibly caused by a creep deformation of the bolt surface.

(7) According to the first embodiment, the fixed wedge 8 is provided with the metal member 36, which constitutes the bearing surface for the bolt 28. The metal member 36 includes a protrusion, that is the first recessed portion 37, which protrudes below the lower surface of the fixed wedge 8 and which fits into the second recessed portion 39 formed on the door panel D. This may facilitate a position setting of the fixed wedge 8 on the door panel D when attaching the fixed wedge 8 to the door panel D, thereby improving an assembly performance of the fixed wedge 8.

(8) According to the first embodiment, the fixed wedge 8 is formed so that the lower surface of the fixed wedge 8 is positioned closer to the upper surface thereof in the rear portion of the fixed wedge 8 than in the front portion of the fixed wedge 8. Thus, a shape of the lower surface of the fixed wedge 8 follows or substantially matches a shape of the curved portion of the door panel D, to which the fixed wedge 8 is attached, thereby restricting the fixed wedge 8 from damaging a panel material of the door panel D during the assembly work.

(9) According to the first embodiment, the thickness of the fixed wedge 8 is large at the position at which the bolt is attached, and thus the bolt 28 whose head is long may be used. Consequently, the design flexibility increases. (10) The vehicle door fixing apparatus of the first embodiment includes the fixed wedge 8 fixedly attached to the door panel D, the base plate 5 fixedly attached to the vehicle body panel B, the movable wedge 6 provided at the base plate 5 in the slidable manner and the spring 12 serving as the biasing member biasing the movable wedge 6 toward the fixed wedge 8. The guide rail 11 formed at the base plate 5 engages with the guide groove 10 formed at the movable wedge 6 in a manner that the guide rail 11 and the guide groove 10 slide relative to each other, thereby allowing the movable wedge 6 to slide. According to the vehicle door fixing apparatus of the first embodiment, the leaf spring 13 is provided in the compressed state between the wall of the guide groove 10 and the surface of the guide rail 11. According to the first embodiment, the leaf spring 13 pushes the surface of the guide rail 11 against the wall of the guide groove 10. Thus, the looseness between the guide groove 10 and the guide rail 11 is reduced, thereby restricting the backlash of the movable wedge 6. Consequently, according to the first embodiment, the backlash of the movable wedge 6 may be restricted and an abnormal noise caused by the backlash may be appropriately restricted.

(11) According to the first embodiment, the leaf spring 13 made of metal is insert-molded to the movable wedge 6 made of resin. Thus, the leaf spring 13 made of metal may be provided at the movable wedge 6 made of resin in a simple and accurate manner.

(12) According to the first embodiment, a surface of the inclined surface 7 of the movable wedge 6 is coated with layers of elastic material whose elastic coefficient is higher than that of the resin material of the movable wedge 6, for example, silicone rubber but not limited thereto. Thus, even in case that the inclined surface 7 of the movable wedge 6 collides with the inclined surface 9 of the fixed wedge 8 when the door is closed, the elastic material may absorb the energy of an impact between the inclined surface 7 and the inclined surface 9, and thus an occurrence of a high-volume abnormal noise may be restricted.

(13) According to the first embodiment, the resin piece 14 as the locking member, which restricts the sliding movement of the movable wedge 6 and locks the movable wedge 6 at the position where the movable wedge 6 causes the bolt hole 5*a* to be exposed, is removably attached to the movable wedge device 2. Thus, in a state where the resin piece 14 is attached to the movable wedge device 2, the bolts may be tightened without manually sliding the movable wedge 6 against the biasing force of the spring 12. By removing the resin piece 14 from the movable wedge device 2 after the bolts are tightened, the movable wedge device 2 functions properly. Consequently, according to the first embodiment, a favorable assembling performance of the movable wedge device 2, which includes the movable wedge 6 for restricting a backlash of the door and which is provided at the vehicle door fixing apparatus, is ensured.

(14) According to an assembling method of the first embodiment, the movable wedge device 2 is assembled on the vehicle door fixing apparatus through the process in which the resin piece 14 restricting the sliding movement of the movable edge 6 so that the movable wedge 6 is locked at the position where the bolt holes 5*a* are exposed is attached to the movable wedge device 2, the process in which the base plate 5 is fixedly attached to the vehicle body panel B by tightening the bolts through the bolt holes 5*a*, which are exposed by attaching the resin piece 14 to the movable wedge device 2, and the process in which the resin piece 14 is removed from the movable wedge device 2 after the base plate 5 is fixedly attached to the vehicle body panel B. Thus, the bolts may be tightened without manually sliding the movable wedge 6 against the biasing force of the spring 12, thereby ensuring the favorable assembling performance of the movable wedge device 2, which includes the movable wedge 6 for restricting the backlash of the door and which is provided at the vehicle door fixing apparatus.

(15) According to the first embodiment, the resin piece 14 fits into the gap formed between the innermost portion of the slit 6*a* and the door lock striker 1 when the movable wedge 6 is displaced to the position where the movable wedge 6 causes the bolt holes 5*a* to be exposed. The resin piece 14, which is fitted into the gap in the above-explained state, restricts the sliding movement of the movable wedge 6. Thus, the sliding movement of the movable wedge 6 may be reliably restricted by means of a member having a relatively simple configuration.

(16) According to the first embodiment, the protruding portion 16 is provided on the lower surface of the resin piece 14 so as to protrude downwardly and the groove 17*a* for accepting the protruding portion 16 is formed on the base plate 5. Thus, the resin piece 14 may be attached to the movable wedge device 2 in a reliable and stable manner.

(17) According to the first embodiment, the knob portion 15 is provided on the upper surface of the resin piece 14. Thus, the resin piece 14 may be held reliably, and attached to and removed from the movable wedge device 2 easily.

(18) According to the first embodiment, the movable wedge 6 may be assembled on the vehicle body panel B via the base plate 5 at the same time when the door lock striker 1 is assembled on the vehicle body panel B. The fixed wedge 8 may be assembled on the door panel D at the same time when the door lock assembly 4 is assembled on the door panel D. Thus, man-hours for assembling the vehicle door fixing apparatus on the vehicle may be reduced, thereby improving the working performance for the assembly.

(19) According to the first embodiment, plural steps are formed on the inclined surface 7 of the movable wedge 6 and on the inclined surface 9 of the fixed wedge 8 in a manner that the plural steps of the inclined surface 7 and the plural steps of the inclined surface 9 are engageable with each other. Thus, an occurrence of slippage between the inclined surface 7 and the inclined surface 9 may be reduced without reducing an inclination angle of the inclined surfaces 7 and 9 to be smaller than an angle of friction thereof, and thus the inclined surfaces 7 and 9 may be downsized.

(20) According to the first embodiment, the spring accommodating portion 29 is provided behind the door lock striker 1 in a moving direction of the movable wedge 6. Thus, the spring 12 may bias or push the movable wedge 6 evenly. In addition, according to the first embodiment, the door lock striker 1 and the spring accommodation space 29 are provided at the base plate 5, thereby making it simple to form the base plate 5.

A vehicle door fixing apparatus according to a second embodiment will be explained with reference to FIGS. 28 to 52. In the second embodiment, the vehicle door fixing apparatus is applied to a side door positioned at a front right side of a vehicle having an open air type body structure or a vehicle having a convertible type structure.

Figure 28:
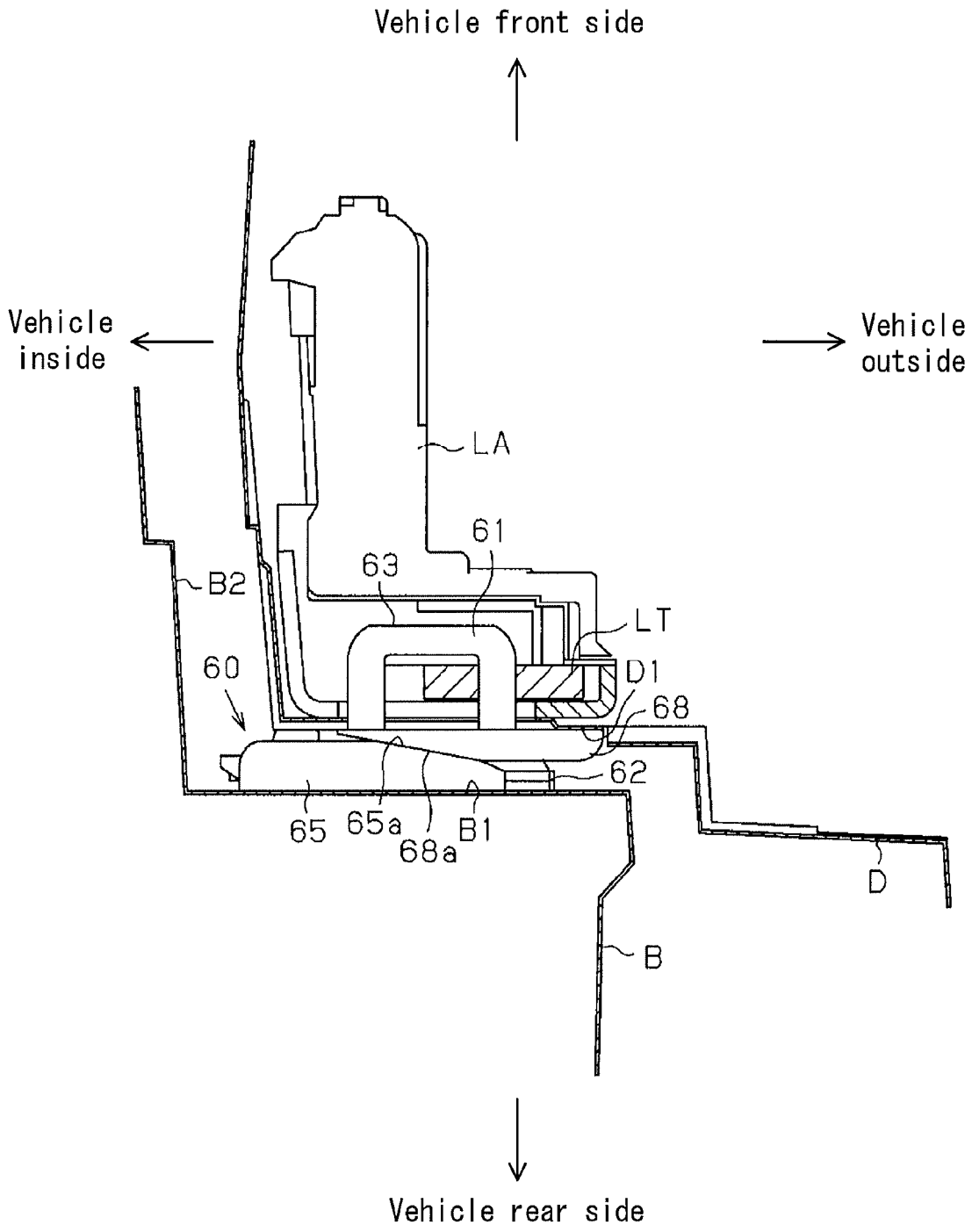
FIG. 28 is a cross sectional view of a vehicle door fixing apparatus according to a second embodiment disclosed here.

As shown in FIG. 28, at a rear portion of the vehicle relative to an opening (a door opening) provided at a side portion of the vehicle, a vehicle body panel B (i.e., a side member outer panel) defines an end surface B1, which extends in a vehicle width direction and faces a front side of a vehicle (hereinafter referred to as the end surface B1). The vehicle body panel B also defines a flange B2 extending from an end portion of the end surface B1 toward a front direction of the vehicle. The end portion, from which the flange B2 extends, of the end surface B1 is positioned in a vicinity of an inside of the vehicle in the vehicle width direction (a left/right direction when viewed in FIG. 28). A movable wedge device 60, which includes a door lock striker 61 and a movable wedge 65, is provided at the end surface B1 and serves as a wedge device.

On the other hand, a door panel D (i.e., a door inner panel) of the vehicle door, which opens and closes the opening along the vehicle width direction, defines an end surface D1 which extends in the vehicle width direction and is positioned forward of the end surface B1 to face the end surface B1 (hereinafter referred to as the end surface D1). A fixed wedge 68 is fixedly attached to the end surface D1 of the door panel D at a portion facing the movable wedge device 60 in a state where the vehicle door is closed. In addition, a door lock assembly LA including a door latch LT, and engaging with and disengaging from the door lock striker 61 is assembled on the door panel D together with the fixed wedge 68, the door lock assembly LA is positioned at an opposite side of the fixed wedge 68 relative to the door panel D.

Figure 29:
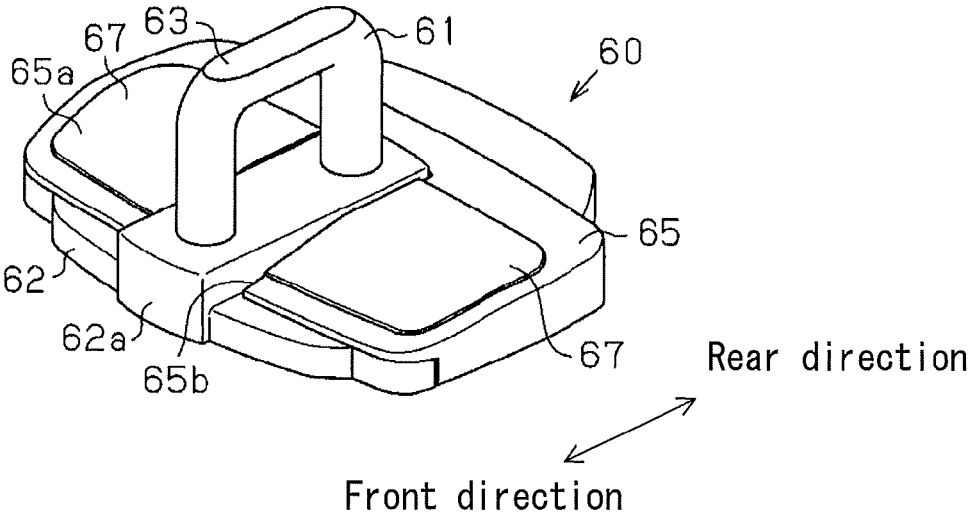
FIG. 29 is a perspective view of a movable wedge device to be provided at the vehicle door fixing apparatus of the second embodiment.
Figure 30:
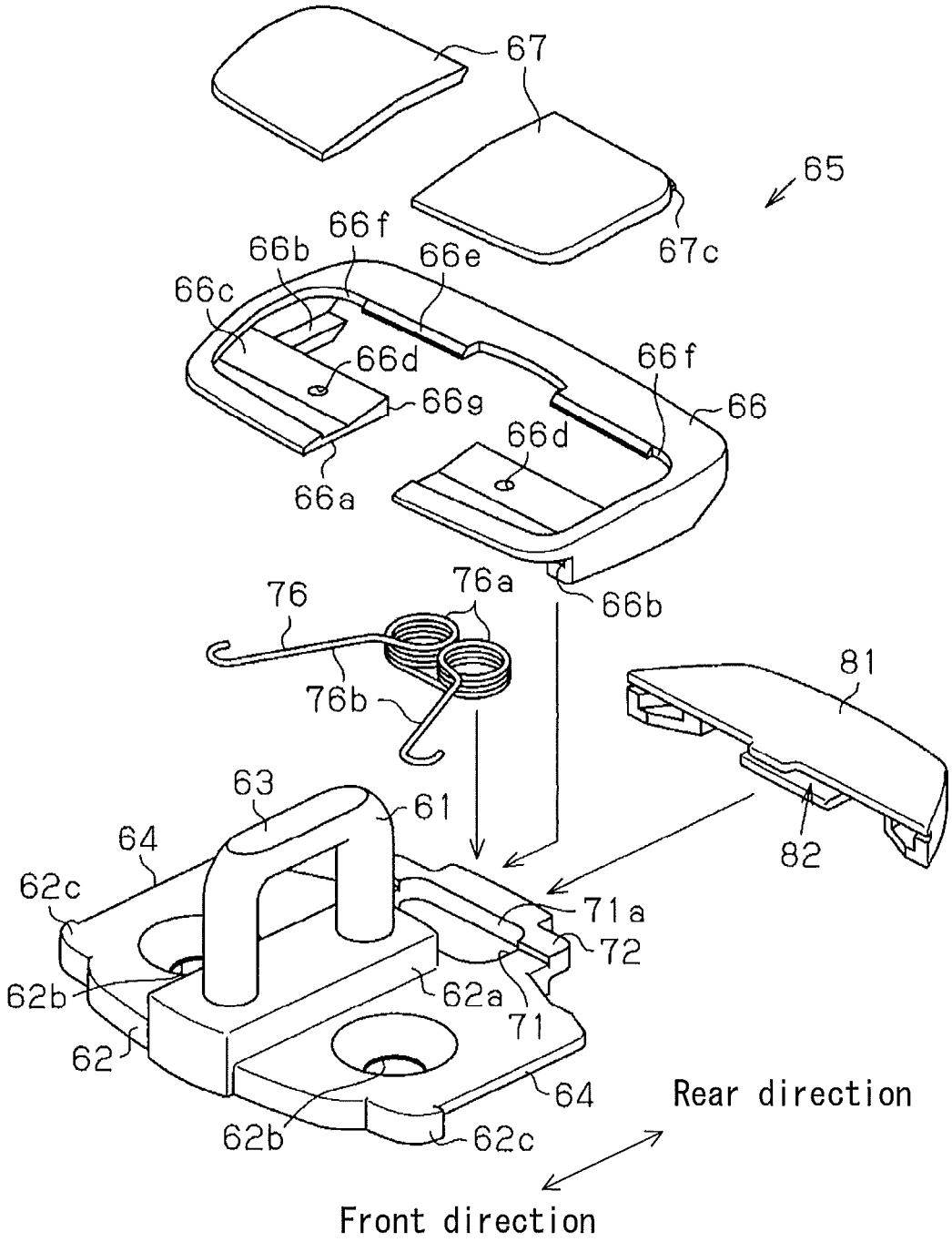
FIG. 30 is an exploded perspective view of the movable wedge device of the second embodiment.

Next, the movable wedge device 60 will be further explained. As shown in FIGS. 29 and 30, the door lock striker 61 includes a base plate 62 and a shaft 63. The base plate 62 is formed in a substantially flat plate shape spreading on the end surface B1. The shaft 63 is provided at the base plate 62 to protrude in the front direction of the vehicle. The shaft 63 is formed to be bent in a substantially U-shaped form so that an upper end portion thereof, which is positioned farther from the base plate 62, is closed. The movable wedge 65 is configured by a strength member 66 made of, for example, a metal material and a pair of contact members 67, 67 each formed from, for example, a resin panel. The strength member 66 has a higher rigidity than each contact member 67.

The movable wedge device 60 is configured by the door lock striker 61, the movable wedge 65, a spring 76 and a cover 81 fixedly attached to the base plate 62. The spring 76 is interposed between the door lock striker 61 and the movable wedge 65, and serves as a biasing member. For convenience, relative to a direction in which the upper end portion (that is, a closed portion of the substantially U-shaped form) of the shaft 63 (the door lock striker 61) extends, a direction away from the cover 81 (a diagonally downward left direction in FIGS. 29 and 30) will be hereinafter referred to as a front direction of the movable wedge device 60 (corresponding to a vehicle outside in the vehicle width direction) and a direction toward the cover 81 (corresponding to a diagonally upward right direction in FIGS. 29 and 30) will be hereinafter referred to as a rear direction of the movable wedge device 60 (a vehicle inside in the vehicle width direction). A detailed structure of the cover 81 is substantially identical to that of the cover 31 of the first embodiment.

As shown in FIGS. 34A to 34D, a guide protruding portion 62*a* is formed at the base plate 62 of the door lock striker 61 to protrude in a protruding direction of the shaft 63. The guide protruding portion 62 has a substantially rectangular column shape and extends substantially between a front end portion and a rear end portion of the shaft 63. The guide protruding portion 62 is formed to extend in a front/rear direction of the door lock striker 61 (the movable wedge device 60) so as to bridge the front end portion and the rear end portion of the shaft 63. Each of the front and rear portions of the shaft 63 is fixed to the base plate 62 by caulking. A bolt hole 62*b* to which a bolt for fixing the base plate 62 to the vehicle body panel B is inserted is formed at the base plate 62 at each side relative to the guide protruding portion 62*a* (the shaft 63) in a lateral direction of the movable wedge device 60. A guide rail 64 having a substantially rectangular cross-section is formed at each lateral side portion of the base plate 62 to linearly extend in the front/rear direction of the door lock striker 61 (the movable wedge device 60). Further, a locking tab 62*c* formed in a tab shape is provided at a front portion of each guide rail 64 in a manner that the pair of locking tabs 62*c*, 62*c* protrude in a direction away from each other.

The base plate 62 is provided with a supporting portion 71*a* positioned behind the shaft 63 and supporting a part of the spring 76. A spring accommodating portion 71 (i.e., the biasing member accommodating portion) formed in a substantially rectangular shape and providing an accommodation space for the spring 76 is formed at a rear portion of the base plate 62. The spring accommodating portion 71 is constituted by a hole formed at the rear portion of the base plate 62 and a rear wall portion of the spring accommodating portion 71 serves as the supporting portion 71*a*. The base plate 62 further includes a step portion 72 protruding in the protruding direction of the shaft 63 so as to be higher than other portions surrounding the step portion 72.

As shown in FIG. 30, the spring 76 includes plural coil portions 76*a*, for example, a pair of coil portions 76*a*, 76*a*, and an arm portion 76*b* protruding from each coil portion 76*a*. Each coil portion 76*a* is wound in a coiled configuration and is arranged at each side relative to the shaft 63 in the lateral direction of the movable wedge device 60. The spring 76 is formed in a bilaterally symmetrical shape relative to the shaft 63. The coil portions 76*a*, 76*a* are wound in reverse directions to each other, and are connected to each other at a side opposite to the protruding direction of the shaft 63. The arm portions 76*b*, 76*b* protrude in diagonally forward directions so that end portions thereof become gradually away from each other.

Figure 31:
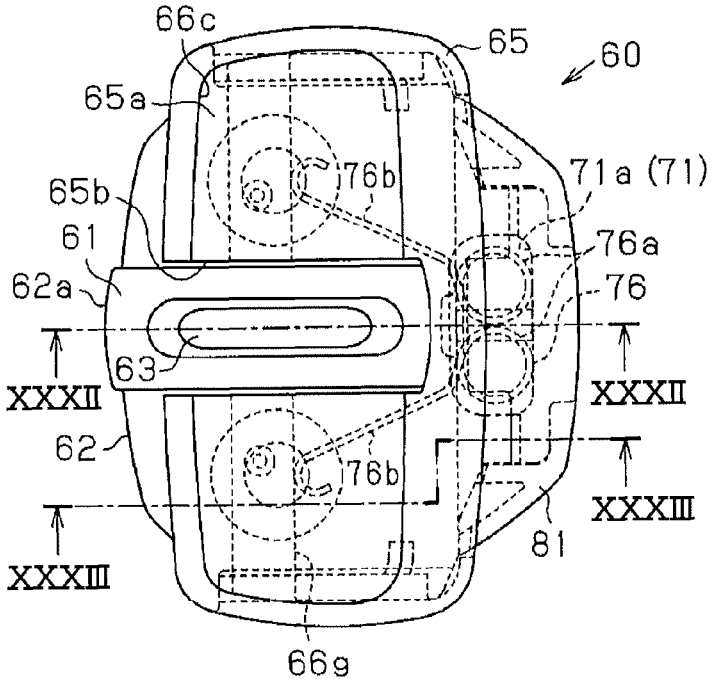
FIG. 31 is a plan view of the movable wedge device of the second embodiment.

As shown in FIG. 31, the coil portions 76*a*, 76*a* are accommodated in the spring accommodating portion 71, and the supporting portion 71*a* supports each coil portion 76*a*, at a portion positioned opposite to a direction in which the pair of arm portions 76*b*, 76*b* protrudes. In other words, the supporting portion 71*a* serves as a supporting surface coming into contact with an outer circumferential surface of each coil portion 76*a*. The arm portions 76*b*, 76*b* are lies on the base plate 62 at each side relative to the shaft 63.

Figure 32:
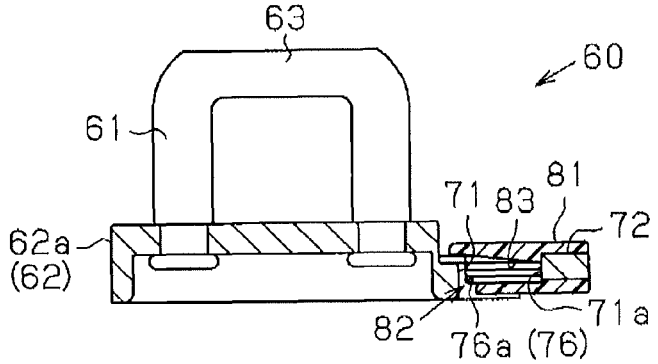
FIG. 32 is a cross-sectional view of the movable wedge device taken along line XXXII-XXXII in FIG. 31.
Figure 35A:
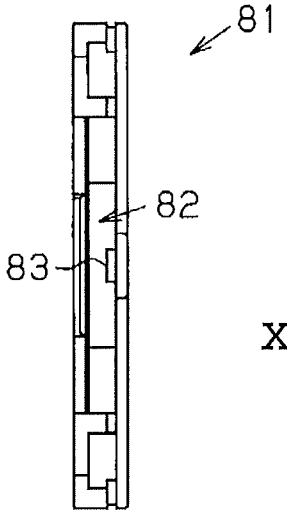
FIG. 35A is a front view of a cover to be assembled on the door lock striker of the first embodiment.
Figure 35B:
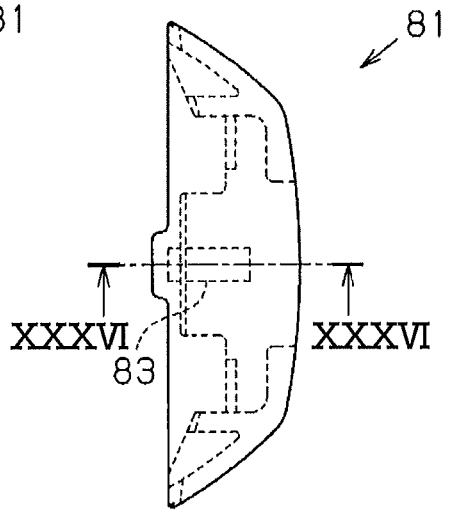
Figure 36:
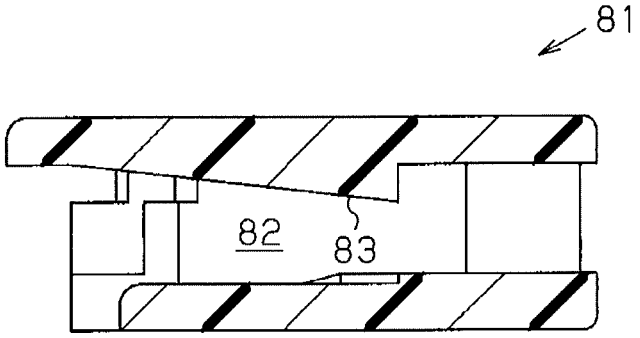
FIG. 36 is a cross sectional view of the cover taken along line XXXVI-XXXVI in FIG. 35.
Figure 37A:
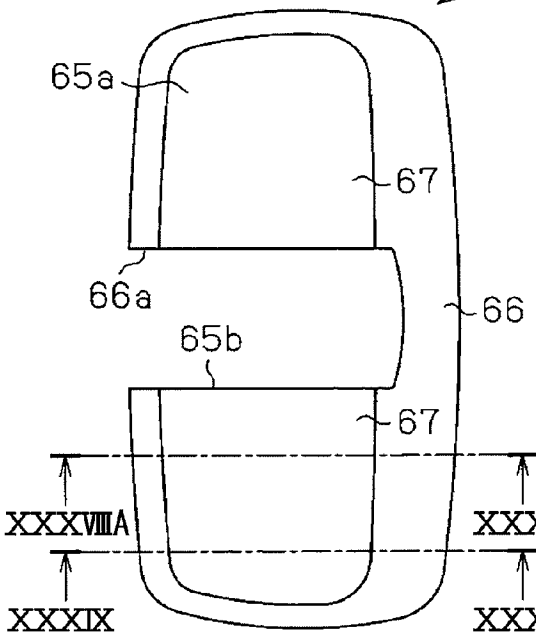
FIG. 37A is a top view of a movable wedge to be provided at the movable wedge device of the second embodiment.
Figure 37B:
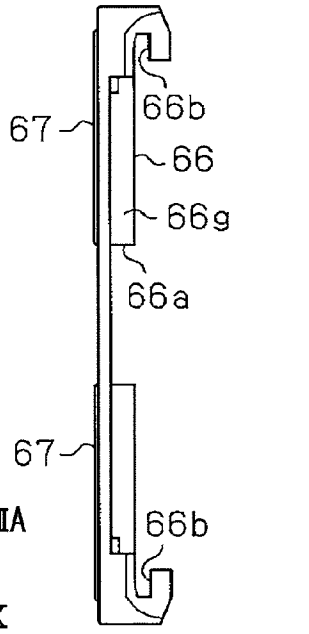
FIG. 37B is a front view of the movable wedge to be provided at the movable wedge device of the second embodiment.
Figure 37C:
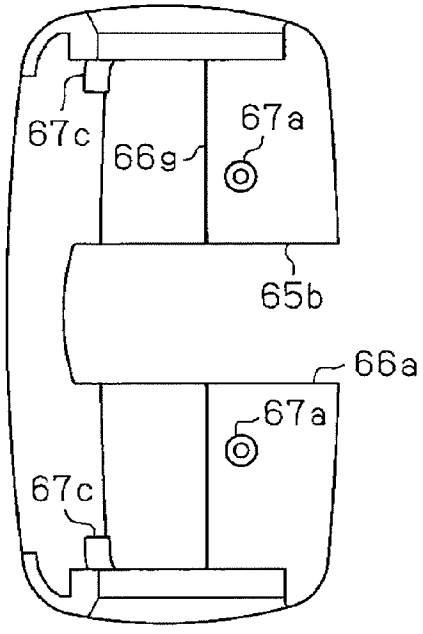
FIG. 37C is a bottom view of the movable wedge to be provided at the movable wedge device of the second embodiment.
Figure 37D:
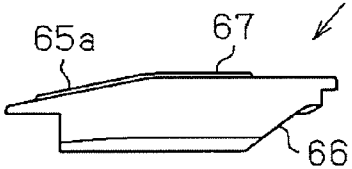
FIG. 37D is a side view of the movable wedge to be provided at the movable wedge device of the second embodiment.

As shown in FIGS. 32, 35A and 35B, the cover 81 includes an accommodation space 82 for accommodating, in cooperation with the base plate 62 (the spring accommodating portion 71), inside thereof the spring 76. As shown in FIG. 36, the accommodation space 82 is formed so as to penetrate from a front end to a rear end of the cover 81.

Figure 33:
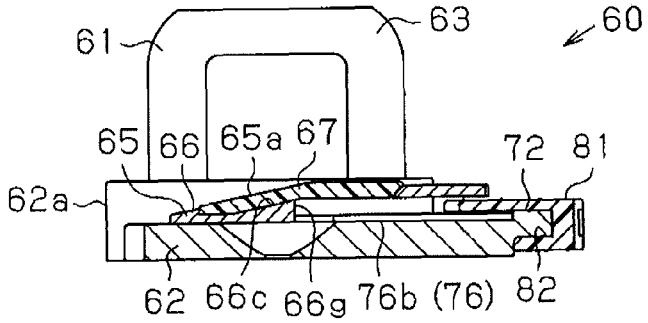
FIG. 33 is a cross-sectional view of the movable wedge device taken along line XXXIII-XXXIII in FIG. 31.
Figure 34A:
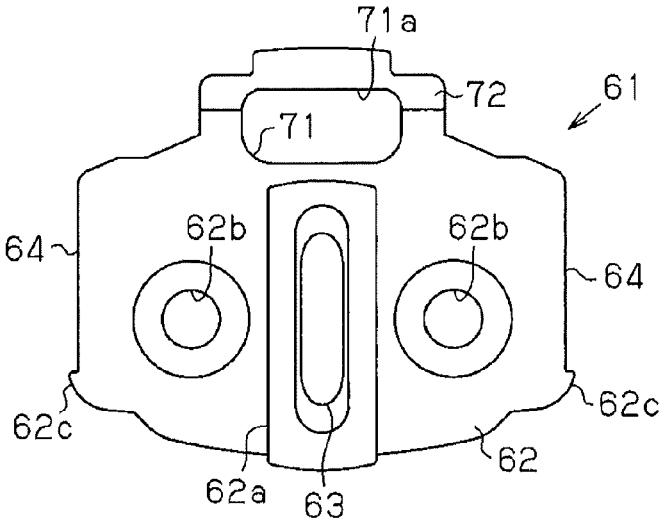
FIG. 34A is a top view of a door lock striker to be provided at the movable edge device of the second embodiment.
Figure 34B:
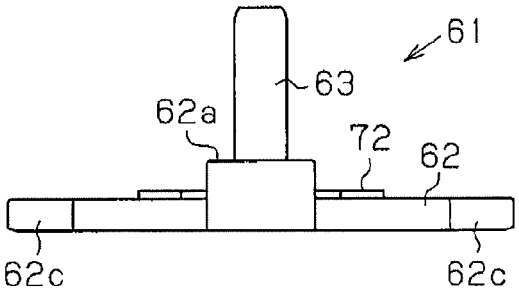
FIG. 34B is a front view of the door lock striker provided at the movable edge device of the second embodiment.
Figure 34D:
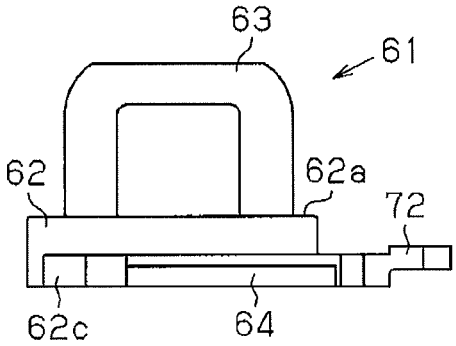
FIG. 34D is a side view of the door lock striker to be provided at the movable edge device of the second embodiment.
Figure 34C:
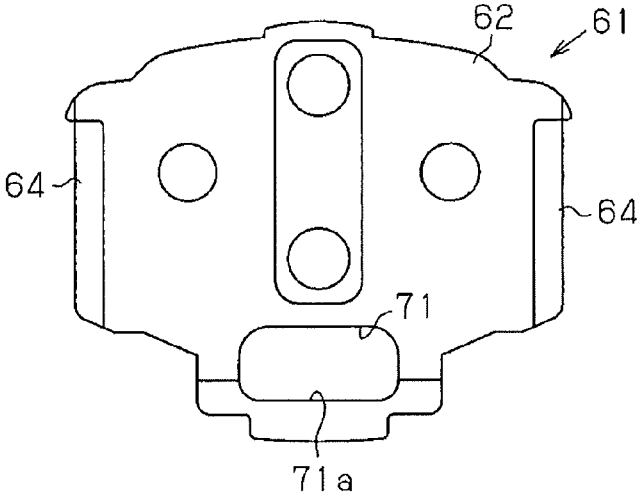
FIG. 34C is a bottom view of the door lock striker to be provided at the movable edge device of the second embodiment.

A tab 83 is formed at a front portion of the cover 81 so as to be interposed between the coil portions 76*a*, 76*a*. A rear end portion of the base plate 62 fits in the accommodation space 82 as shown in FIG. 33, and the tab 83 engages with the step portion 72 of the base plate 62 as shown in FIG. 32, and thus the cover 81 is fixed to the base plate 62. The end portions, which face the protruding direction of the shaft 63 and the opposite direction thereto respectively, of each coil portion 76*a* are supported by inner walls, which face each other, of the accommodation space 82. A rear end of each coil portion 76*a* is supported by a side wall of a rear portion of the spring accommodating portion 71.

The movable wedge 65 is provided at the base plate 62 in a manner that the movable wedge 65 covers an end surface of the base plate 62, which faces the protruding direction of the shaft 63. As shown in FIG. 30, the strength member 66 of the movable wedge 65 is formed in a substantially rectangular frame-like shape and includes a guide groove 66*a* formed in a substantially central portion of a front end portion of the strength member 66 and extending in the front/rear direction of the movable wedge 65. A guide groove 66*b* is formed at each of lateral edge portions of the strength member 66 to extend in the front/rear direction of the movable wedge device 60. Communication is provided between a front end and a rear end of each guide grove 66*b*. The guide grooves 66*b*, 66*b* include substantially U-shaped cross sections and openings of the U-shaped cross sections face each other. The guide groove 66*a* slidably engages with the guide protruding portion 62*a* of the base plate 62 and the guide grooves 66*b*, 66*b* engage with the guide rails 64, 64 provided at the base plate 62 respectively, and thus the strength member 66 is movable relative to the base plate 62 in the front/rear direction of the movable wedge device 60 within a certain range. In other words, the strength member 66 (the movable wedge 65) is slidable relative to the base plate 62 in the front/rear direction of the movable wedge device 60 via a pair of rail mechanisms, which is constituted by the guide rails 64, 64 and the guide grooves 66*b*, 66*b*, or other mechanism.

Figure 38A:
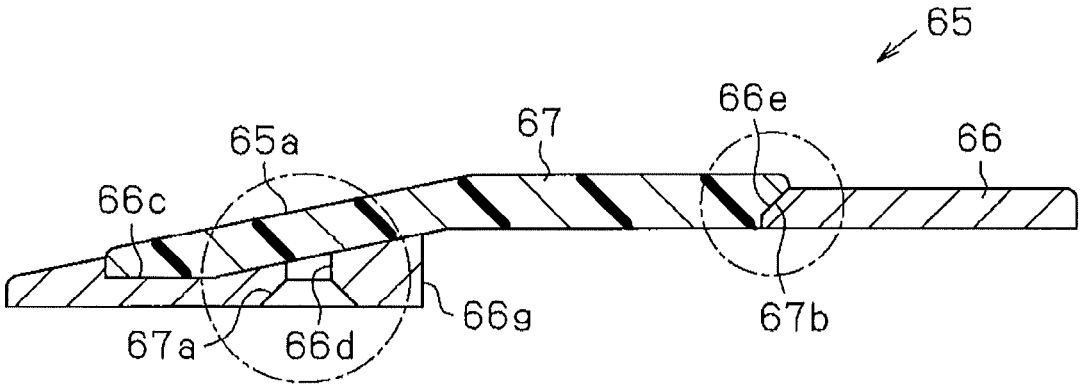
FIG. 38A is a cross sectional view of the movable wedge taken along line XXXVIIIA-XXXVIIIA in FIG. 37A.
Figure 38B:
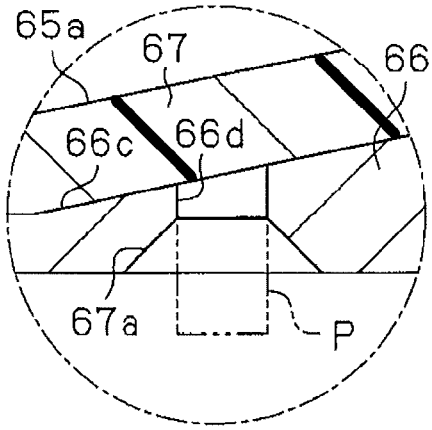
FIG. 38B is an enlarged view of a portion of FIG. 38A.
Figure 38C:
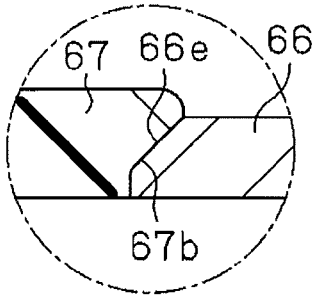
FIG. 38C is an enlarged view of a portion of FIG. 38A.
Figure 39:
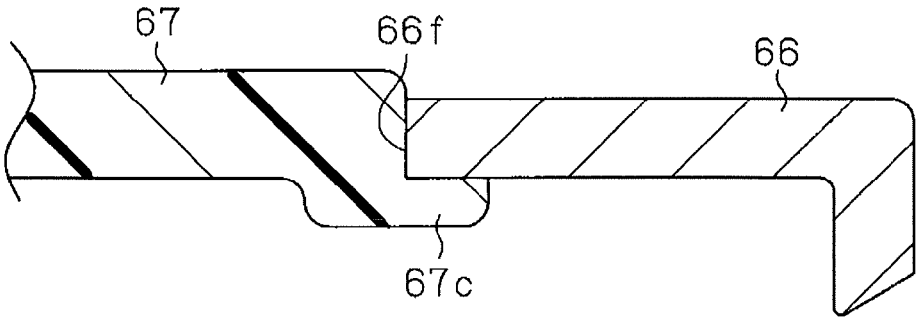
FIG. 39 is a cross sectional view of the movable wedge take along line XXXIX-XXXIX in FIG. 37A.

An attachment recessed portion 66*c* is formed so as to be recessed forward the upper surface of the base plate 62, at a rear portion of the front end portion of the strength member 66 to extend in a lateral direction of the strength member 66 over an entire length thereof. The strength member 66 includes an attachment hole 66*d* which is formed at each attachment recessed portion 66*c* at each side relative to the guide groove 66*a* and which penetrates the strength member 66 in a thickness direction thereof (the protruding direction of the shaft 63). As shown in FIGS. 38A and 38C, a chamfered portion 66*e* having a sloped configuration is formed at a front edge of a rear end portion of the strength member 66. The chamfered portion 66*e* is positioned at an intermediate portion of the strength member 66 in an extending direction thereof. Thus, due to the chamfered portion 66*e*, the rear end portion of the strength member 66 is formed in a manner that an end portion, which is positioned in a vicinity of the base plate 62, of the front edge is sharpened toward the front direction. As shown in FIG. 39, at each end portion, in the extending direction of the strength member 66, of the front edge of the rear end portion of the strength member 66, a locking portion 66*f* standing at a substantially right angle is formed instead of the chamfered portion 66*e*.

As shown in FIG. 30, the contact member 67, 67 of the movable wedge 65 are fixed to the strength member 66 so as to be laid on the attachment recessed portions 66*c*, 66*c* at each side relative to the guide groove 66*a*. As shown in FIGS. 38A and 38B, an attachment protruding portion 67*a* is formed at a front end portion of each contact member 67. An end portion of the attachment protruding portion 67*a*, which is formed in a flanged shape, is inserted in and penetrates through the attachment hole 66*d*. Each attachment protruding portion 67*a* serves as a stopper by engaging with an edge portion of the attachment hole 66*d*. As shown in FIG. 38B, the attachment protruding portion 67*a* is formed by welding an end portion of a pin P, which has a substantially cylindrical shape and which is for penetrating through the attachment hole 66*d*, so that the end portion of the pin P is formed in the flanged shape.

As shown in FIG. 38C, a chamfered portion 67*b* having a sloped configuration and serving as a stopper is formed at a rear edge portion of each contact member 67 so that the contact member 67 does not come off the strength member 66. The chamfered portion 67*b* is positioned at an intermediate portion of each contact member 67 in the extending direction thereof so that the chamfered portion 67*b* faces the chamfered portion 66*e* of the strength member 66. Thus, due to the chamfered portion 67*b*, the rear edge portion of each contact member 67 is formed in a manner that an end portion, which is positioned away from the base plate 62, of the rear edge portion of the chamfered portion 67*b* is sharpened toward the rear direction. As shown in FIG. 39, a locking tab 67*c* is formed at the rear edge portion of each contact member 67, at a portion facing the corresponding locking portion 66*f*. Each locking tab 67*c* is formed protruding in the rear direction so as to be in contact with a surface, which faces the base plate 62, of the locking portion 66*f* so that each attachment protruding portion 67*a* does not come off the attachment hole 66*d*. Accordingly, the chamfered portion 67*b* and the locking tab 67*c* of each contact member 67 are in contact with the chamfered portion 66*e* and the locking portion 66*f* of the strength member 66, respectively, and thus the rear edge portion of each contact member 67 sandwiches a front edge portion of the rear end portion of the strength member 66 in the thickness direction thereof. Consequently, each contact member 67 is restricted from coming off the strength member 66 in the thickness direction thereof.

In order to assemble each contact member 67 on the strength member 66, the contact member 67 is moved rearward relative to the strength member 66 so that the front edge portion of the rear end portion of the strength member 66 is sandwiched by the chamfered portion 67*b* and the locking tab 67*c* in the thickness direction thereof. In a state where the chamfered portion 67*b* and the locking tab 67*c* sandwich therebetween the front edge portion of the rear portion end of the strength member 66, the contact member 67 is pivoted about a pivot point, that is, the chamfered portion 67*b*, toward the strength member 66 in the thickness direction of the strength member 66 while the pin P is inserted in the corresponding attachment hole 66*d* so that the contact member 67 is laid on the attachment recessed portion 66*c*. The end portion of the pin P, which penetrates through the attachment hole 66*d*, is welded to have the flanged shape, and thus the attachment protruding portion 67*a* is formed. Thus, each contact member 67 is fixedly attached to the strength member 66 and restricted from coming off the strength member 66.

As shown in FIGS. 37A to 37D and 38, the movable wedge 65 includes an inclined surface 65*a* which is formed at the front portion of each contact member 67 fixed to the strength member 66 and which is inclined toward the front direction of the movable wedge 65 so as to be closer to the strength member 66 in the thickness direction thereof. The movable wedge 65 also includes a slit 65*b* cut off from the front direction of the movable wedge 65. The slit 65 is positioned between the pair of contact members 67, 67 each of which is fixed to the attachment recessed portion 66*c* at each side relative to the guide groove 66*a*. In other words, the entire movable wedge 65 engages with the guide protruding portion 62*a* (the door lock striker 61) of the base plate 62 at the slit 65*b*.

In order to assemble the movable wedge device 60, the guide groove 66*a* of the strength member 66 (the movable wedge 65) is slid relative to the guide protruding portion 62*a* of the base plate 62 from a rear direction to a front direction of the base plate 62 as shown in FIG. 30, while sliding the guide grooves 66*b*, 66*b* into the guide rails 64, 64 formed at lateral side portions of the base plate 62. While retaining the above-described state, the arm portions 76*b*, 76*b*, each protruding diagonally in the front direction of the movable wedge device 60, are pressed against a rear edge surface 66*g* of the front end portion of the strength member 66 as shown in FIGS. 31 to 33, and the coil portions 76*a*, 76*a* are accommodated in the spring accommodating portion 71. At this time, the arm portions 76*b*, 76*b* of the spring 76 are pushed by the rear edge surface 66*g* and thus an angle between arm portions 76*b*, 76*b* increases, that is, a distance between the arm portions 76*b*, 76*b* increases. Thus, torsional forces are generated at the coil portions 76*a*, 76*a*, thereby generating a biasing force in a direction in which the angle between the arm portions 76*b*, 76*b* decreases. Accordingly, the strength member 66 (the movable wedge 65) is biased in the front direction thereof by the coil portions 76*a*, 76*a*. Accordingly, the strength member 66 is always biased relative to the base plate 62 in the front direction of the movable wedge device 60 so that the front edge portion of the rear end portion of the strength member 66 comes in contact with a rear end surface of the guide protruding portion 62*a* of the base plate 62 or so that a front end surface of each guide groove 66*b* comes in contact with the corresponding locking tab 62*c* of the base plate 62.

Next, the rear end portion of the base plate 62 is fitted into the accommodation space 82 of the cover 81 and the tab 83 is engaged with the step portion 72 of the base plate 62, so that the cover 81 is fixed to the base plate 62. At this time, the end portions, which face the protruding direction of the shaft 63 and the opposite direction thereto, of each coil portion 76*a* are supported by the inner walls, which face each other, of the accommodation space 82. The rear end of each coil portion 76*a* is supported by a rear wall of the spring accommodating portion 71.

Figure 40:
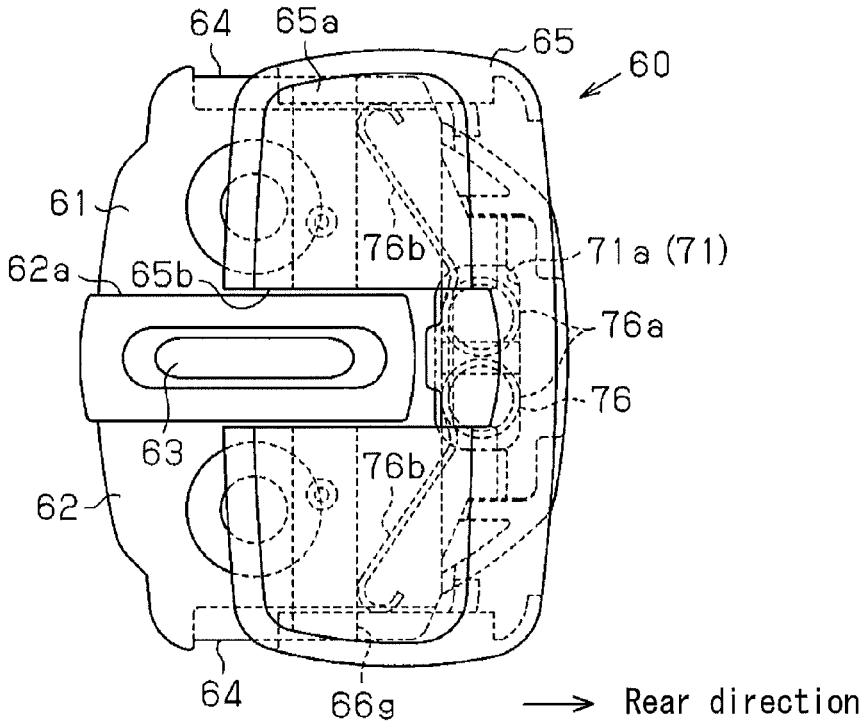
FIG. 40 is a plan view illustrating a movement of the movable wedge device of the second embodiment.
Figure 41:
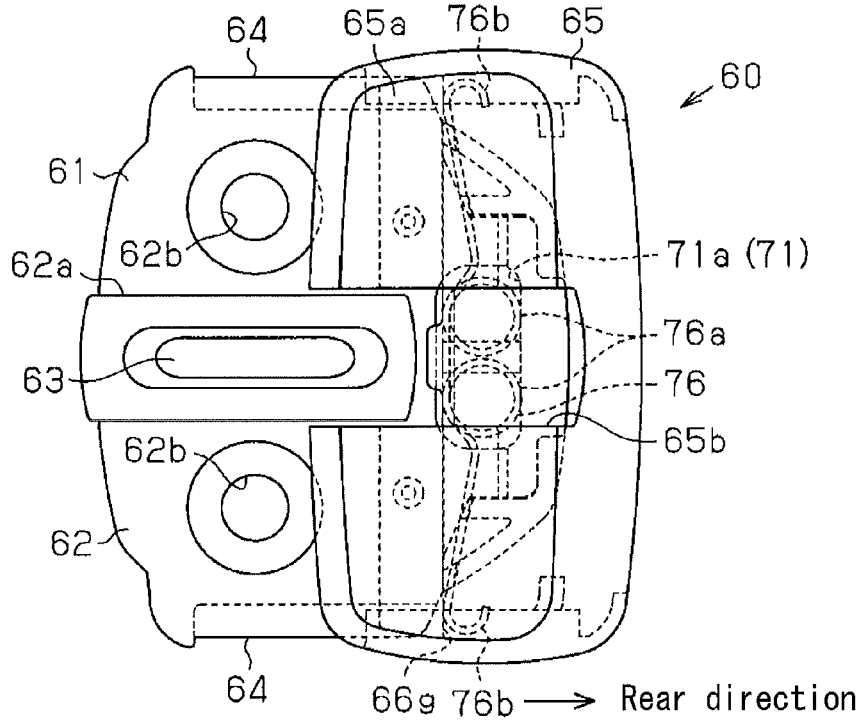
FIG. 41 is a plan view of the movable wedge device of the second embodiment before being assembled on the vehicle body panel.

As described above, the assembly of the movable wedge device 60 is completed. Thus, as shown in FIG. 40, the movable wedge 65 that is always biased by the spring 76 in the front direction relative to the base plate 62 is movable in the rear direction against the biasing force of the spring 76. At this time, the arm portions 76*b*, 76*b* are pushed by the rear edge surface 66*g* of the strength member 66 and the angle between the arm portions 76*b*, 76*b* increases, and thus a biasing force in a direction in which the angle between the arm portions 76*b*, 76*b* decreases, that is, the biasing force biasing the strength member 66 (the movable wedge 65) in the front direction, is generated. As shown in FIG. 41, as the movable wedge 65 moves further in the rear direction against the biasing force of the spring 76, the bolt holes 62*b*, 62*b* may be exposed in a direction in which the bolts are inserted in the bolt holes 62*b*, 62*b*, respectively.

Figure 42:
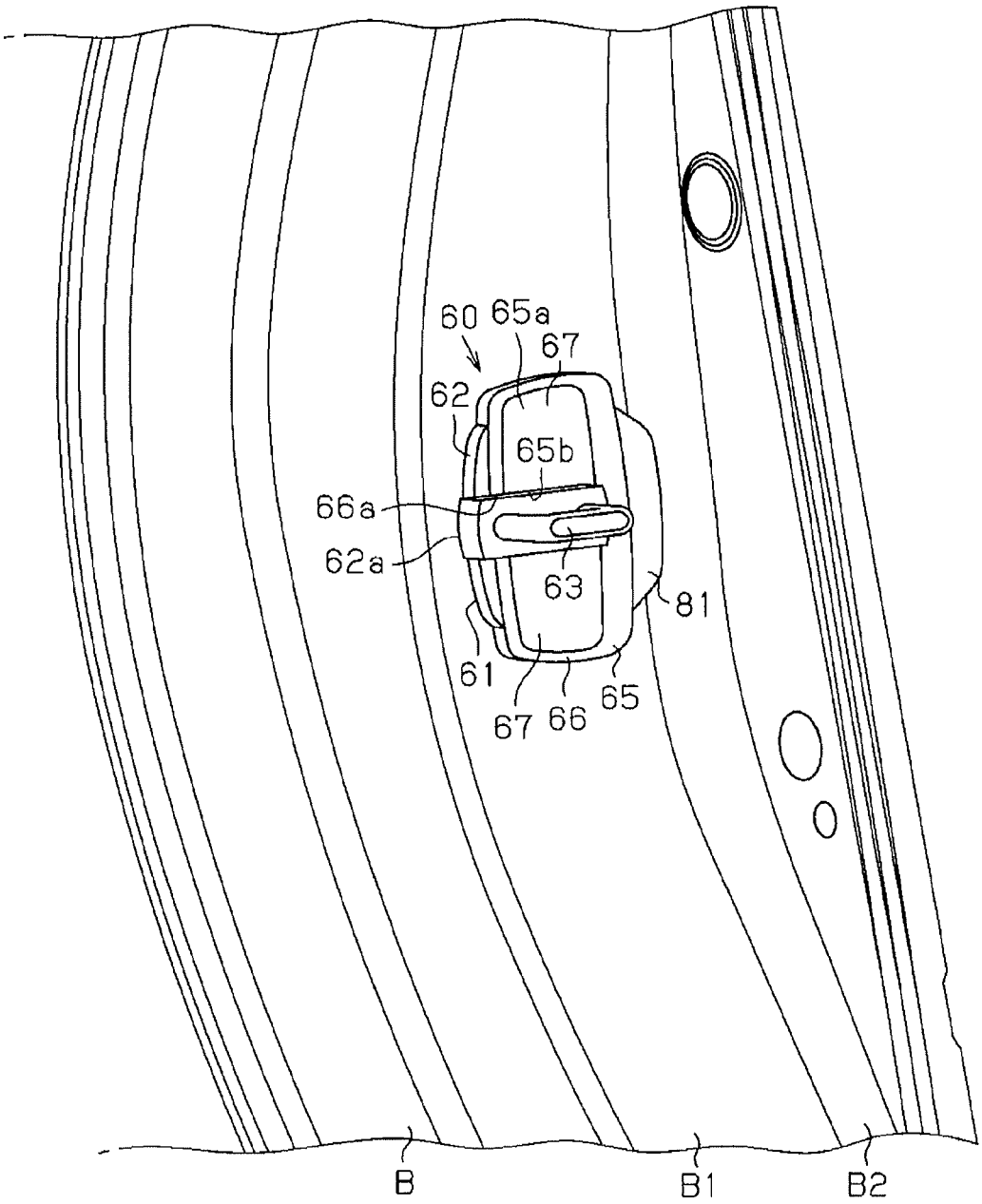
FIG. 42 is a perspective view illustrating a manner in which the movable wedge device of the second embodiment is provided at the vehicle body panel.

As shown in FIGS. 28 and 42, the movable wedge device 60 having the above-explained structure is fixedly attached to the end surface B1 of the vehicle body panel B. In a state where the movable wedge device 60 is attached to the end surface B1, a direction in which the upper end portion of the shaft 63 (the door lock striker 61) extends, that is, the front/rear direction of the movable wedge device 60 and a moving direction of the movable wedge device 65, coincides with the vehicle width direction. In other words, the moving direction of the movable wedge device 65 coincides with a direction in which the door panel D comes closer to and away from the vehicle body panel B when the vehicle door is operated for opening and closing. Consequently, the movable wedge 65 (the strength member 66) surrounds the shaft 63 of the door lock striker 61 in a manner that the guide groove 66*a* is opened toward the fixed wedge 68 in the direction in which the door panel D comes closer to and away from the vehicle body panel B. The inclined surface 65*a* is inclined so as to gradually come closer to the end surface B1 toward the vehicle outside in the vehicle width direction.

In order to attach the movable wedge device 60 to the end surface B1, the movable wedge 65 is moved in the rear direction (in the vehicle inside direction in the vehicle width direction) as explained above against the biasing force of the spring 76 so that the bolt holes 62*b*, 62*b* are exposed. In a state where the bolt holes 62*b*, 62*b* are exposed, bolts for fixing the base plate 62 to the vehicle body panel B are inserted in the bolt holes 62*b*, 62*b* and are tightened to the vehicle body panel B. After the wedge device 60 is attached to the end surface B1 and the movable wedge 65 is released, the movable wedge 65 is biased by the spring 76 in the front direction so that the front edge portion of the rear end portion of the strength member 66 comes in contact with the rear end surface of the guide protruding portion 62*a* of the base plate 62 or so that the front end surface of each guide groove 66*b* comes in contact with the corresponding locking tab 62*c* of the base plate 62. Accordingly, the bolt holes 62*b*, 62*b* (and the bolts inserted therein) come to be covered with the base plate 5 so as not to be exposed to the outside. Thus, the movable wedge device 60 is configured so that the bolt holes 62*b*, 62*b* are covered with the movable wedge 65 so as not to be exposed to the outside in a normal state, that is, in the state where the movable wedge 65 is not slid in the rear direction thereof against the biasing force of the spring 76.

Figure 43:
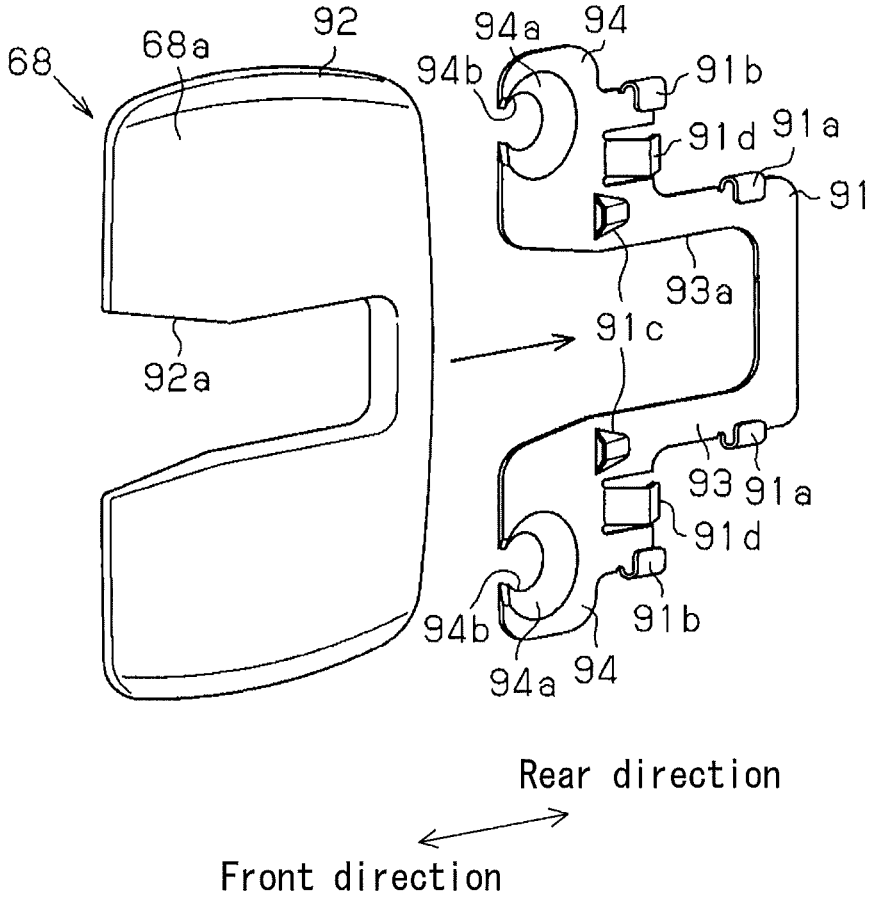
FIG. 43 is an exploded perspective view of the fixed wedge to be provided at the vehicle door fixing apparatus of the second embodiment.

Next, the fixed wedge 68 will be described in more detail. As shown in FIG. 43, the fixed wedge 68 includes an attachment member 91 made from, for example, a metal plate and a wedge member 92 made of, for example, a resin material. The attachment member 91 includes a body portion 93 and a pair of extending portions 94, 94, all of which are formed as one piece. The body portion 93 includes a slit 93*a* formed into a substantially rectangular shape, and thus the body portion 93 is formed in a substantially U-shape. The pair of extending portions 94, 94 is formed at side portions in a vicinity of an opening of the body portion 93 in the front/rear direction of the fixed wedge 68 so as to be positioned both sides relative to an opening portion of the slit 93 so as to extend in opposite directions from each other in a lateral direction of the wedge member 92. The attachment member 91 is symmetrically constructed relative to the slit 93*a*. Hereunder, a direction in which the substantially U-shape of the body portion 93 (the attachment member 91) opens (a diagonally downward left direction in FIG. 43) corresponds to a front direction of the fixed wedge 68 and the opposite direction to the front direction of the fixed wedge 68 (a diagonally upward right direction in FIG. 43) corresponds to a rear direction of the fixed wedge 68.

The attachment member 91 includes a pair of guide rails 91*a*, 91*a* for engaging with the fixed wedge and a pair of guide rails 91*b*, 91*b* for engaging with the fixed wedge (hereinafter referred to as the guide rail 91*a* and the guide rail 91*b*, respectively). The pair of guide rails 91*a*, 91*a* is formed at lateral end portions of a rear portion of the body portion 93, respectively so as to rise and bend in a direction in which the guide rails 91*a*, 91*a* face each other. Each guide rail 91*b* is formed at a lateral end portion of a rear portion of each extending portion 94 so as to rise and bend in a manner that the guide rails 91*b*, 91*b* face each other. The pair of guide rails 91*b*, 91*b* may be bent in a direction away from each other. A pair of first locking portions 91*c*, 91*c* is formed at a front portion relative to the pair of guide rails 91*a*, 91*a*, respectively and each first locking portion 91*c* rises to have a substantially semi-dome shape. Each first locking portion 91*c* protrudes in a direction in which the guide rails 91*a*, 91*a* and the guide rails 91*b*, 91*b* rise. A protruding length of each first locking portion 91*c* becomes progressively longer from a rear portion to a front portion thereof. An engagement protruding portion 91*d* is formed at the attachment member 91, between each guide rail 91*b* and the corresponding first locking portion 91*c*, by cutting and raising a rear end portion of the extending portion 94 so that the cut portion is folded diagonally in the direction in which the first locking portion 91*c* rises at a fold line, that is, a front end of the cut portion. A rear end portion of each engagement protruding portion 91*d* is bent toward the attachment member 91, and thus the engagement protruding portion 91*d* is formed in a protruding shape.

A recessed portion 94*a* having a substantially conical shape is formed at each extending portion 94 to serve as a bearing surface for a bolt for fixing the attachment member 91 (the fixed wedge 68) to the door panel D. At a substantially center of the recessed portion 94*a*, a bolt hole 94*b* into which the bolt is inserted is formed. Each bolt hole 94*b* has a substantially major arc shape that opens in the front direction of the fixed wedge 68, thereby reducing a size of the attachment member 91 (the pair of extending portions 94, 94) in the front/rear direction of the fixed wedge 68. Each bolt hole 94*b* may be completely circular in case there is no need to reduce the size of the attachment member 91 (the pair of extending portions 94, 94) in the front/rear direction.

Figure 44:
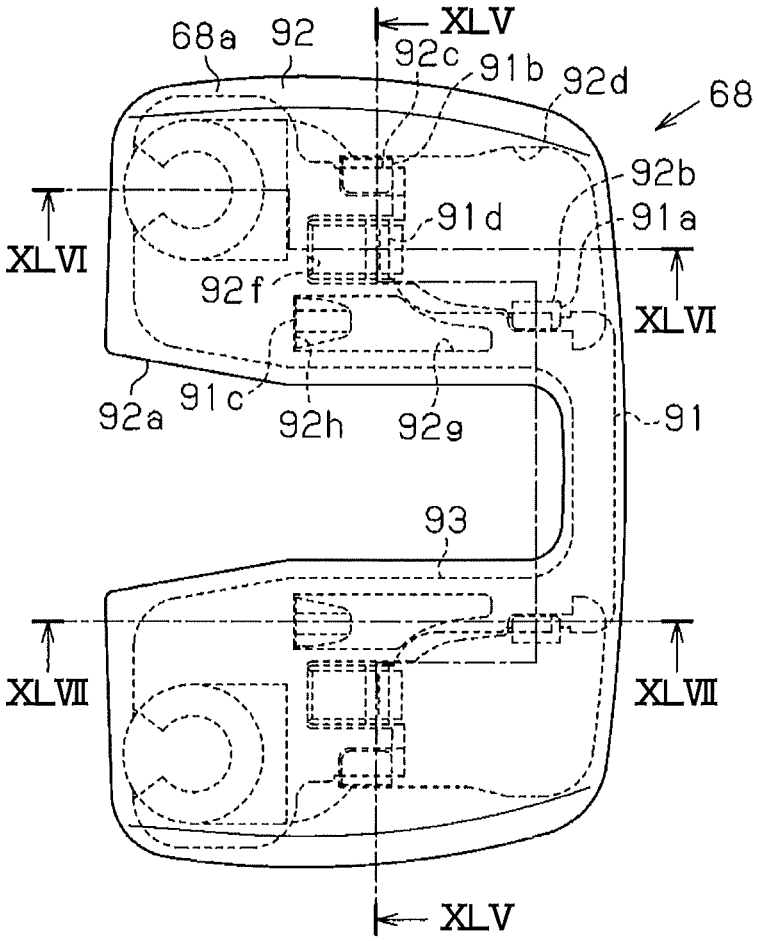
FIG. 44 is a plan view of the fixed wedge of the second embodiment.
Figure 45:
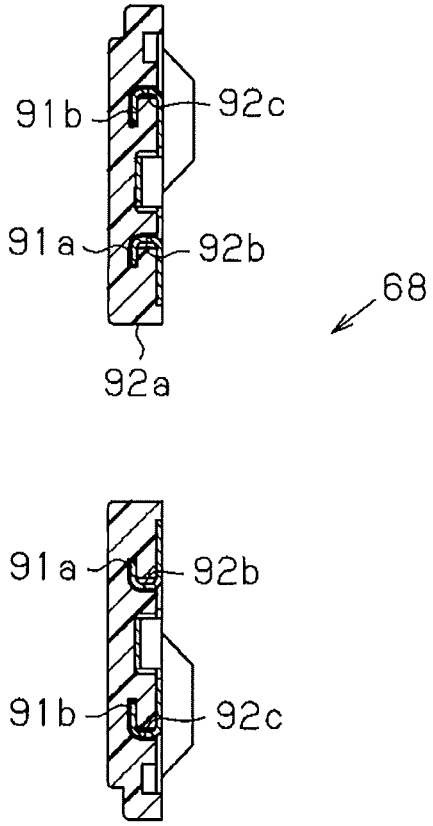
FIG. 45 is a cross sectional view of the fixed wedge taken along line XLV-XLV in FIG. 44.

The wedge member 92 includes a slit 92*a* cut from the front direction of the fixed wedge 68 and is formed in a substantially U-shape. As shown in FIG. 44, the wedge member 92, which provides a design surface, that is, an aesthetically pleasing surface, of the fixed wedge 68, is removably attached to the attachment member 91, at a surface facing the direction in which the guide rails 91*a*, 91*a* and the guide rails 91*b*, 91*b* rise in a manner that the wedge member 92 covers an entire attachment member 91. As shown in FIG. 45, the wedge member 92 includes a pair of guide grooves 92*b*, 92*b* for engaging with the fixed wedge and a pair of guide grooves 92*c*, 92*c* for engaging with the fixed wedge (hereinafter referred to as the guide groove 92*b* and the guide groove 92*c*), each of which includes a substantially L-shaped cross section. The pair of guide grooves 92*b*, 92*b* and the pair of guide grooves 92*c*, 92*c* slidably engage with the pair of guide rails 91*a*, 91*a* and the pair of guide rails 91*b*, 91*b*, respectively. The pair of guide grooves 92*b*, 92*b* and the pair of guide grooves 92*c*, 92*c* of the wedge member 92 slidably engage with the pair of guide rails 91*a*, 91*a* and the pair of guide rails 91*b*, 91*b* of the attachment member 91, and thus the wedge member 92 is movable relative to the attachment member 91 in the front/rear direction of the fixed wedge 68 within a certain range. Accordingly, the wedge member 92 is guided to be attached to and removed from the attachment member 91.

Figure 46:
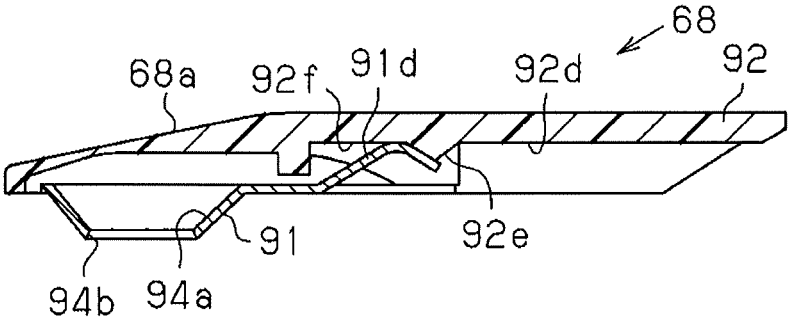
FIG. 46 is a cross sectional view of the fixed wedge taken along line XLVI-XLVI in FIG. 44.

As shown in FIG. 46, in a state where the wedge member 92 is positioned at an attachment position relative to the attachment member 91, recessed portions 92*d*, 92*d* are formed at the wedge member 92. Each recessed portion 92*d* connects to a rear portion of each attachment member 91, the rear portion includes each engagement protruding portion 91*d*. Each recessed portion 92*d* includes a protruding portion 92*e* protrudingly formed to have a substantially triangular cross section and to be in pressure contact with a rear portion of the corresponding engagement protruding portion 91*d*. The wedge member 92 includes engagement recessed portions 92*f*, 92*f* each configured by a front end surface of the recessed portion 92*d*, a front end surface of the protruding portion 92*e* and an inner wall surface positioned between the front end surface of the recessed portion 92*d* and the front end surface of the protruding portion 92*e*.

When the wedge member 92 moves in the rear direction of the fixed edge 68 relative to the attachment member 91 and thus when the engagement protruding portion 91*d* is inserted into the recessed portion 92*d* from a rear end of the recessed portion 92*d*, the engagement protruding portion 91*d* becomes elastically deformed by the protruding portion 92*e* while fitting into the engagement recessed portion 92*f*. Thus, a movement of the wedge member 92 in the front/rear direction (that is, the sliding movement of the wedge member 92 in a sliding direction of the guide rails 91*a*, 91*a* for the fixed wedge, the guide rails 91*b*, 91*b* for the fixed wedge, guide grooves 92*b*, 92*b* for the fixed wedge and the guide grooves 92*c*, 92*c* is restricted. In particular, the wedge member 92 is restricted from moving relative to the attachment member 91 in a direction in which the wedge member 92 is removed from the attachment member 91. In a state where the attachment member 91 and the wedge member 92 are attached to each other, when an external force exceeding a certain level is applied to the wedge member 92 in the direction in which the wedge member 92 is removed from the attachment member 91, the engagement protruding portion 91*d*, which is elastically deformed by the protruding portion 92*e*, passes over the protruding portion 92*e* so as to come out of the 92*f*. Thus, the wedge member 92, which is attached to the attachment member 91, may be removed from the attachment member 91.

Figure 47:
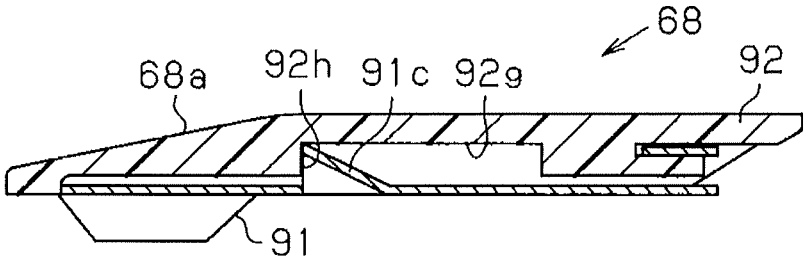
FIG. 47 is a cross sectional view of the fixed wedge taken along line XLVII-XLVII in FIG. 44.

As shown in FIG. 47, in the state where the wedge member 92 is positioned at the attachment position relative to the attachment member 91, recessed portions 92*g*, 92*g* for accommodating the first locking portions 91*c*, 91*c* respectively are formed at the wedge member 92. A front end surface of each recessed portion 92*g* comes close to or comes in contact with a front end surface of the first locking portion 91*c* in the rear direction, that is, in a direction in which the wedge member 92 is attached to the attachment member 91 (i.e., an attachment direction), thereby providing a second locking portion 92*h*. Thus, in order to attach the wedge member 92 to the attachment member 91, when the wedge member 92 is moved relative to the attachment member 91 in the rear direction and comes to be positioned at the attachment position relative to the attachment member 91, the wedge member 92 is restricted from further moving in the rear direction, that is, in the attachment direction, because the second locking portion 92*h* engages with the first locking portion 91*c*. Accordingly, it is restricted that the wedge member 92 excessively moves relative to the attachment member 91 beyond the intended attachment position in the direction in which the wedge member 92 is attached to the attachment member 91.

As illustrated in FIGS. 46 and 47, the fixed wedge 68 includes an inclined surface 68*a* which is formed at a front portion of the wedge member 92 that is fixed to the attachment member 91. The inclined surface 68*a* is formed so as to be closer to the attachment member 91 in a thickness direction thereof, that is, so as to be inclined downward toward the front direction of the fixed wedge 68.

In order to assemble the fixed wedge 68, the wedge member 92 is moved from a front direction to a rear direction of the attachment member 91 as shown in FIG. 43, while the guide rails 91*a*, 91*a* and the guide rails 91*b*, 91*b* of the attachment member 91 are slid along the guide grooves 92*b*, 92*b* and the guide grooves 92*c*, 92*c* of the wedge member 92, respectively as shown in FIG. 44. Further, the engagement protruding portions 91*d*, 91*d* of the attachment member 91 are slid into the recessed portions 92*d*, 92*d* of the wedge member 92 respectively, and thus the engagement protruding portions 91*d*, 91*d* are fitted into the engagement recessed portions 92*f*, 92*f*. Further, the first locking portions 91*c*, 91*c* of the attachment member 91 are slid in the recessed portions 92*g*, 92*g* of the wedge member 92 respectively, and the first locking portions 91*c*, 91*c* come closer to or come in contact with the second locking portions 92*h*, 92*h* in the attachment direction, respectively. Thus, the assembly of the fixed wedge 86 is completed.

Figure 48:
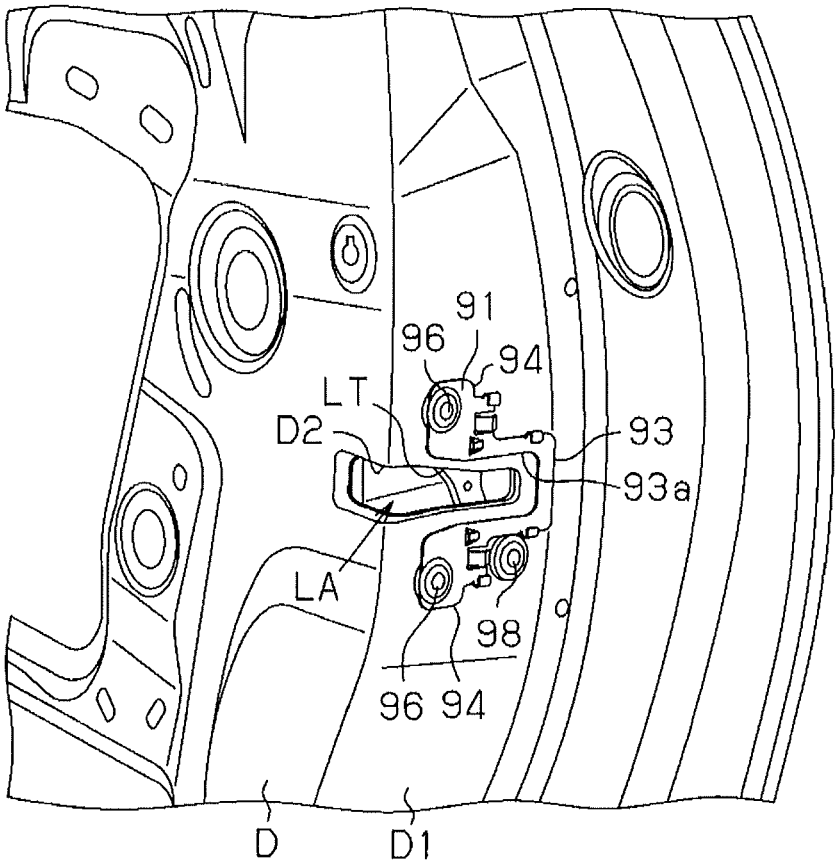
FIG. 48 is a perspective view illustrating a manner in which an attachment member of the fixed wedge of the second embodiment is attached to a door panel.
Figure 50:
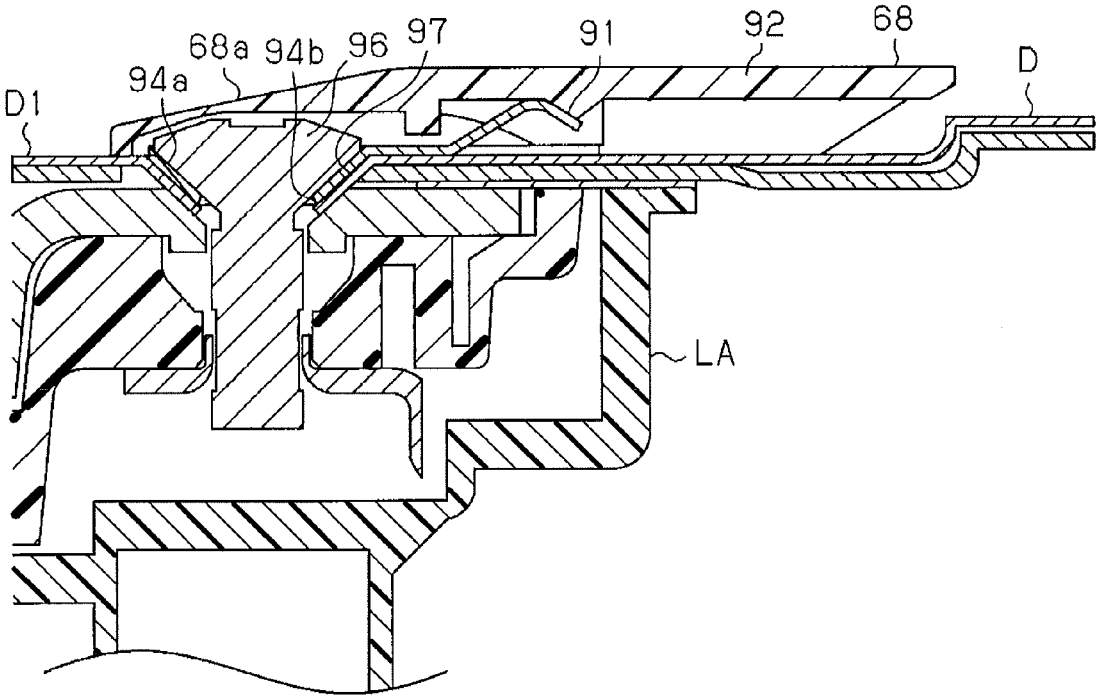
FIG. 50 is a cross sectional view illustrating a manner in which the fixed wedge of the second embodiment is assembled on the door panel.

In order to assemble the fixed wedge 68 on the door panel D (the end surface D1 which extends in the vehicle width direction and is positioned in a vicinity of the opening of the vehicle body), first, the attachment member 91, without the wedge member 92 attached thereto, is fixedly attached to the end surface D1 as shown in FIG. 48. At this time, the attachment member 91 is attached to the door panel D together with the door lock assembly LA, which is temporarily attached to the door panel D, at the opposite side relative to the attachment member 91. In other words, the door lock assembly LA is tightened in advance to the door panel D, at the opposite side relative to the attachment member 91, by means of a bolt 98 arranged so as not to interfere with the attachment member 91 (the fixed wedge 68). The attachment member 91 is fixedly attached to the end surface D1 together with the door lock assembly LA by means of bolts 96, 96 each serving as a mounting member. After the attachment member 91 is attached to the end surface D1, the slit 93*a* of the attachment member 91 is arranged to surround the portion, which extends in the vehicle width direction, of the recess D2, while leaving a distance between the slit 93*a* and a recess D2 for receiving the striker, which is provided at the door panel D. The recess D2 for receiving the striker is provided so that the shaft 63 of the door lock striker 61 is inserted in and removed from the recess D2. As shown in FIG. 50, each recessed portion 94*a* of the attachment member 91, which protrudes in a direction of the end surface D1, fits in a recessed portion 97 formed at the door panel D.

Figure 49:
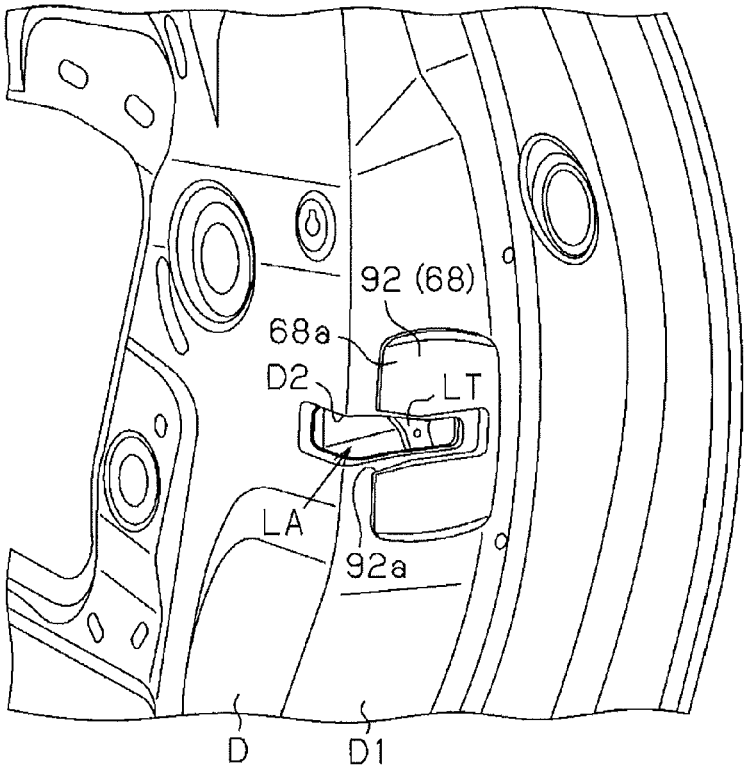
FIG. 49 is a perspective view illustrating a manner in which the fixed wedge device of the second embodiment is provided at the door panel.

Next, the wedge member 92 is fixedly attached to the attachment member 91 that is secured to the end surface D1 as shown in FIG. 49 in the manner described above. At this time, the wedge member 92 covers the entire attachment member 91, and thus the attachment member 91 is not exposed to the outside. The bolts 96, 96 for fixing the attachment member 91 to the door panel D are not exposed to the outside.

According to the fixed wedge 68 having the above-described configuration, as shown in FIGS. 28 and 49, in a state where the fixed wedge 68 is attached to the door panel D, a direction in which the slit 92*a* extends (the front/rear direction of the fixed wedge 68) coincides with the direction in which the door panel D comes closer to and away from the vehicle body panel B (that is, the vehicle width direction in a state where the vehicle door is closed) for opening and closing the vehicle door. Therefore, the slit 92*a* of the fixed wedge 68 (the wedge member 92) is formed in a shape that matches a shape of the portion of the recess D2, the portion extends in the vehicle width direction (the vehicle width direction in the state where the vehicle door is closed). In other words, because the slit 92*a* is formed at the wedge member 92 of the fixed wedge 68, the fixed wedge 68 surrounds the recess D2, while the fixed wedge 68 is configured to be open toward the movable wedge device 60 in the direction in which the door panel D comes closer to and away from the vehicle body panel B. In addition, the inclined surface 68*a* is inclined relative to the body panel B so as to gradually come closer to the end surface D1 toward the direction in which the door panel D comes closer to the body panel B when the vehicle door is operated for closing the opening of the vehicle body.

According to the vehicle door fixing apparatus of the second embodiment, the inclined surface 65*a* of the movable wedge 65 and the inclined surface 68*a* of the fixed edge 68 (the wedge member 92) are in pressure contact with each other in a state where the vehicle door is closed as shown in FIG. 28

Next, an operation of the vehicle door fixing apparatus of the second embodiment will be described. According to the vehicle door fixing apparatus of the second embodiment, in a state where the vehicle door is closed, the inclined surface 65*a* of the movable wedge 65 that is fixedly attached to the vehicle body panel B is, in a reciprocatingly slidable manner, in contact with the inclined surface 68*a* of the fixed wedge 68 that is fixedly attached to the door panel D as shown in FIG. 28. At this time, the movable wedge 65 is pushed against the fixed wedge 68 by the biasing force of the spring 76, and thus the vehicle door is pushed toward a hinge of the vehicle door, and thus a backlash or a rattling of the door is restricted.

Figure 51:
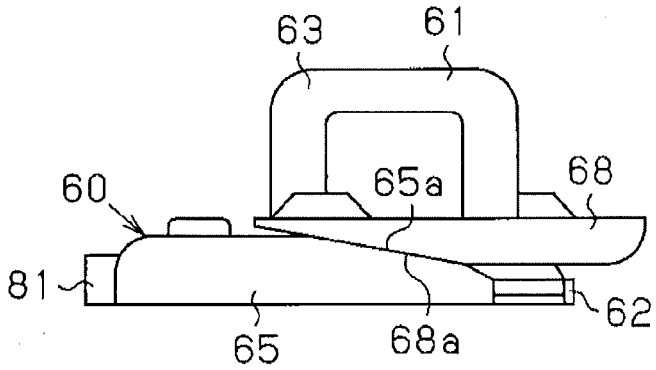
FIG. 51 is a lateral view illustrating a state of the movable wedge device and the fixed wedge of the vehicle door fixing apparatus of the second embodiment when the vehicle body is not deformed.
Figure 52:
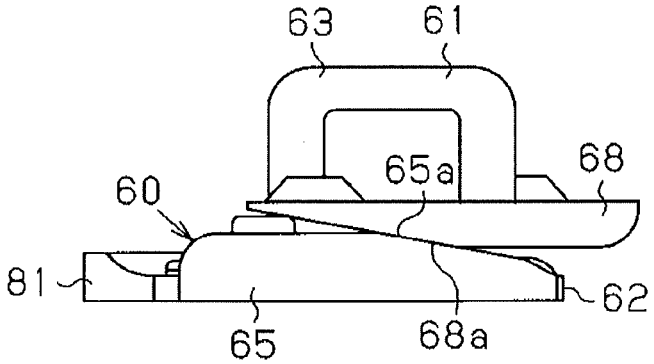
FIG. 52 is a lateral view illustrating a state of the movable wedge device and the fixed wedge of the vehicle door fixing apparatus of the second embodiment when the vehicle body is deformed.

When a bending deformation occurs to the vehicle body in the right/left direction thereof while, for example, when the vehicle makes a turn, the movable wedge 68 arranged at a side of the vehicle at which the vehicle body expands moves relative to the fixed wedge 8 in the right direction when viewed in FIG. 51. At this time, the movable wedge 65 in a state illustrated in FIG. 51 moves to be in a state illustrated in FIG. 52. Thus, the fixed wedge 68 moves upwardly when viewed in FIG. 51 (that is, in the front/rear direction of the vehicle when the fixed wedge 68 is assembled on the vehicle). Accordingly, a gap generated between an opening portion of the vehicle body and the vehicle door in the front/rear direction of the vehicle due to the bending deformation is reduced. At a side of the vehicle at which the vehicle body shrinks while, for example, the vehicle makes the turn, the deformation of the vehicle body may be restricted by the movable wedge 65. Thus, according to the vehicle door fixing apparatus having the above-explained structure, a backlash of the vehicle door may be restricted and a rigidity of the vehicle body is effectively increased.

As explained above, according to the second embodiment, the following effects and advantages may be obtained in addition to the effects and advantages (1) to (3), (5), (18) and (20), which are attained according to the first embodiment. (21) According to the vehicle door fixing apparatus of the second embodiment, the spring 76 includes plural coil portions 76*a*, for example, the pair of coil portions 76*a*, 76*a* which are arranged in parallel to each other. Thus, an outer diameter of each coil portion 76*a* (a coil diameter) may be reduced compared to a case where a biasing force having a necessary level is ensured by one coil portion. Accordingly, a size of the base plate 62 that includes the supporting portion 71*a* supporting the coil portions 76*a*, 76*a* (and a size of the cover 81) may be reduced in the moving direction of the movable wedge device 65. Accordingly, the base plate 62 (the movable wedge device 60) of the second embodiment may be mounted, without interfering with the flange B2, even on a vehicle at which the end surface B1 of the vehicle body panel B is reduced in the vehicle width direction (for example, a compact car), and thus a mountability of the base plate 62 is improved. As a result, the movable wedge device 60 (the vehicle door fixing apparatus) of the second embodiment may be applied to various types of vehicles, thereby facilitating communization of the movable wedge device 60.

(22) According to the vehicle door fixing apparatus of the second embodiment, the wedge member 92 is removably attached to the attachment member 91. Thus, in a case that plural types of the wedge members 92, each of which has a different frictional engagement force relative to the movable wedge device 60 (the movable wedge 65), exist due to a change in a material or other reasons, one type of the wedge member 92 may be chosen from among the plural types of the wedge member 92 and be attached to the attachment member 91. Accordingly, a level of the frictional engagement between the wedge member 92 and the movable wedge device 60, that is, a level of fixation of the vehicle door, may be adjusted on the basis of user's preference. Alternatively, the frictional engagement of the wedge member 92 and the movable wedge device 60 may be released on the basis of user's preference by removing the wedge member 92 from the attachment member 91. In other words, by attaching or removing the wedge member 92 relative to the attachment member 91, a fixing effect of the vehicle door is selectively obtained.

In a case that plural types of the wedge members 92, each of which has a different aesthetic feature (for example, a color), exist, one type of the wedge member 92 may be chosen from among the plural types of the wedge member 92 and be attached to the attachment member 91. Thus, an aesthetic quality may be improved to meet user's preference.

In particular, the wedge member 92 may be attached to and removed from the attachment member 91 in a state where the attachment member 91 is attached to the end surface D1 of the door panel D. Thus, a replacement of the wedge member 92 may be performed smoothly. (23) According to the vehicle door fixing apparatus of the second embodiment, the wedge member 92 is guided to be attached to and removed from the attachment member 91 by means of an extremely simple structure where the guide grooves 92*b*, 92*b* and the guide grooves 92*c*, 92*c* slidably engage with the guide rails 91*a*, 91*a* and the guide rails 91*b*, 91*b*, respectively. Thus, attachment and removal operations of the wedge member 92 may be performed smoothly.

(24) According to the vehicle door fixing apparatus of the second embodiment, in a state where the attachment member 91 and the wedge member 92 are in the attachment position, each second locking portion 92*h* of the wedge member 92 comes closer to or comes in contact with the corresponding first locking portion 91*c* of the attachment member 91 in the direction in which the wedge member 92 is attached to the attachment member 91 (the rear direction of the fixed wedge 68). The direction in which the wedge member 92 is attached to the attachment member 91 matches the sliding direction of the guide grooves 92*b*, 92*b* and the guide grooves 92*c*, 92*c* relative to the guide rails 91*a*, 91*a* and the guide rails 91*b*, 91*b*. Thus, during an attachment operation of the wedge member 92 to the attachment member 91, when the attachment member 91 and the wedge member 92 reach the attachment position, each second locking portion 92*h* engages with the corresponding first locking portion 91*c* in the attachment direction so that the wedge member 92 is restricted from further moving in the attachment direction. Thus, the wedge member 92 is restricted from excessively moving in the attachment direction relative to the attachment member 91 beyond the intended attachment position.

While the wedge member 92 is frictionally engaged with the movable wedge device 60 (the movable wedge 65), the wedge member 92 is restricted from moving relative to the attachment member 91 in the attachment direction, which coincides with a pressing direction of the movable wedge device 60. (25) According to the vehicle door fixing apparatus of the second embodiment, when the attachment member 91 and the wedge member 92 are in the attachment position, the engagement protruding portions 91*d*, 91*d* of the attachment member 91 are fitted into the engagement recessed portions 92*f*, 92*f* of the wedge member 92. Thus, a movement of the wedge member 92 in the direction in which the wedge member 92 is removed from the attachment member 91 is blocked. Accordingly, in the attachment position, the wedge member 92 is restricted from coming off the attachment member 91.

On the other hand, in a state where the attachment member 91 and the wedge member 92 are attached to each other, when the external force exceeding the certain level is applied to the wedge member 92 in the direction in which the wedge member 92 is removed from the attachment member 91, the engagement protruding portion 91*d*, which is elastically deformed by the protruding portion 92*e*, passes over the protruding portion 92*e* so as to come out of the engagement recessed portion 92*f*. Thus, the wedge member 92, which is attached to the attachment member 91, may be removed from the attachment member 91.

(26) According to the vehicle door fixing apparatus of the second embodiment, the attachment member 91 is attached to the door panel D by means of the bolts 96, 96, which also tighten the door lock assembly LA to the door panel D. Thus, there is no need to provide an attachment portion at the door panel D for exclusively attaching the attachment member 91 to the door panel D. Accordingly, even in case that the attachment member 91 (the fixed wedge 68) is attached to the door panel D after the door lock assembly LA is tightened to the door panel D, man-hours for providing the exclusive attachment portion for the attachment member 91 may be reduced.

(27) According to the vehicle door fixing apparatus of the second embodiment, the movable wedge 65 may be attached to the body panel B together with the base plate 62 of the door lock striker 61, and the fixed wedge 68 may be attached to the door panel D together with the door lock assembly LA. Thus, man-hours for assembly of the vehicle door fixing apparatus, including, for example, the door lock striker 61, as a whole may be reduced.

The strength member 66 of the movable wedge 65 includes the guide groove 66*a* that opens toward the fixed wedge 68 in the direction in which the door panel D comes closer to and away from the vehicle body panel B when the vehicle door is operated for closing the opening of the vehicle body. Accordingly, the strength member 66 surrounds the shaft 63 of the door lock striker 61 in a manner that the guide groove 66*a* is opened toward the fixed wedge 68 in the direction in which the door panel D comes closer to and away from the vehicle body panel B. Thus, while the fixed wedge 68 receives a load from the contact members 67, 67 because of the pressure contact between the fixed wedge 68 and the contact members 67, 67, the strength member 66 will elastically deform in a manner that an opening width of the guide groove 66*a* is inserted (a so-called state where an opening portion is enlarged by a load applied thereto).

(28) According to the vehicle door fixing apparatus of the second embodiment, the chamfered portion 67*b* and the locking tab 67*c* of each contact member 67 sandwich therebetween the chamfered portion 66*e* and the locking portion 66*f* of the strength member 66 (that is, a facing portion of the strength member 66, which faces the chamfered portion 67*b* and the locking tab 67*c* in the direction in which the door panel D comes closer to and away from the vehicle body panel B), thereby restricting each contact member 67 from coming off the strength member 66. In addition, each contact member 67 will relocate in a direction away from the fixed wedge 68 when coming into pressure contact with the fixed wedge 68. This relocation of the contact member 67 may increase an overlap width between the facing portion of the strength member 66 (the chamfered portion 66*e* and the locking portion 66*f*), and the chamfered portion 67*b* and the locking tab 67*c* which sandwich the facing portion of the strength member 66. Thus, each contact member 67 is restricted from coming off the strength member 66 by means of the pressure contact between the contact member 67 and the fixed wedge 68.

(29) According to the vehicle door fixing apparatus of the second embodiment, the attachment protruding portion 67*a* is inserted in each attachment hole 66*d* and is restricted from coming off the attachment hole 66*d* in the thickness direction of the strength member 66, thereby restricting each contact member 67 from coming off the strength member 66.

(30) According to the vehicle door fixing apparatus of the second embodiment, the recessed portion 94*a*, which serves as the bearing surface for the bolt 96 for fixing the attachment member 91 to the door panel D, is formed at the attachment member 91 of the fixed wedge 68. According to this structure, the bearing surface for the bolt 96 is strengthened by using metal and thus a backlash at the fixed wedge 68, which would be otherwise caused by a creep deformation of the bearing surface made of, for example resin, is adequately restricted.

(31) According to the vehicle door fixing apparatus of the second embodiment, the recessed portion 94*a* of the fixed wedge 68, which constitute the bearing surface for the bolt 96 for fixing the attachment member 91 to the door panel D, is formed to protrude toward the end surface D1 of the door panel D and fits in the recessed portion 97 formed at the door panel D. This may facilitate a position setting of the fixed wedge 68 on the door panel D when attaching the fixed wedge 68 to the door panel D.

Variations and changes may be made to the embodiments as follows. Modifications of the leaf spring 13 will be explained as follows. As explained above, according to the first embodiment, the looseness between the guide rail 11 and the guide groove 10 is reduced by providing the leaf spring 13 in the compressed state between the wall of the guide groove 10 and the surface of the guide rail 11, thereby restricting the backlash from occurring to the movable wedge 6. In the first embodiment, the leaf spring 13 that is made of metal and is insert-molded to be integral with the movable wedge 6 is used as the elastic member.

However, another member than the leaf spring 13 made of metal may restrict the backlash of the movable wedge 6 as long as the another member is provided between the wall of the guide groove 10 and the surface of the guide rail 11 in the compressed state.

Figure 53:
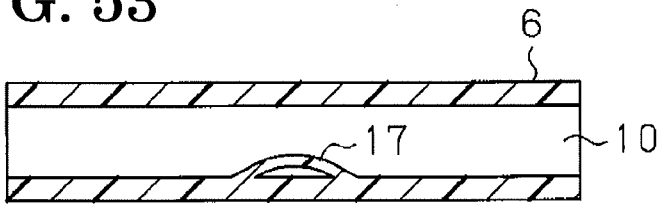
FIG. 53 is a cross sectional view of a guide groove according to a first modification of the first embodiment.

For example, as shown in FIG. 53, according to a first modification of the first embodiment, a leaf spring 17 (i.e., the elastic member) made of resin may restrict the backlash of the movable wedge 6. The leaf spring 17 is formed during a molding process of the movable wedge 6 at a lower wall of the guide groove 10, when viewed in FIG. 53, so as to be integral with the movable wedge 6. The guide rail 11 is pushed by the leaf spring 17, similarly to the way the guide rail 11 is pushed by the leaf spring 13 made of metal, toward a direction of an upper wall, when viewed in FIG. 53, of the guide groove 10. Thus, the looseness between the guide rail 11 and the guide groove 10 is reduced, and thus the backlash of the movable wedge 6 may be restricted, thereby appropriately restricting the occurrence of the abnormal noise caused by the backlash. Here, the leaf spring 17 made of resin is formed to be integral with the movable wedge 6 made of resin, however, the leaf spring 17 may be formed separately from the movable wedge 6.

Figure 54:
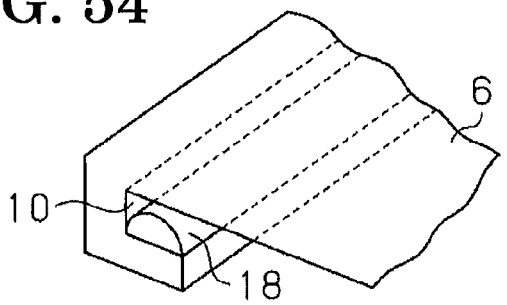
FIG. 54 is a perspective view illustrating a structure of a rail mechanism according to a second modification of the first embodiment.

As shown in FIG. 54, according to a second modification of the first embodiment, a protrusion 18 (i.e., the elastic member) may also restrict the backlash of the movable wedge 6 in a manner similar as described above. The protrusion 18, which is formed to have a substantially semicircular cross-section and to extend in a direction in which the guide groove 10 extends, is fixed to the lower wall, when viewed in FIG. 54, of the guide groove 10. The protrusion 18 is formed so that a height thereof is greater than a gap formed between the surface of the guide rail 11 and the wall of the guide groove 10, and so that the protrusion 18 is provided between the surface of the guide rail 11 and the wall of the guide groove 10 in the compressed state. The protrusion 18 is made of an elastic material, for example, silicone rubber but is not limited thereto.

Figure 55:
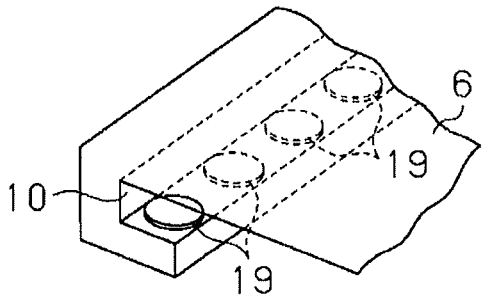
FIG. 55 is a perspective view illustrating a structure of a rail mechanism according to a third modification of the first embodiment.

The above-explained shape of the protrusion 18 is not limited thereto and may be appropriately changed. For example, as shown in FIG. 55, according to a third modification of the embodiment, a protrusion 19 (i.e., the elastic member) formed in a substantially cylindrical shape is provided at the groove 10 in a manner that plural protrusions 19 are arranged on the groove 10 with a constant interval thereamong along the direction in which the guide groove 10 extends. Here, the protrusion 18, 19 is provided at the wall of the guide groove 10, however, the protrusion 18, 19 made of the elastic material may be provided at the surface of the guide rail 11 by means of outsert-molding or another method.

Modifications of the resin piece 14 will be explained as follows. As explained above, according to the first embodiment, the resin piece 14, which restricts the sliding movement of the movable wedge 6 so that the movable wedge 6 is locked at the position where the bolt holes 5*a* of the base plate 5 are exposed, is removably attached to the movable wedge device 2, thereby facilitating an assembling work for bolting the base plate 5 on the vehicle body panel B. However, another member may be used instead of the resin piece 14 as long as another member is configured to restrict the sliding movement of the movable wedge 6 so that the movable wedge 6 is locked at the position where the movable wedge 6 causes the bolt holes 5*a* of the base plate 5 to be exposed.

Figure 56A:
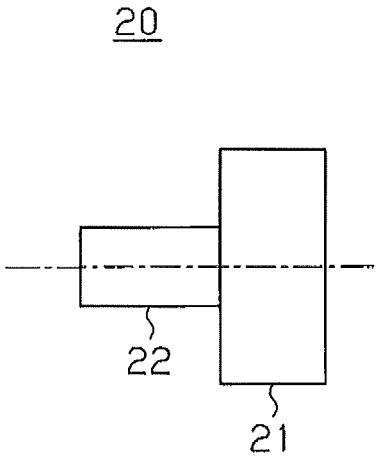
FIG. 56A is a lateral view of a pin according to a fourth modification of the first embodiment.
Figure 56B:
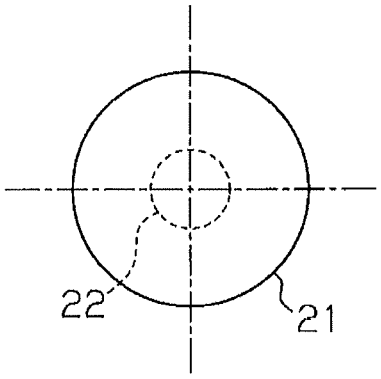
FIG. 56B is a plan view of the pin according to the fourth modification of the first embodiment.

For example, as shown in FIGS. 56A and 56B, a pin 20 according to a fourth modification of the embodiments may restrict the sliding movement of the movable wedge 6. The pin 20 includes a large diameter portion 21 having a cylindrical shape and a small diameter portion 22 having a cylindrical shape.

Figure 57:
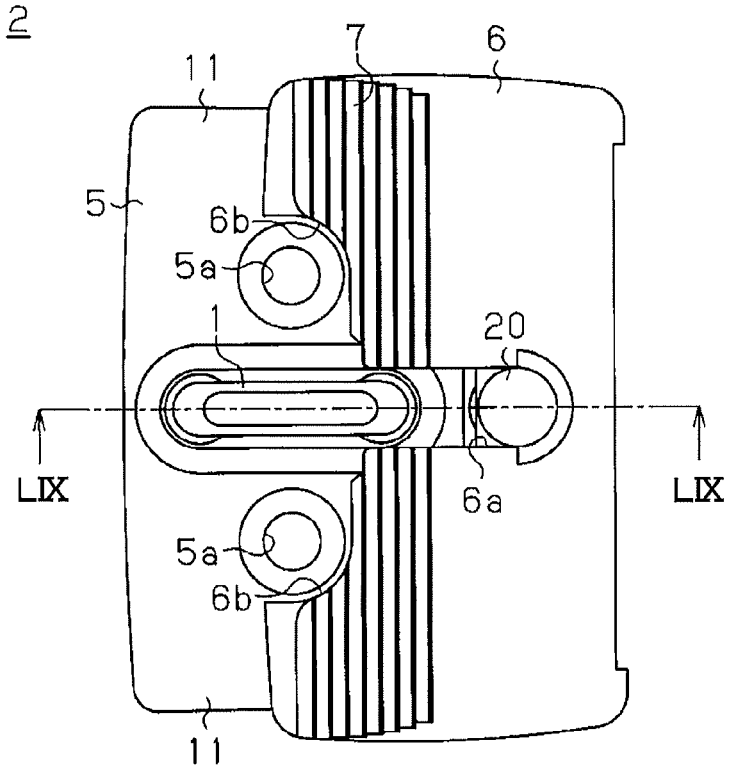
FIG. 57 is a plan view of the movable wedge device of the fourth modification of the first embodiment in a state where the movable wedge device is not assembled on the vehicle body panel.
Figure 58:
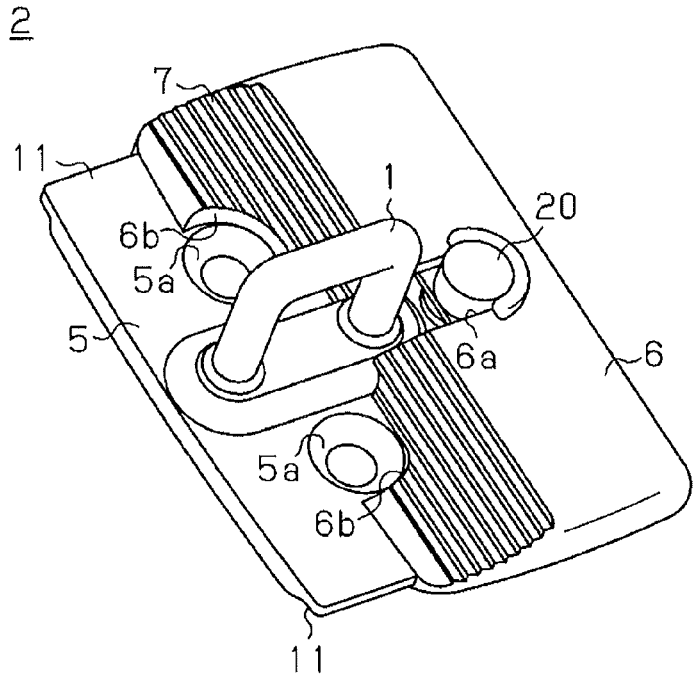
FIG. 58 is a perspective view of the movable wedge device of the fourth modification of the first embodiment in a state where the movable wedge device is not assembled on the vehicle body panel.
Figure 59:
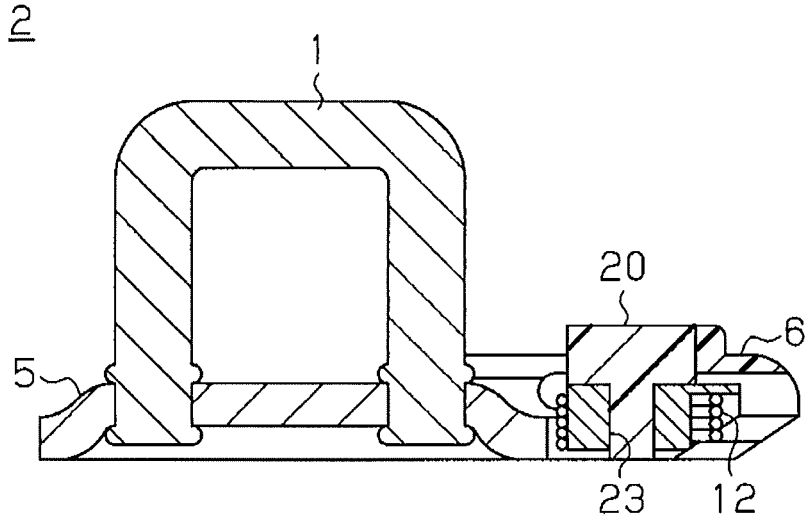
FIG. 59 is a cross sectional view of the movable wedge device taken along line LIX-LIX in FIG. 57.

As shown in FIGS. 57 and 58, in a state where the pin 20 is attached to the movable wedge device 2, the large diameter portion 21 is in contact with the innermost portion of the slit 6*a* formed at the movable wedge 6, thereby restricting the sliding movement of the movable wedge 6 so that the movable wedge 6 is locked at the position where the movable wedge 6 is fully slid in the rear direction, that is, where the bolt holes 5*a* of the base plate 5 are exposed. As shown in FIG. 59, the pin 20 is attached to the base plate 5 by fitting the small diameter portion 22 into a hole 23 formed on the protruding portion 5*b* provided at the rear portion of the base plate 5.

In the foregoing explanation, the pin 20 made of resin or the resin piece 14 is used as the locking member restricting the sliding movement of the movable wedge 6 and locking the movable wedge 6 at the position where the movable wedge 6 causes the bolt holes 5*a* to be exposed. However, the pin 20 and the resin piece 14 may be made of metal or other material.

Figure 60:
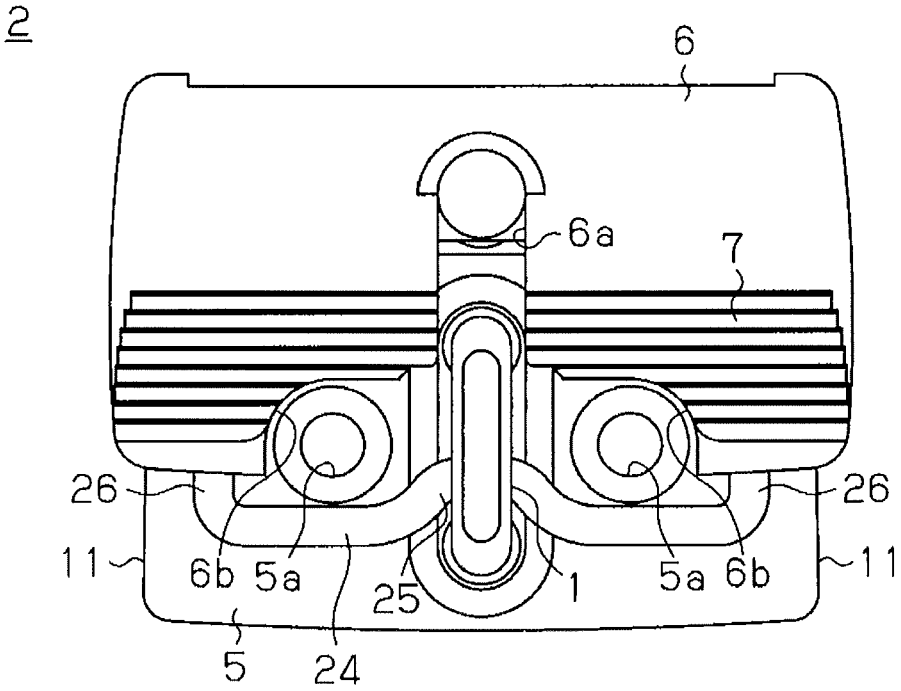
FIG. 60 is a plan view of the movable wedge device of a fifth modification of the first embodiment in a state where the movable wedge device is not assembled on the vehicle body panel.

For example, as shown in FIG. 60, a locking member 24 according to a fifth modification of the embodiment may restrict the sliding movement of the movable wedge 6 and lock the movable wedge 6 at the position where the bolt holes 5*a* are exposed. The locking member 24 is attached to the movable wedge device 2 so that a middle portion 25 of the locking member 24 is in contact with the door lock striker 1 and so that end portions 26, 26 of the locking member 24 in a lengthwise direction thereof are in contact with a front end face of the movable wedge 6. In a state where the locking member 24 having the above-explained configuration is attached to the movable wedge device 2, the locking member 24 is positioned to be sandwiched between the door lock striker 1 and the front end face of the movable wedge 6, and thus the sliding movement of the movable wedge 6 is restricted and the movable wedge 6 is locked at the position where the bolt holes 5*a* of the base plate 5 are exposed.

As explained above, another member may be used as long as another member is configured to restrict the sliding movement of the movable wedge 6 and to lock the movable wedge 6 at the position where the movable wedge 6 causes the bolt holes 5*a* to be exposed. Other modifications will be explained as follows. According to the first embodiment, the fixed wedge 8 is formed so that the position of the lower surface of the fixed wedge 8 is closer to the upper surface of the fixed wedge 8 in the rear portion of the fixed wedge 8 than in the front portion thereof. However, in case that the door panel D is formed to be flat at the portion to which the fixed wedge 8 is attached, the fixed wedge 8 may be formed so that the lower surface thereof is positioned at a uniform height.

According to the first embodiment, the metal member 36 constituting the bearing surface for the bolt 28 is provided to protrude below the lower surface of the fixed wedge 8. However, in case, for example, the second recessed portion 39 is not formed on the door panel D at the position at which the bolt is attached, the metal member 36 needs to be provided so as not to protrude below the lower surface of the fixed wedge 8.

According to the first embodiment, the metal member 36 constituting the bearing surface for the bolt 28 is insert-molded to the fixed wedge 8. However, the fixed wedge 8 may be configured without including the metal member 36 as long as a sufficient strength and creep resistance is ensured.

According to the first embodiment, the cover 31 is formed to cover the lower portion of the coil portion 12*a* of the spring 12. However, the cover 31 may be formed so as not to cover the lower portion of the coil portion 12*a* as long as the posture of the spring 12 is maintained adequately.

According to the first embodiment, the cover 31 is formed to support the upper portion 12*c* and the lower portion of the spring 12. However, the cover 31 may be formed to support only the upper portion 12*c* or only the lower portion of the spring 12.

According to the first embodiment, the cover 31 is formed to cover the upper, lower, left and right portions of the spring 12 but to uncover the rear portion of the spring 12. However, the cover 31 may be formed in a shape of a bag covering the rear portion of the spring 12 in addition to the upper, lower, left and right portions thereof.

According to the first embodiment, the step portion 30 is provided at the base plate 5 so that the upper surface of the step portion 30 coincides with the upper portion of the spring 12, thereby supporting a rear end of the spring 12. However, in case that the cover 31 is formed in the shape of the bag, the cover 31 may include a structure where the height of the upper surface of the step portion 30 does not coincide with the height of the upper the upper portion of the spring 12.

According to the first embodiment, the protruding portion 16 is provided on the lower surface of the resin piece 14 so as to protrude downwardly and the groove 17*a*, into which the protruding portion 16 is fitted, is formed on the base plate 5. However, the resin piece 14 and the base plate 5 may be configured without including the protruding portion 16 or the groove 17*a*, respectively as long as the resin piece 14 is attached to the movable wedge device 2 in the reliable and stable manner.

The configurations of the leaf springs 13, 17 are not limited thereto and appropriate variations and changes may be made. The leaf springs 13, 17 may have other configurations as long as the leaf spring 13, 17 is configured to push the guide rail 11 toward the wall of the guide groove 10.

The leaf spring 13, 30 is provided on the wall of the guide groove 10, however, the leaf spring 13, 30 may be provided on the surface of the guide rail 11. According to the first embodiment, the leaf spring 13 made of metal is insert-molded to the movable wedge 6 made of resin, however, a manner in which the leaf spring 13 is provided is not limited thereto. The leaf spring 13 may be provided in another appropriate manner.

According to the first embodiment, each of the inclined surface 7 of the movable wedge 6 and the inclined surface 9 of the fixed wedge 8 is formed stepwise, however, each of the inclined surfaces 7, 8 may be formed in a flat surface or a curved surface not including steps.

Figure 61:
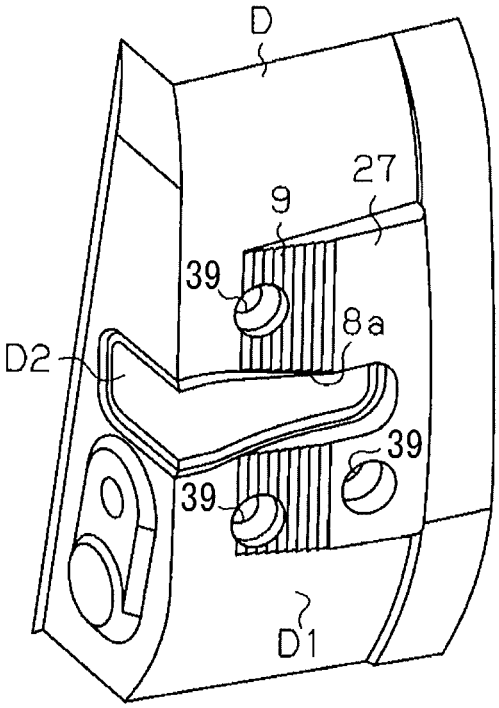
FIG. 61 is a perspective view illustrating a manner in which the fixed wedge of a sixth modification of the first embodiment is provided at the door panel.

According to the first embodiment, the fixed wedge 8 is fixedly attached to the door panel D by means of the bolts 28. However, according to a sixth modification of the first embodiment, a fixed wedge 27 may be integrally provided at the door panel D as shown in FIG. 61.

According to the first embodiment, the spring 12 may include plural coil portions 12*a*. According to the second embodiment, the spring 76 may include one coil portion 76*a*, or three or more coil portions 76*a*.

According to the second embodiment, the pair of guide rails 91*a*, 91*a* and the pair of guide rails 91*b*, 91*b* are provided at the attachment member 91 of the fixed wedge 68, and the pair of guide grooves 92*b*, 92*b* and the pair of guide grooves 92*c*, 92*c* are provided at the wedge portion 92 of the fixed wedge 68. However, the guide grooves may be provided at the attachment member 91, and the guide rails may be provided at the wedge member 92. In addition, the number of pairs of the guide rails and the number of pairs of the guide groove may be arbitrarily determined.

According to the second embodiment, the engagement protruding portion 91*d* is provided at the attachment member 91 of the fixed wedge 68, and the engagement recessed portion 92*f* is provided at the wedge member 92 of the fixed wedge 68. However, the engagement recessed portion 92*f* may be provided at the wedge member 91 and the engagement protruding portion 91*d* may be provided at the wedge member 92. The number of pairs of the engagement protruding portion 91*d* and the engagement recessed portions 92*f* may be arbitrarily determined.

In the second embodiment, the number of pairs of the first locking portions 91*c*, 91*c* of the attachment member 91 and the number of pairs of the second locking portions 92*h*, 92*h* may be arbitrarily determined. According to the second embodiment, the attachment member 91 is fixedly attached to the door panel D by means of the bolt 96, which also tightens the door lock assembly LA to the door panel D, however, the attachment member 91 may be arbitrarily positioned without being restricted by the door lock assembly LA. In addition, the number of the bolts for fixing the attachment member 91 may be arbitrarily determined. In these cases, the attachment member 91 may be fixed by means of another mounting member than the bolt (for example, a pin or a clip).

According to the second embodiment, the strength member 66 of the movable wedge 65 may be made of resin as long as a sufficient rigidity (strength) is ensured. In addition, each contact member 67 may be made of metal provided that a sufficient buffering is ensured between the contact members 67, 67 and the wedge member 92 of the fixed wedge 68.

According to the second embodiment, the attachment member 91 of the fixed wedge 68 may be made of resin as long as a sufficient rigidity (strength) is ensured. In addition, the wedge member 92, which provides the design surface, may be made of metal provided that a sufficient buffering is ensured between the wedge member 92 and, for example, the movable wedge 65.

According to the second embodiment, the contact member 67 is split into two pieces, that is, the pair of contact members 67, 67, arranged at both sides relative to the guide protruding portion 62*a* of the base plate 62. However, the contact member 67 formed into a single piece, that is, the contact members 67, 67 may be connected with each other behind the guide protruding portion 62*a*.

According to the second embodiment, the end portion of the pin P, which penetrates through the attachment hole 66*d* of the strength member 66, is welded to have the flanged shape, and thus the attachment protruding portion 67*a* is fixedly attached to the strength member 66 without coming off the attachment hole 66*d*. However, for example, a clip may be used instead of the 67*a*.

In the second embodiment, an elastic member may be disposed between a surface of guide rail 64 and a wall of the guide groove 66*b* in the compressed state, in order to reduce a looseness between the guide rail 64 and the guide groove 66*b*, thereby restricting a backlash of the movable wedge 65.

In the second embodiment, a locking member, which restricts the sliding movement of the movable wedge 65 and locks the movable wedge 65 at a position where the movable wedge 65 causes the bolt holes 62*b* to be exposed, is removably attached so that a favorable assembly performance of the movable wedge device 60 is ensured.

In the second embodiment, a surface of the inclined surface 65*a* of the movable wedge 65 may be coated with layers of an elastic material having higher elastic coefficient than the resin material forming the contact member 67, for example, silicone rubber but not limited thereto. Thus, even in case that the inclined surface 65*a* of the movable wedge 65 collides with the inclined surface 68*a* of the fixed wedge 68 when the vehicle door is closed, the elastic material may absorb the energy of an impact between the inclined surface 65*a* and the inclined surface 68*a*, and thus an occurrence of a high-volume abnormal noise may be restricted.

According to the second embodiment, the recessed portion 94*a*, which serves as the bearing surface of the bolt 96, of the fixed wedge 68 is formed to protrude in the direction of the end surface D1. However, in case, for example, where the recessed portion 97 is not formed at the bolt attaching position of the door panel D, the recessed portion 94*a* needs to be formed not to protrude in the direction of the end surface D1.

According to the second embodiment, the fixed wedge 68 is constituted by the attachment member 91 made of metal and the wedge member 92 made of resin. However, the fixed wedge 68 may be made only of resin as long as a sufficient strength and creep resistance is ensured. Alternatively, a metal member for reinforcement may be insert-molded to the fixed wedge 68, at a portion that serves as the bearing surface of the bolt 96.

According to the second embodiment, the cover 81 is structured to support both end portions of each coil portion 76*a* (the end portion facing the protruding direction of the shaft 63 and the end position facing an opposite direction thereto). However, the cover 81 may be structured to support one of the end portions of each coil portion 76*a*.

According to the second embodiment, the cover 81 is structured so that the rear portion of each coil portion 76*a* of the spring 76 is opened. However, the cover 81 may be structured to cover the rear portion of each coil portion 76*a*.

According to the second embodiment, each of the inclined surface 65*a* of the movable wedge 65 and the inclined surface 68*a* of the fixed wedge 68 is formed in a flat surface not including steps, however, each of the inclined surfaces 65*a*, 68*a* may be formed stepwise or in a curved surface.

According to the second embodiment, the fixed wedge 68 is fixedly attached to the door panel D by means of the bolts 96, 96. However, the fixed wedge may be integrally provided at the door panel D. According to the embodiments, the step portion 30, 72 is provided at the base plate 5, 62 and the tab 33, 83 engaging with the step portion 30, 72 is provided at the cover 31, 81. Thus, the cover 31, 81 is fixed to the base plate 5, 62. However, the cover 31, 81 may be fixed to the base plate 5, 62 in another manner.

According to the embodiments, the spring accommodating portion 29, 71 is constituted by the hole formed at the base plate 5, 62. However, in case that, for example, a spring of another type than the coil spring is used, the spring accommodating portion 29, 71 may include, for example, a recessed configuration or a polygonal configuration as long as the accommodating portion accommodating the spring and the supporting portion supporting the spring when the spring biases the movable wedge are provided.

According to the embodiments, the movable wedge 6, 65 is biased by the spring 12, 76. The configuration of the spring 12, 76 is not limited to that shown in, for example, FIGS. 3 and 30 and appropriate variations and changes may be made.

In addition, another elastic member than the spring may be used for biasing the movable wedge 6, 65.

According to the embodiments, the door lock striker 1, 61 is provided integrally with the movable wedge device 2, 60 constituted by the base plate 5, 62, the movable wedge 6, 65, and the spring 12, 72, however, the door lock striker 1, 61 may be provided separately from the movable wedge device 2, 60.

According to the embodiments, the movable wedge 6, 65 is provided on a same side at which the door lock striker 1, 61 is provided, and the fixed wedge 8, 68 is provided at a same side at which the door lock assembly 4, LA is provided. However, the fixed wedge 8, 68 may be provided at the same side at which the door lock striker 1, 61 is provided and the movable wedge 6, 65 may be provided at the side at which the door lock assembly 4, LA is provided. In this case, in the second embodiment, the strength member 66 of the movable wedge 65 is arranged so as to surround the recess D2 for receiving the striker in a manner that the guide groove 66*a* is opened toward the fixed wedge 8, 68 in the direction in which the door panel D comes closer to and away from the vehicle body panel B.

According to the embodiments, the movable wedge 6, 65 is provided at the vehicle body panel B and the fixed wedge 8, 27, 68 is provided at the door panel D, however, the movable wedge 6, 65 may be provided at the door panel D and the fixed wedge 8, 27, 68 may be provided at the vehicle body panel B. In this case, the fixed wedge 8, 27, 65 may be integrally provided at the base plate 5, 62 at which the door lock striker 1, 61 is provided or may be integrally provided at the vehicle body panel B.

According to the embodiments, the embodiments are employed in the side door of the vehicle having the structure of the open air car or in the vehicle having the structure of the convertible vehicle (that is, the vehicle provided with a roof that opens and closes, or with a removable roof). However, the embodiments may be employed in other doors for opening and closing the opening portion provided at the vehicle body, including but not limited to, a side door of a vehicle having a fixed roof, a sliding-type side door for sliding in a front/rear direction of the vehicle, a back door (a rear gate) for tilting in a vertical direction or a right/left direction of the vehicle to open and close the opening portion provided at a rear portion of the vehicle body.

According to the embodiments, the vehicle door fixing apparatus includes the fixed wedge 8, 27, 68 configured to be fixedly attached to one of the vehicle body panel B and the door panel D, the base plate 5, 62 configured to be fixedly attached to the other one of the vehicle body panel B and the door panel D, the movable wedge 6, 65 slidably provided at the base plate 5, 62, the spring 12, 76 biasing the movable wedge 6, 65 toward the fixed wedge 8, 27, 68, and the cover 31, 81 fixedly attached to the base plate 5, 62 and covering around the spring 12, 76.

According to the above-described structure, the cover 31, 81 covers around the spring 12, 76, that is, the part of the spring 12, 76 and the vicinity of the spring 12, 76, and thus the displacement of the spring 12, 76 is controlled, which restricts the inadequate posture change of the spring 12, 76. The cover 31, 81 is formed separately from the base plate 5, 62, thereby allowing the base plate 5, 62 to be formed in the simple shape instead of the complicated shape, and also restricting the posture of the spring 12, 76 from changing inadequately. Consequently, according to the embodiments, the inadequate posture change of the spring 12, 76 may be restricted appropriately without sacrificing the molding performance of the base plate 5, 62.

According to the embodiments, the base plate 5, 62 includes the supporting portion 29*a*, 71*a* provided in the moving direction of the movable wedge 6, 65 and supporting the part of the spring 12, 76.

According to the above-described structure, by providing the supporting portion 29*a*, 71*a* supporting the spring 12, 76, the spring 12, 76 is supported at the time when the spring 12, 76 generates the biasing force.

According to the above-described structure, the supporting portion 29*a*, 71*a* is provided at the spring accommodating portion 29, 71 accommodating the part of the spring 12, 76 and corresponds to the supporting surface being into contact with the outer circumferential surface of the coil portion 12*a*, 76*a*, which is wound in the coiled configuration, of the spring 12, 76.

According to the above-described structure, the displacement of the spring 12, 76 may be controlled by means that the supporting portion 29*a*, 71 is in surface contact with the outer circumference of the coil portion 12*a*, 76*a*.

According to the embodiments, the spring 12, 76 includes the coil portion 12*a*, 76*a* wound in the coiled configuration and the two arm portions 12*b*, 76*b* each protruding from the coil portion 12*a*, 76*a* and the end of each of the two arm portions 12*b*, 76*b* is in contact with the movable wedge 6, 65. The supporting portion 29*a*, 71*a* of the base plate 5, 62 supports the coil portion 12*b*, 76*a* at the portion positioned opposite to the direction in which the two arm portions 12*b*, 76*b* protrude, and the cover 31, 81 is provided for supporting at least one of the upper portion 12*c* of the coil portion 12*a*, 76*a* and the lower portion of the coil portion 12*a*, 76*a*.

According to the above-described structure, by providing the supporting portion 29*a*, 71*a*, which supports the coil portion 12*a*, 76*a* at the portion positioned opposite to the direction in which the two arm portions 12*b*, 76*b* protrude, is formed at the base plate 5, 62 and by providing the cover 31, 81 for supporting the upper portion 12*c* or the lower portion of the coil portion 12*a*, 76, the spring 12, 76 may be supported in the appropriate manner.

According to the first embodiment, the spring accommodating portion 29 accommodating the part of the spring 12 is configured to include the step portion 30 formed at the base plate 5, and the spring 12 is arranged in a manner that the upper surface of the step portion 30 and the upper portion of the spring 12 coincide with each other.

Consequently, the spring 12 is supported by the step portion 30, and thus the inadequate posture change of the spring 12 may be restricted even more adequately.

According to the first embodiment, the cover 31 is provided with the tab 33 for engaging with the step portion 30.

Consequently, the cover 31 may be attached to and removed from the base plate 5 in the simple and reliable manner.

According to the embodiment, the spring 76 includes the plural coil portions 76*a* arranged in alignment with each other.

Consequently, the outer diameter of each coil portion 76*a* (the coil diameter) may be reduced compared to a case where the biasing force having the necessary level is ensured by one coil portion. Accordingly, the size of the base plate 62 that includes the supporting portion 71*a* supporting the coil portions 76*a*, 76*a* may be reduced in the moving direction of the movable wedge device 6, 65, and thus the mountability of the base plate 5, 62 is improved.

In order to, for example, restrict the occurrence of the abnormal noise when the fixed wedge 8, 27, 68 and the movable wedge 6, 65 collide with each other, the fixed wedge 8, 27, 68 and the movable wedge 6, 65 may be made of resin.

In this case, the fixed wedge 8, 27, 68 made of resin is attached to the vehicle body panel B or to the door panel D by means of the bolt 28, 98. However, in case that the fixed wedge 8, 27, 68 is made of resin, the bearing surface for the bolt 28, 98 may be creep-deformed, which may decrease a bolt tightening force, and thus the backlash of the fixed wedge 8, 27, 68 may be generated. The backlash of the fixed wedge 8, 68, which is caused by the bolt creep, may affect a retention of the door lock assembly 4, LA in an appropriate position because the door lock assembly 4, LA is fixed to the door panel D together with the fixed wedge 8, 68 in a manner that the lock assembly 4, LA and the fixed wedge 8, 68 sandwich therebetween the door panel D.

According to the first embodiment, the fixed wedge 8 is made of resin and the metal member 36 is insert-molded to the fixed wedge 8, and the metal member 36 serves as the bearing surface for the bolt 28 for fixing the fixed wedge 8.

According to the above-mentioned structure, related to the vehicle door fixing apparatus provided with the fixed wedge 8 made of resin, the metal member 36 is insert-molded to the fixed wedge 8 and the metal member 36 serves as the bearing surface for the bolt 28 for fixing the fixed wedge 8. Consequently, the bearing surface for the bolt 28 is strengthened by using metal and thus the backlash at the fixed wedge 8, which would be otherwise caused by the creep deformation of the bearing surface, may be adequately restricted.

According to the first embodiment, the metal member 36 is configured to include the first recessed portion 37 recessed relative to the lower surface of the fixed wedge 8 and protruding downwardly below the lower surface, and the first recessed portion 37 fits in the second recessed portion 39 formed at one of the door panel D and the vehicle body panel B.

According to the above-mentioned structure, the metal member 36 is provided to include the first recessed portion 37 recessed relative to the lower surface of the fixed wedge 8 and protruding downwardly below the lower surface and the first recessed portion 37 fits in the second recessed portion 39 formed at one of the door panel D and the vehicle body panel B. Consequently, the position setting of the fixed wedge 8 on the door panel D during the attachment of the fixed wedge 8 to the door panel D is facilitated.

According to the first embodiment, the direction toward which the thickness of the fixed wedge 8 decreases is the front direction of the fixed wedge 8, the thickness of the fixed wedge 8 is the thickness at the portion where the inclined surface 9 is formed on the upper surface of the fixed wedge 8, and the direction which is opposite to the front direction is the rear direction of the fixed wedge 8. The fixed wedge 8 is formed in a manner that the lower surface of the fixed wedge 8 is positioned closer to the upper surface of the fixed wedge 8 at the rear portion of the fixed wedge 8 than at the front portion of the fixed wedge 8.

According to the above-mentioned structure, in case that the direction toward which the thickness of the fixed wedge 8 decreases is the front direction of the fixed wedge 8, the thickness of the fixed wedge 8 is the thickness at the portion where the inclined surface 9 is formed on the upper surface of the fixed wedge 8 and the direction which is opposite to the front direction is the rear direction of the fixed wedge 8, the fixed wedge 8 is formed in a manner that the lower surface of the fixed wedge 8 is positioned closer to the upper surface of the fixed wedge 8 at the rear portion of the fixed wedge 8 than at the front portion of the fixed wedge 8. Consequently, the shape of the lower surface of the fixed wedge 8 follow or substantially matches the shape of the curved portion 40 of the door panel D, to which the fixed wedge 8 is attached, thereby restricting the fixed wedge 8 from damaging the panel material of the door panel D during the assembly work.

According to the embodiments, the base plate 5, 62 includes the door lock striker 1, 61 and the spring accommodating portion 29, 71 is arranged behind the door lock striker 1, 61 in the moving direction of the movable wedge 6, 65.

According to the above-mentioned structure, the spring 12, 76 may bias or push the movable wedge 6, 65 evenly. In addition, according to the above-mentioned structure, the door lock striker 1, 61 and the spring accommodation space 29, 71 are provided at the base plate 5, 62, thereby making it simple to form the base plate 5, 62.

According to the embodiment, the inadequate posture change of the spring 12, 76 may be restricted appropriately without sacrificing the molding performance of the base plate 5, 62.

The principles, preferred embodiments and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A vehicle door fixing apparatus, comprising:

a fixed wedge configured to be fixedly attached to one of a vehicle body panel or a door panel;

a base plate configured to be fixedly attached to the other one of the vehicle body panel or the door panel, the base plate including a supporting portion;

a movable wedge slidably provided at the base plate, the movable wedge including a recessed portion;

a biasing member biasing the movable wedge toward the fixed wedge, the biasing member comprising a coil portion wound in a coil configuration and two arm portions each protruding outwardly from the coil portion, the supporting portion of the base plate supporting the coil portion, and each of the arm portions possessing a part spaced from the coil portion and in contact with a surface of the recessed portion of the movable wedge;

the movable wedge being movable relative to the base plate against the biasing of the biasing member, and during movement of the movable wedge relative to the base plate the surface of the recessed portion of the movable wedge acts on the two arm portions of the biasing member to change an angle between the two arm portions of the biasing member;

a cover fixedly attached to the base plate and covering around the biasing member; and wherein the base plate is configured to be assembled to one of the vehicle body panel or the door panel by fasteners which are covered by the movable wedge when the movable wedge is in its original position.

2. The vehicle door fixing apparatus according to claim 1, wherein the supporting portion is provided in a moving direction of the movable wedge.

3. The vehicle door fixing apparatus according to claim 2, wherein the supporting portion is provided at a biasing member accommodating portion accommodating a part of the biasing member and corresponds to a supporting surface being into contact with an outer circumferential surface of a coil portion, which is wound in a coiled configuration, of the biasing member.

4. The vehicle door fixing apparatus according to claim 2, wherein the part of each of the two arm portions in contact with the surface of the recessed portion of the movable wedge is an end part of each of the two arm portions, the supporting portion of the base plate supports the coil portion at a portion positioned opposite to a direction in which the two arm portions protrude, and the cover supports at least one of an upper portion of the coil portion and a lower portion of the coil portion.

5. The vehicle door fixing apparatus according to claim 2, wherein:

the biasing member includes a plurality of coil portions wound in a coiled configuration and the two arm portions each protrude from the plurality of coil portions, and the part of each of the two arm portions in contact with the surface of the recessed portion of the movable wedge is an end of each of the two arm portions;

the plurality of coil portions arranged in alignment with each other;

the supporting portion of the base plate supports the plurality of coil portions at a portion positioned opposite to a direction in which the two arm portions protrude, and the cover is provided for supporting at least one of an upper portion of the plurality of coil portions and a lower portion of the plurality of coil portions.

6. The vehicle door fixing apparatus according to claim 1, wherein the base plate includes a door lock striker and the biasing member accommodating portion is arranged behind the door lock striker in a moving direction of the movable wedge.

7. The vehicle door fixing apparatus according to claim 1, comprising:

a guide rail provided at the base plate or the movable wedge;

a guide groove which is provided at the other one of the base plate and the movable wedge, and with which the guide rail engages for allowing the movable wedge to slide; and an elastic member provided in a compressed state between a surface of the guide rail and a wall of the guide groove.

8. The vehicle door fixing apparatus according to claim 1, wherein the fasteners are bolts.

9. A vehicle door fixing apparatus, comprising:

a fixed wedge configured to be fixedly attached to a door panel;

a base plate configured to be fixedly attached to a vehicle body panel, the base plate including a supporting portion;

a movable wedge slidably provided at the base plate, the movable wedge including a recessed portion;

a biasing member biasing the movable wedge toward the fixed wedge, the biasing member comprising a coil portion wound in a coil configuration and two arm portions each protruding outwardly from the coil portion, the supporting portion of the base plate supporting the coil portion and each of the arm portions possessing a part spaced from the coil portion and in contact with a surface of the recessed portion of the movable wedge;

the movable wedge being movable relative to the base plate against the biasing of the biasing member, and during movement of the movable wedge relative to the base plate the surface of the recessed portion of the movable wedge acts on the two arm portions of the biasing member to change an angle between the two arm portions of the biasing member;

a cover fixedly attached to the base plate and covering around the biasing member; and wherein the base plate is configured to be assembled to the vehicle body panel by fasteners which are covered by the movable wedge.

10. The vehicle door fixing apparatus according to claim 9, wherein the supporting portion is provided in a moving direction of the movable wedge.

11. The vehicle door fixing apparatus according to claim 10, wherein the supporting portion is provided at a biasing member accommodating portion accommodating a part of the biasing member and corresponds to a supporting surface being into contact with an outer circumferential surface of the coil portion of the biasing member.

12. The vehicle door fixing apparatus according to claim 10, wherein the the part of each of the two arm portions in contact with the surface of the recessed portion of the movable wedge is an end of each of the two arm portions, the supporting portion of the base plate supports the coil portion at a portion positioned opposite to a direction in which the two arm portions protrude, and the cover is provided for supporting at least one of an upper portion of the coil portion and a lower portion of the coil portion.

13. The vehicle door fixing apparatus according to claim 10, wherein the biasing member includes a plurality of coil portions wound in a coiled configuration and the two arm portions each protruding from the plurality of coil portions, the part of each of the two arm portions that is in contact with the surface of the recessed portion of the movable wedge is an end of each of the two arm portions;

the plurality of coil portions arranged in alignment with each other;

the supporting portion of the base plate supports the plurality of coil portions at a portion positioned opposite to a direction in which the two arm portions protrude, and the cover is provided for supporting at least one of an upper portion of the plurality of coil portions and a lower portion of the plurality of coil portions.

14. The vehicle door fixing apparatus according to claim 9, wherein the base plate includes a door lock striker and the biasing member accommodating portion is arranged behind the door lock striker in a moving direction of the movable wedge.

15. The vehicle door fixing apparatus according to claim 9, comprising:

a guide rail provided at the base plate;

a guide groove which is provided at the movable wedge, and with which the guide rail engages for allowing the movable wedge to slide; and an elastic member provided in a compressed state between a surface of the guide rail and a wall of the guide groove.

16. The vehicle door fixing apparatus according to claim 9, wherein the fasteners are bolts.

* * * * *